United States Patent [19]

Tsujimoto et al.

[11] 4,306,399

[45] Dec. 22, 1981

[54] AUTOMATIC BAGGING APPARATUS AND A METHOD THEREFOR

[75] Inventors: Eiichi Tsujimoto; Masataka Maruyama; Osamu Kosaki, all of Kobe, Japan

[73] Assignee: Kawatetsu Metrological Equipment and Vending Machine Co., Ltd., Nishinomiya, Japan

[21] Appl. No.: 91,816

[22] Filed: Nov. 6, 1979

[30] Foreign Application Priority Data

May 22, 1979 [JP] Japan ..... 54-63484

[51] Int. Cl.[3] ..... B65B 43/36; B65B 43/30; B65B 57/02

[52] U.S. Cl. ..... 53/52; 53/75; 53/571; 53/385; 53/386; 53/503

[58] Field of Search ..... 53/571, 503, 572, 504, 53/385, 386, 459, 52, 75

[56] References Cited

U.S. PATENT DOCUMENTS

| | | | |
|---|---|---|---|
| 2,958,990 | 11/1960 | Kerker | 53/571 X |
| 3,480,114 | 11/1969 | Shoffner | 53/571 X |
| 3,490,195 | 1/1970 | Abramson | 53/572 X |
| 3,546,829 | 12/1970 | Lonergan | 53/390 X |
| 3,699,741 | 10/1972 | Norman | 53/390 X |
| 3,935,691 | 2/1976 | Broch | 53/385 X |
| 4,183,194 | 1/1980 | Lucke | 53/385 X |

*Primary Examiner*—Horace M. Culver
*Attorney, Agent, or Firm*—Wenderoth, Lind & Ponack

[57] ABSTRACT

An automatic bagging apparatus for automatically packing articles into a bag comprises a horizontally movable tray assembly operable to transport and insert the articles towards the bag and a loader assembly simultaneously movable together with the tray assembly during the loading of the articles into the bag. When the loader assembly is to be retracted leaving the articles inside the bag, the loader assembly starts its return movement independently of and subsequent to the return of the tray assembly. The bag is, after having been fed from at least one bag box to a bag receptacle, positioned frontwardly of the tray assembly and is completely opened by the application of at least one blow of compressed air in to the bag subsequent to the opening of the mouth of the bag. The loading of the articles into the bag is initiated after the bag has been so completely opened. The loaded bag is then erected by tilting it downwards about the point of pivot located adjacent the mouth of the bag and then pivoting the same upwards about the point of pivot located adjacent the bottom thereof.

19 Claims, 51 Drawing Figures

AUTOMATIC BAGGING APPARATUS AND A METHOD THEREFOR

The present invention generally relates to an automatic bagging apparatus and a method for automatically packing articles to be bagged into a bag.

The recent trend in supermarket industries is to minimize the number of employees and, particularly, to eliminate a clerk assigned to work on packing articles item by item into a bag, leaving only the cashier at the check-out counter. One method to achieve this is to assign the existing cashier to transfer the articles item by item from one shopping basket or cart onto another while inputting the price of each of the articles into the cash register and to let the customer pack his own purchased articles into a bag. This method appears to be efficient, but in the long-term prospect of supermarket management appears not to be feasible partly because of the increased labor imposed on the cashier and partly because of inconvenience the customer may suffer.

In view of the above, various automatic bagging apparatuses have heretofore been developed, such as disclosed in the U.S. Pat. No. 2,958,990, patented Nov. 8, 1960; the U.S. Pat. No. 3,699,741, patented Oct. 24, 1972; and the U.S. Pat. No. 3,763,628, patented Oct. 9, 1973.

The automatic bagging apparatus disclosed in each of these patents is capable of performing, in sequence, the feeding of one bag at a time from a bag container to a merchandise receiving station, the opening of the mouth of the bag at the merchandise receiving station, the loading of articles to be bagged into the mouth-opened bag, and the transportation of the loaded bag to a delivery zone where the customer can pick the loaded bag up subsequent to the settlement of payment.

However, in all of these prior art automatic bagging apparatuses, the loading of the articles to be bagged is carried out by inserting the tray assembly with the articles thereon into the mouth-opened bag resting at the merchandise receiving station. Therefore, these prior art automatic bagging apparatuses involve such a possibility that, during the insertion of the tray assembly with the articles being loaded into the mouth-opened bag, one or both of the tray assembly and some of the articles to be bagged contact portions of the bag, thereby tearing the bag. This is particularly true where a block of the articles placed on the tray assembly has an edge corner on one hand and the bag is made of paper or a thin sheet of synthetic resin on the other hand. Once the bag is torn while it rests at the merchandise receiving station, the machine no longer operates unless the torn bag is removed.

In particular, the U.S. Pat. No. 3,763,628 discloses the application of a blast of compressed air into the mouth-opened bag to cause the latter to be popped open or bulged open to such an extent as to establish a substantially rectangular cubic interior shape inside the bag. However, in this prior art automatic bagging apparatus, the above described possibility of tearing of the bag in contact with the tray assembly and/or some of the articles to be bagged is relatively high. This is because, even though the mouth-opened bag is popped open by the application of the compressed air thereinto, the upper lip of the bag tends to hand down, thereby narrowing the opening of the mouth of the bag to such an extent that, during the subsequent loading of the articles to be bagged, some of the articles carried by the tray assembly may contact and, consequently, tear the upper lip of the bag.

In addition, none of these prior art automatic bagging apparatuses have a tray size adjusting capability which is necessary to render the machine to be operable by the utilization of bags of different sizes one at a time.

The following prior art references appear to be of interest. The U.S. Pat. No. 2,924,053 of Feb. 9, 1960 discloses a check-out counter including a displaceable portion which is inclined to one of several different angles to facilitate the packing of articles to be bagged. The U.S. Pat. No. 2,950,589 of Aug. 30, 1960 discloses a bag feeding mechanism including four interior jaws, adapted to be inserted into the half-opened mouth of the bag while the upper lip of the mouth of the bag is sucked, and four exterior jaws cooperable with the interior jaws to clamp the mouth of the bag, and means for moving these jaws in a direction away from each other to open the mouth of the bag to such an extent as to produce a substantially rectangular-sectioned mouth. The U.S. Pat. No. 2,973,610 of Mar. 7, 1961 discloses a bag filling machine suited for packing sliced items into transparent flexible plastic bags. The U.S. Pat. No. 2,987,863 of June 13, 1961 discloses a bag opener including a pair of pivotally supported tongue members adapted to be inserted into the bag and then to be pivoted in a direction away from each other to open the mouth of the bag.

The U.S. Pat. No. 3,490,195 of Jan. 20, 1970 discloses an automatic packaging machine operable for the use of a stack of bags tied together at their marginal portions by means of a wicket having a pair of opposed legs extending through the marginal portions of the bags in the stacked condition. The U.S. Pat. No. 3,774,370 of Nov. 27, 1973 discloses a merchandise bagging apparatus including a tray assembly which moves, i.e., retracts, in a direction away from the bag only when the articles to be bagged are desired to be left inside the bag which has manually been slipped over the tray assembly. The U.S. Pat. No. 3,855,757 of Dec. 24, 1974 discloses an automatic bagging device including a bag receptacle having its inner surfaces so designed as to maintain the bag in a fully opened position by vacuum until the bag is filled with articles to be bagged.

The present invention has been developed in view to substantially eliminating the disadvantages and inconveniences inherent in the prior art automatic bagging apparatuses and has for its essential object to provide an improved automatic bagging apparatus which will function in a fool-proof manner, at high speed and over a long period of time.

Another important object of the present invention is to provide an improved automatic bagging apparatus of the type referred to above, which is safe to operate and does not cause the customer to be worried about his goods or purchases being damaged during the packing into the bag.

A further object of the present invention is to provide an improved automatic bagging apparatus of the type referred to above, which can be operated by one person instead of two or more persons, in order to save the cost of labor at the check-out station of a supermarket or any other store or in industrial facilities.

A still further object of the present invention is to provide an improved automatic bagging apparatus of the type referred to above, which is inexpensive in the cost of manufacture, simple in design, efficient in operation and time saving.

It is a related object of the present invention to provide a method for automatically packing articles to be bagged into a bag, which can readily be performed in a foolproof manner and at high speed.

In order to accomplish these and other objects of the present invention, there is provided an improved automatic bagging apparatus which performs the loading of goods or purchases into a bag by causing a tray assembly to move from a retracted position towards an inserted position together with a loader assembly then pushing the goods or articles on the tray assembly while moving from a withdrawn position towards a pushed position. The movement of the tray assembly towards the inserted position is initiated after the bag has been transported from a container towards a bag receiving means, positioned frontwardly of the tray assembly with respect to the direction of movement of said tray assembly towards the inserted position, and then completely popped or bulged open to such an extent as to establish a substantially rectangular cubic interior space inside the bag.

During the insertion of the goods or purchases together with the tray assembly into the completely opened bag on the bag receiving means, the upper and lower lips of the mouth of the bag are retained in position by upper and a lower clamping devices on one hand and the side walls connecting the upper and lower lips of the mouth of the bag are spread by side flaps. Accordingly, even though some of the goods or purchases contact portions of the completely opened bag, there is no substantial possibility of the bag being torn. In addition, as evidenced by a series of tests conducted by the present inventors, since the tray assembly when moved to the inserted position is completely inserted in the completely opened bag and since the tray assembly in the inserted position is subsequently allowed to return towards the retracted position leaving the loader assembly at the pushed position, the above described possibility is minimized or substantially eliminated.

The complete opening of the bag resting on the bag receiving means is carried out by applying a plurality of blasts of compressed air in rapid sequence. Preferably, the number of the blasts of the compressed air is two.

The improved automatic bagging apparatus according to the present invention further comprises a gating assembly supported for movement between closed and opened position in a direction perpendicular to the direction of movement of the tray assembly, said gating assembly when in the closed position substantially forming the front wall of the tray assembly in opposition to the loader assembly and when in the opened position permitting the passage of the tray assembly and the loader assembly past said gating assembly.

The bag which has been loaded with the goods or purchases and still resting on the bag receiving means is, after the loader assembly has been moved back to the withdrawn position subsequent to the return of the tray assembly back to the retracted position, erected into an upright position convenient for the customer to take it away. Preferably, the erecting of the loaded bag is, according to the present invention, carried out by first tilting the loaded bag with the bottom thereof lowered and then pivoting the loaded bag about the point of pivot located adjacent the bottom of the loaded bag. By so doing, there is such an advantage that the possibility of falling out of some of the goods or purchases positioned inside the bag, but adjacent the mouth of the bag, which would occur when the loaded bag is abruptly erected as is the case with the conventional bagging machine, can be avoided.

In any event, these and other objects and features of the present invention will become apparent from the following description taken in conjunction with a preferred embodiment thereof with reference to the accompanying drawings, in which.

Figure 11A:
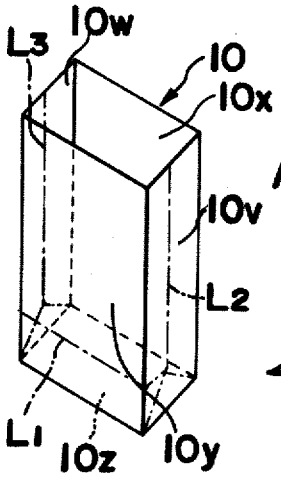
Figure 11B:
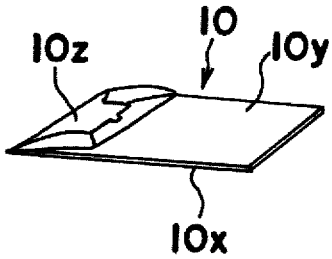
Figure 12:
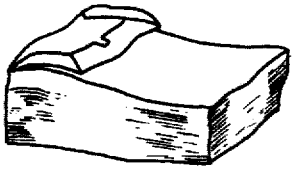
Figure 13:
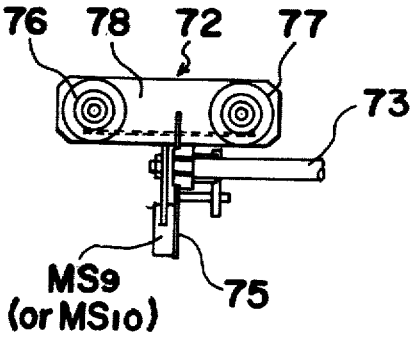
Figure 14:
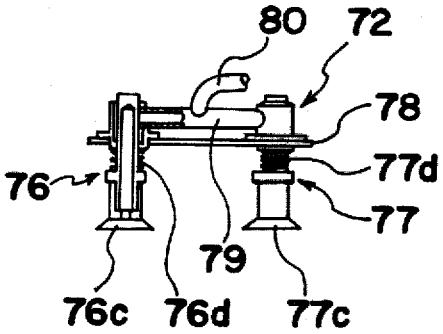
Figure 9:
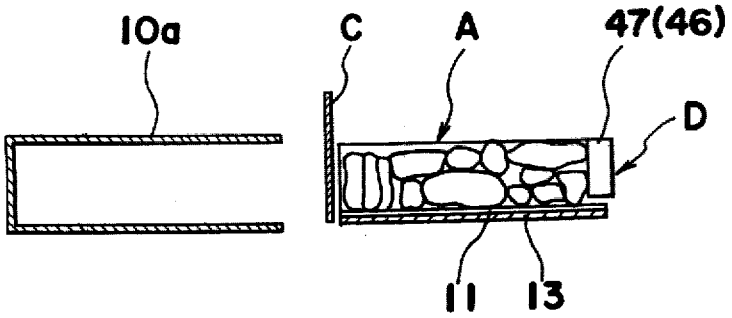
Figure 9:
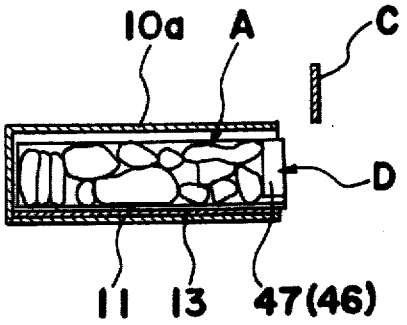
Figure 9:
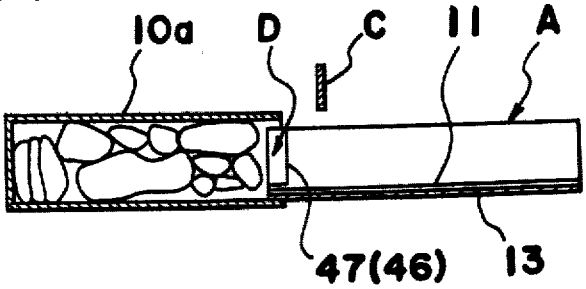
Figure 9:
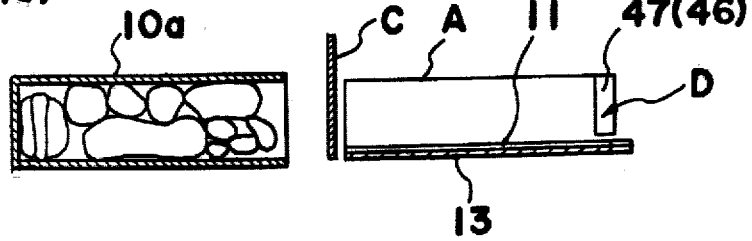
Figure 10:
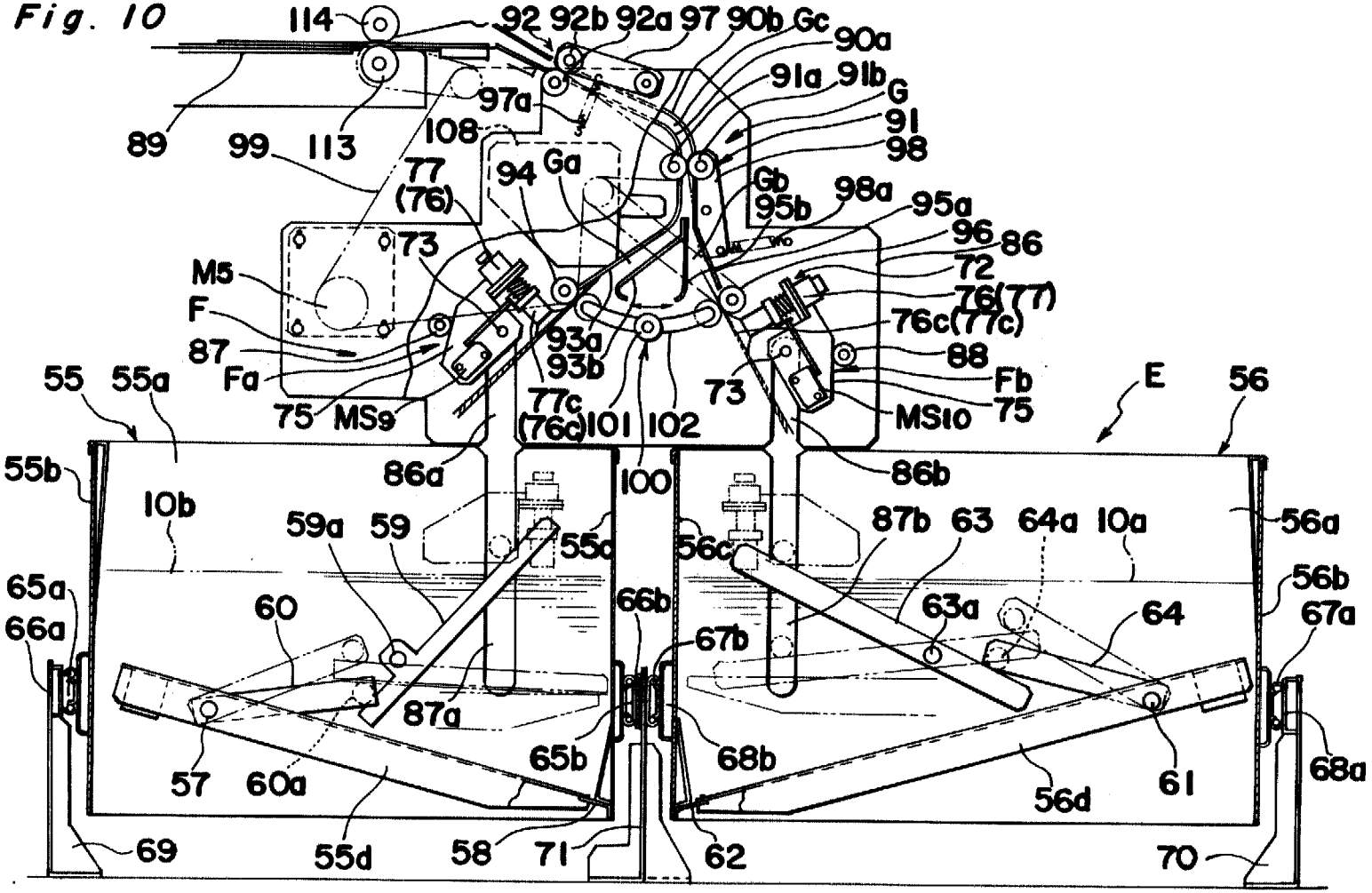
Figure 15:
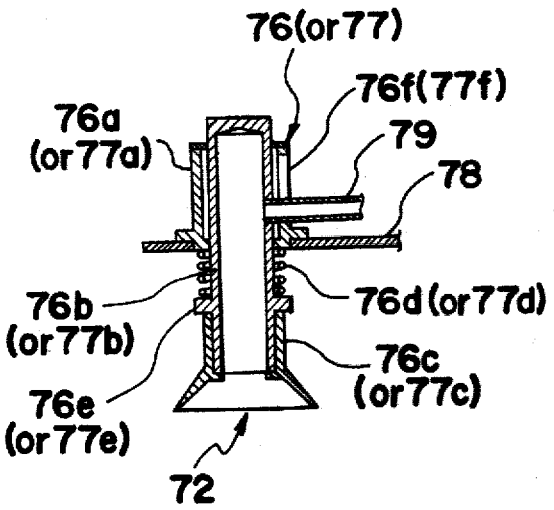
Figure 16:
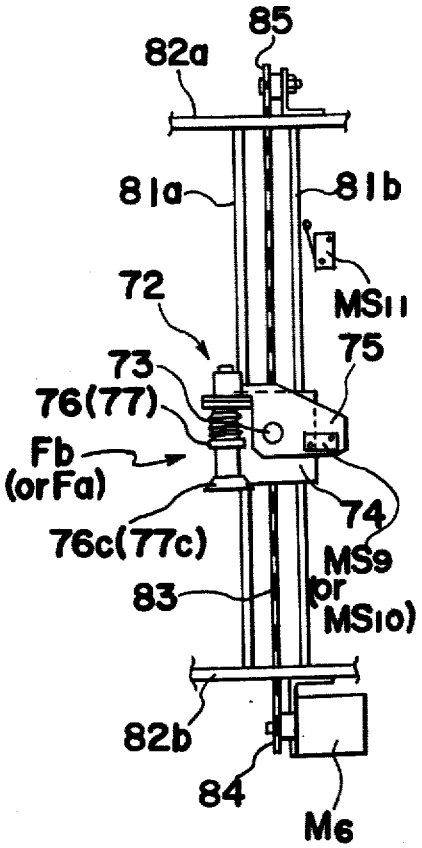
Figure 17:
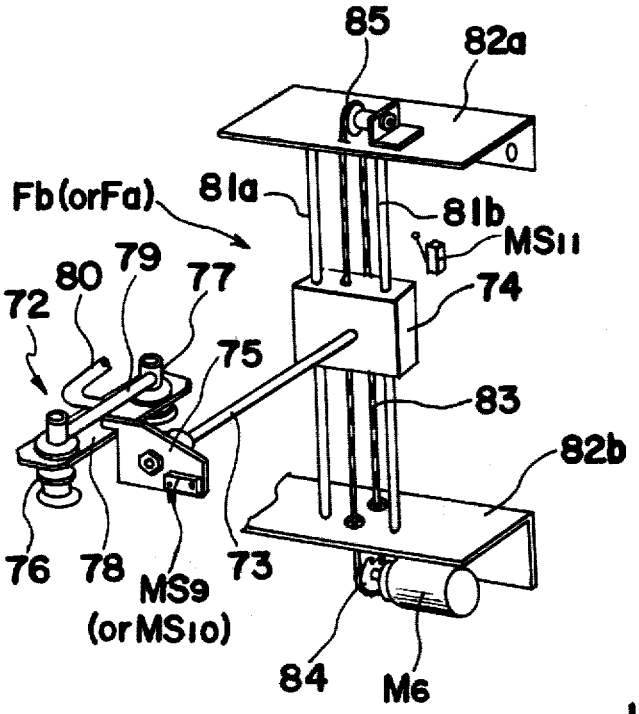
Figure 18:
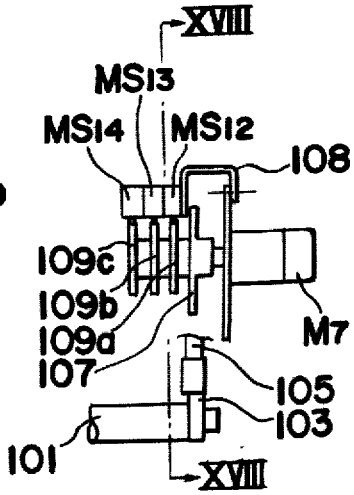
Figure 18:
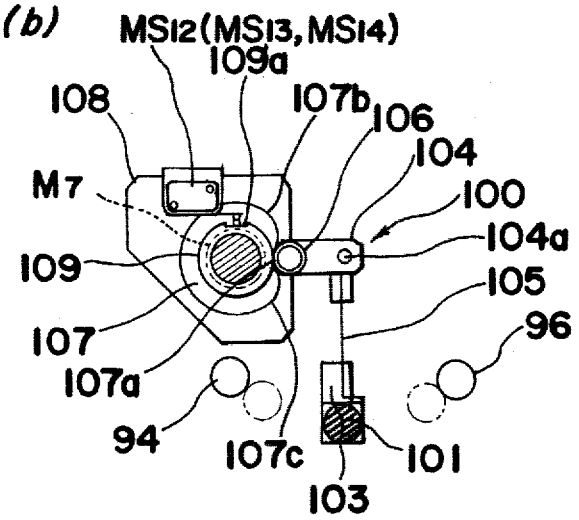
Figure 19:
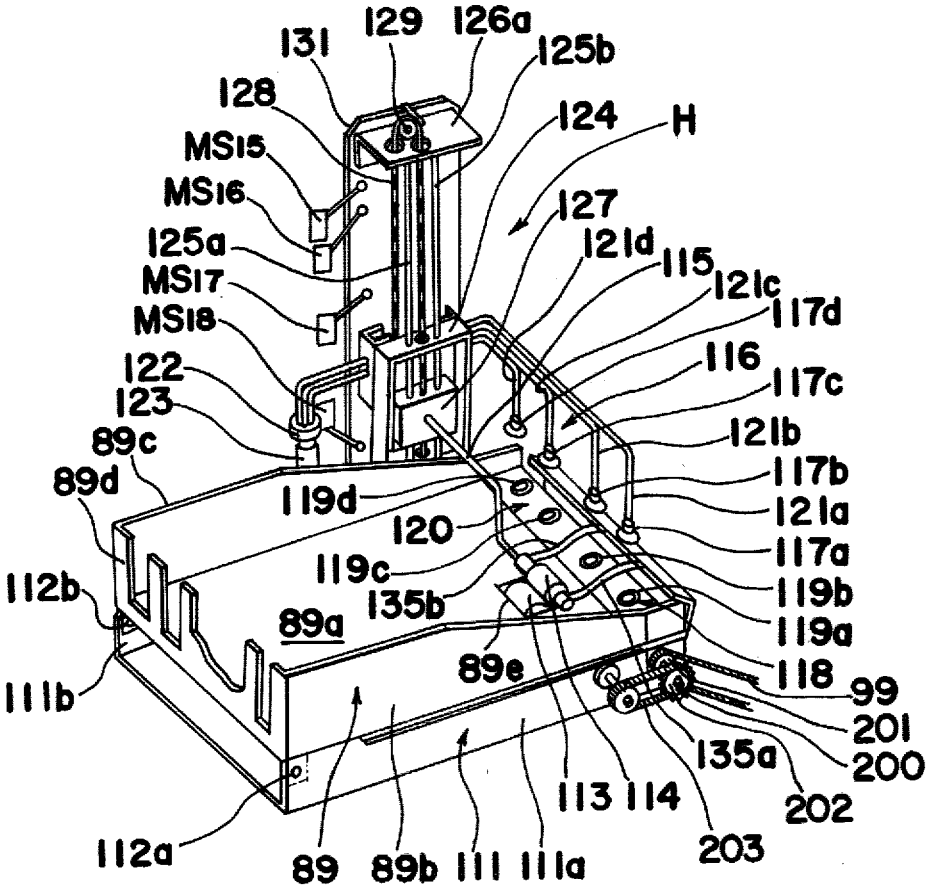
Figure 20:
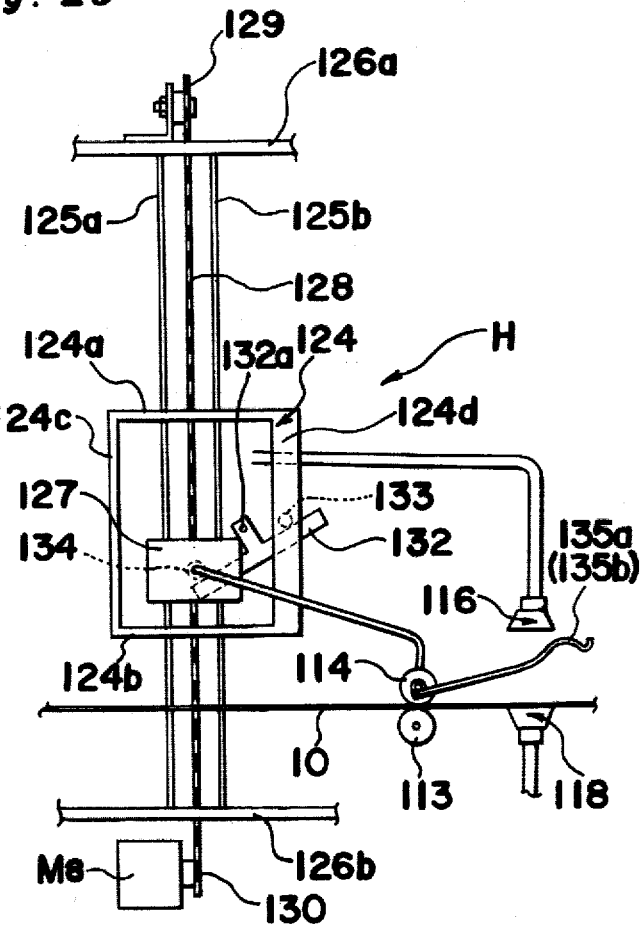
Figure 21:
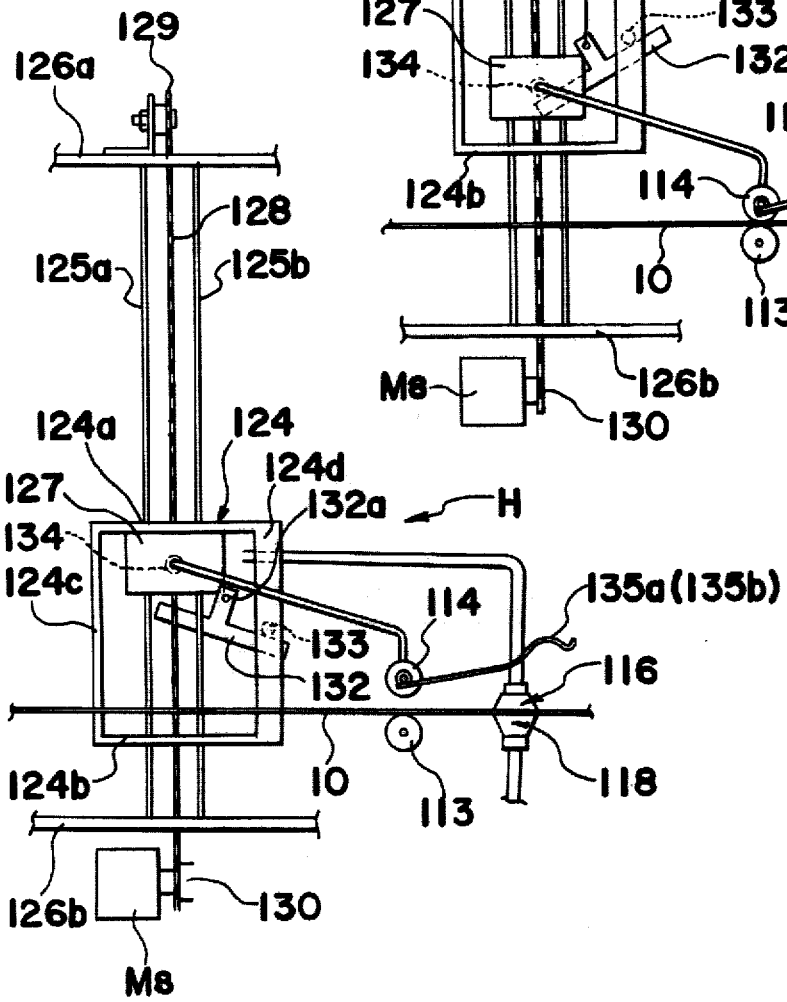
Figure 22:
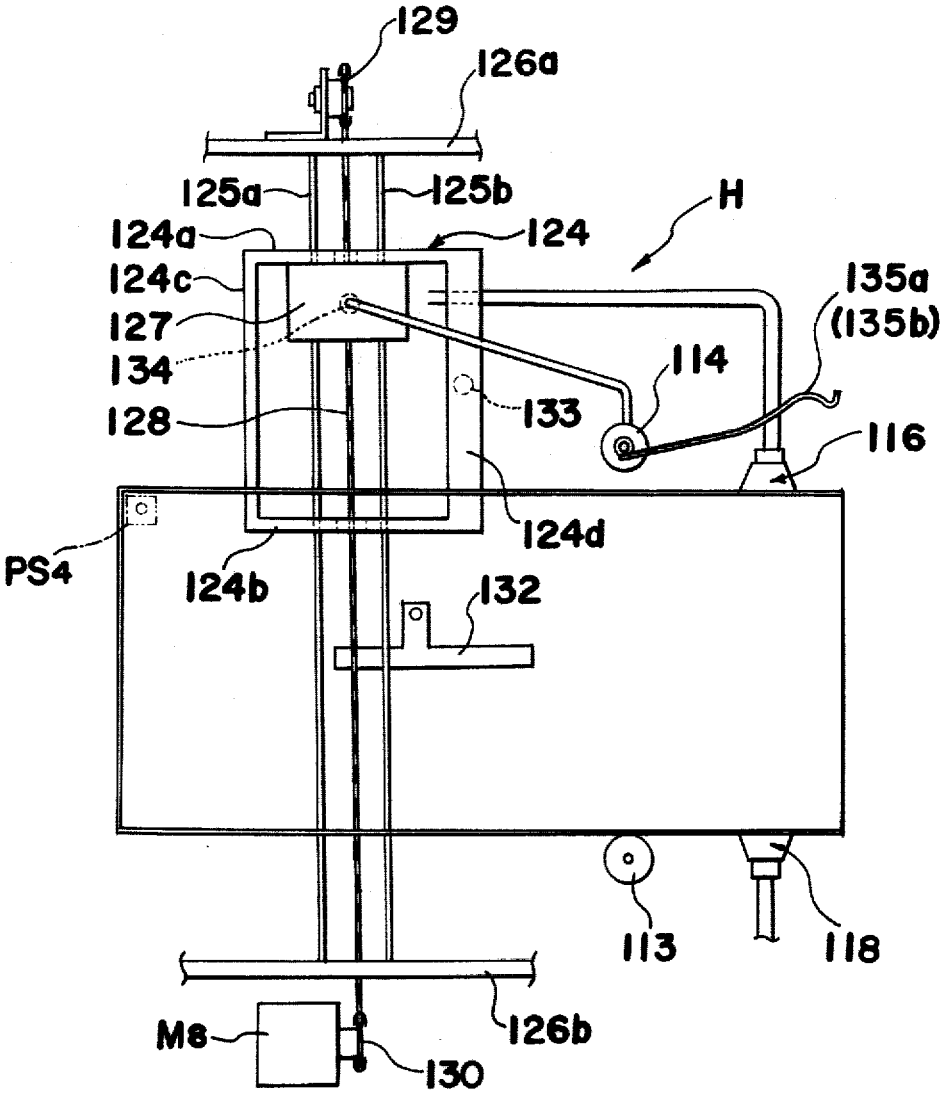
Figure 23:
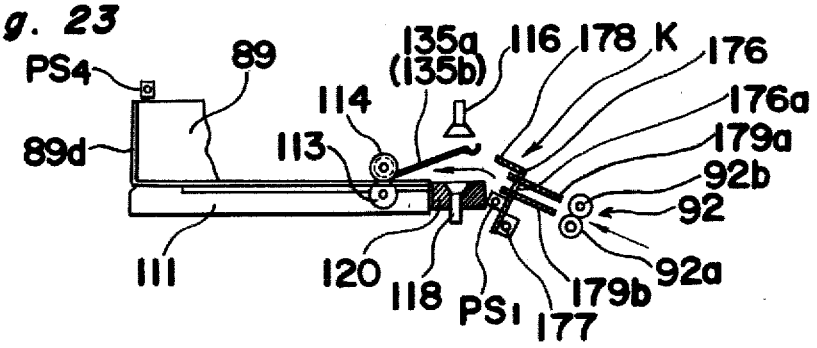
Figure 24A:
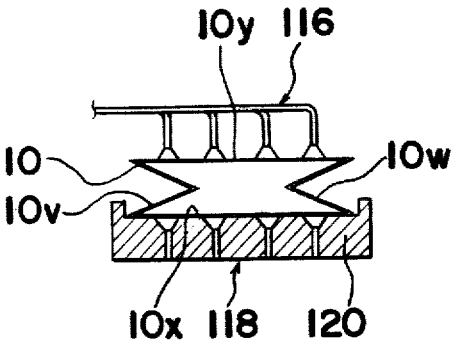
Figure 24B:
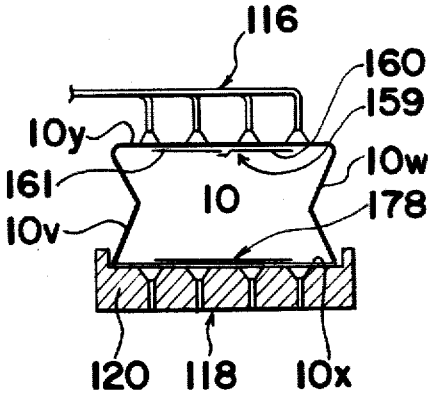
Figure 24C:
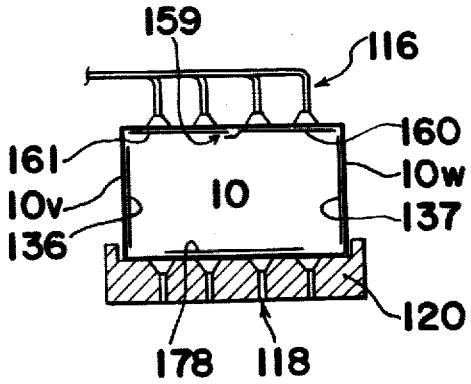
Figure 27A:
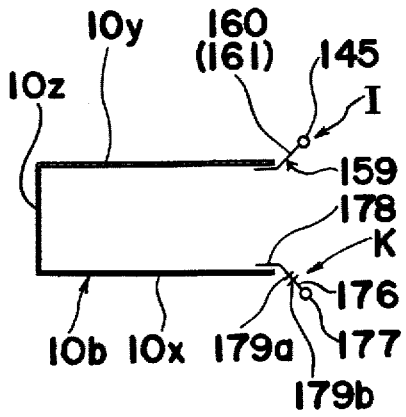
Figure 27B:
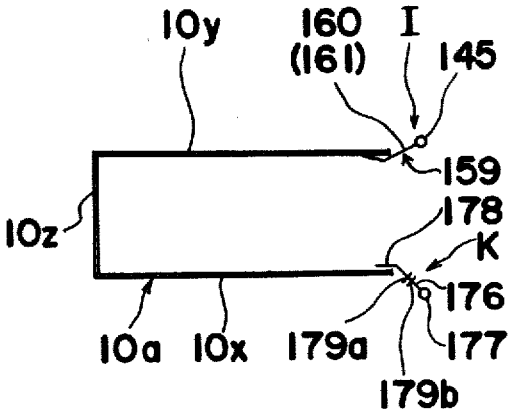
Figure 25:
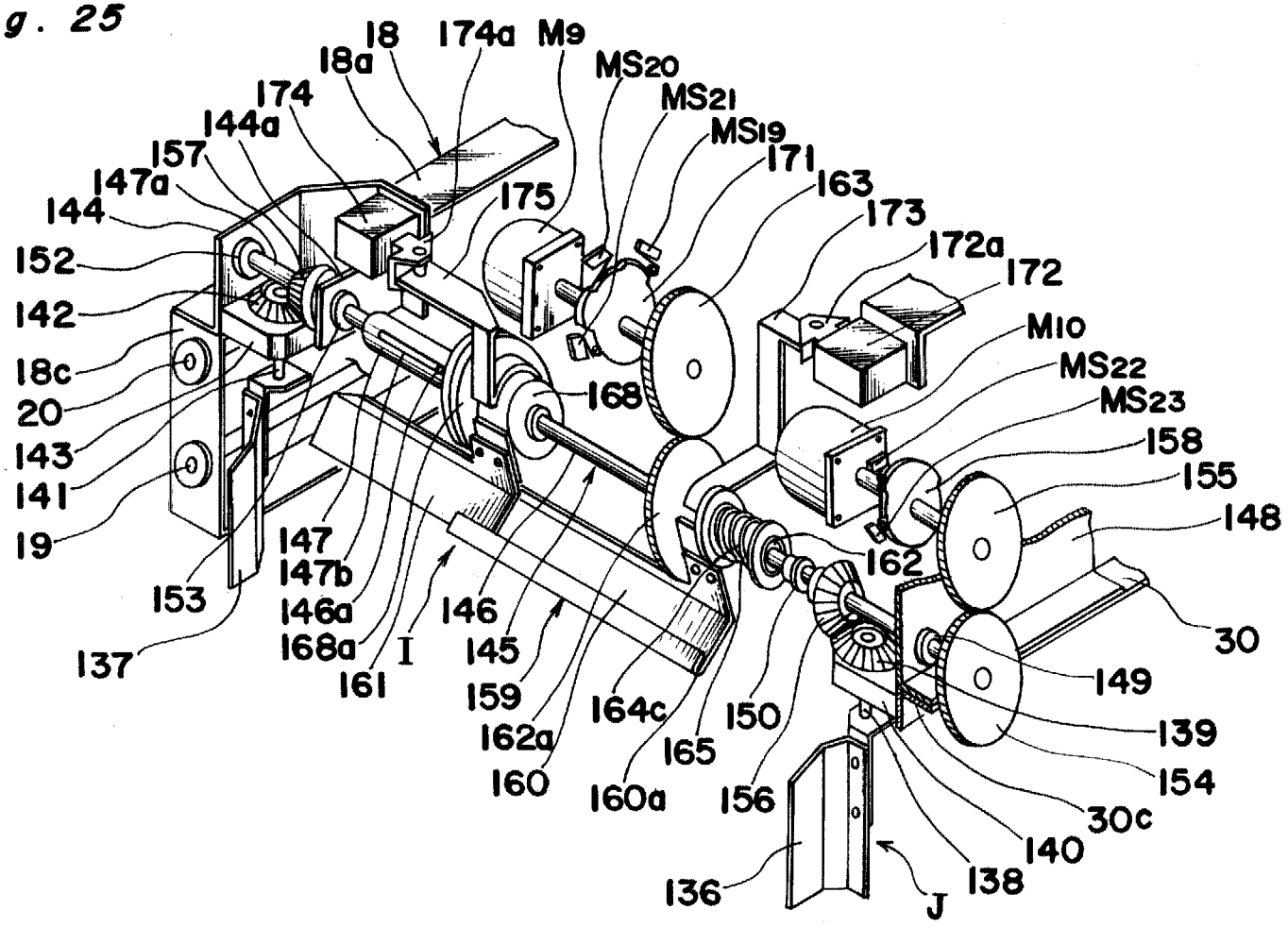
Figure 26:
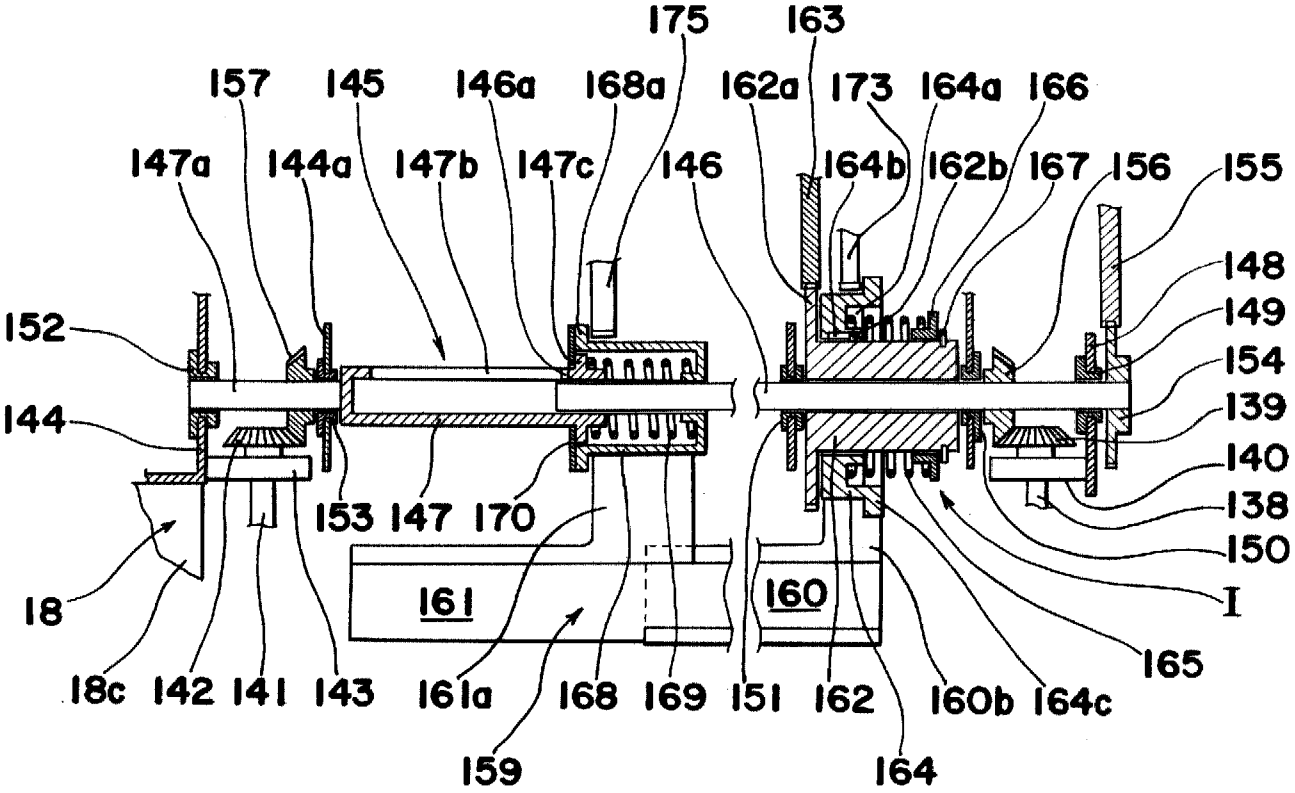
Figure 28:
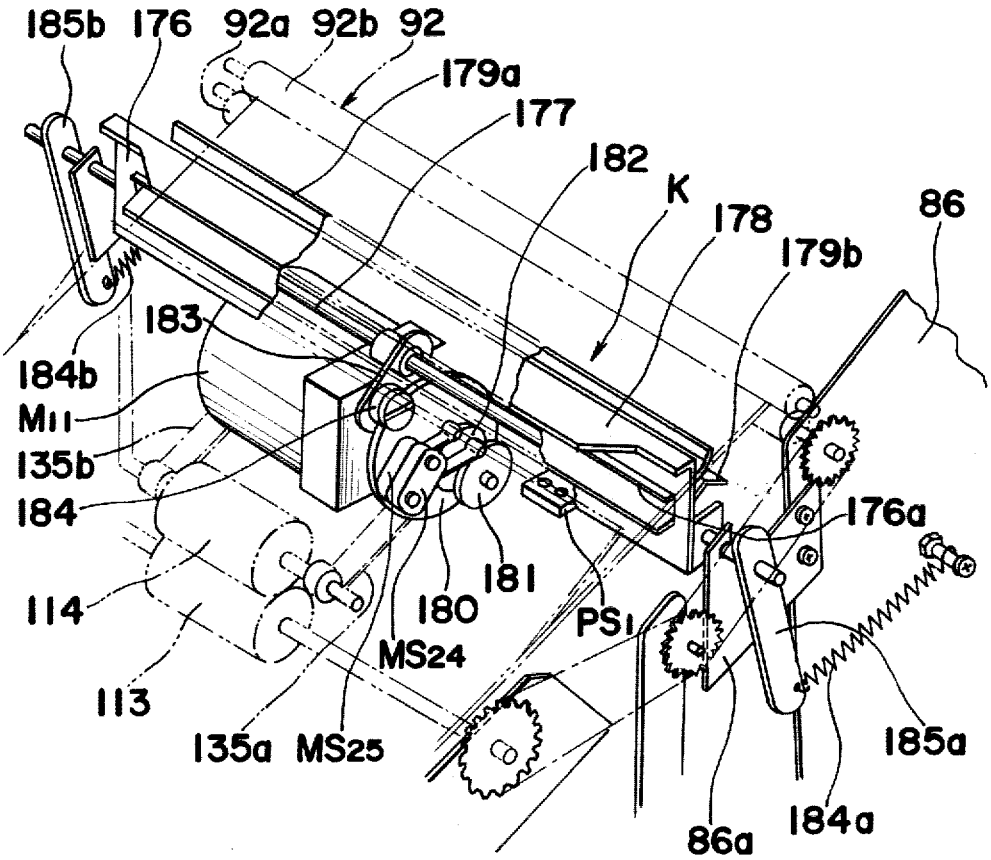
Figure 29:
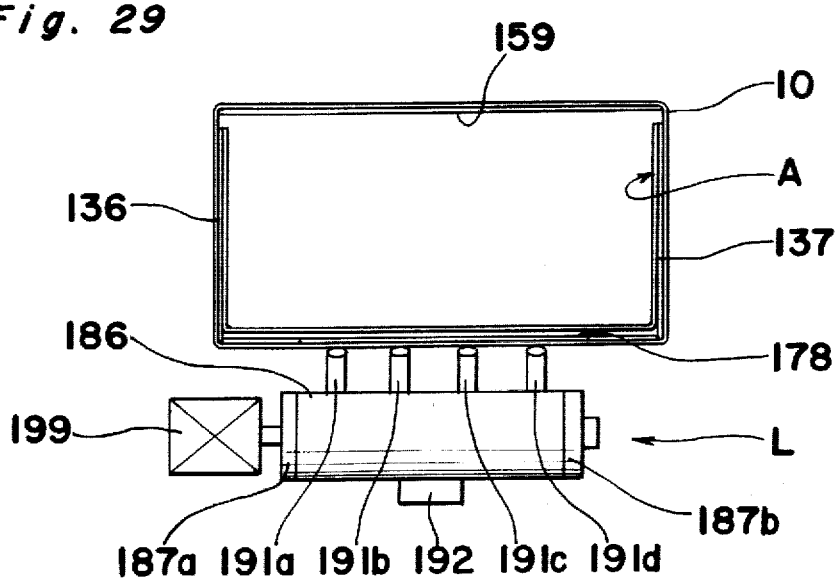
Figure 30:
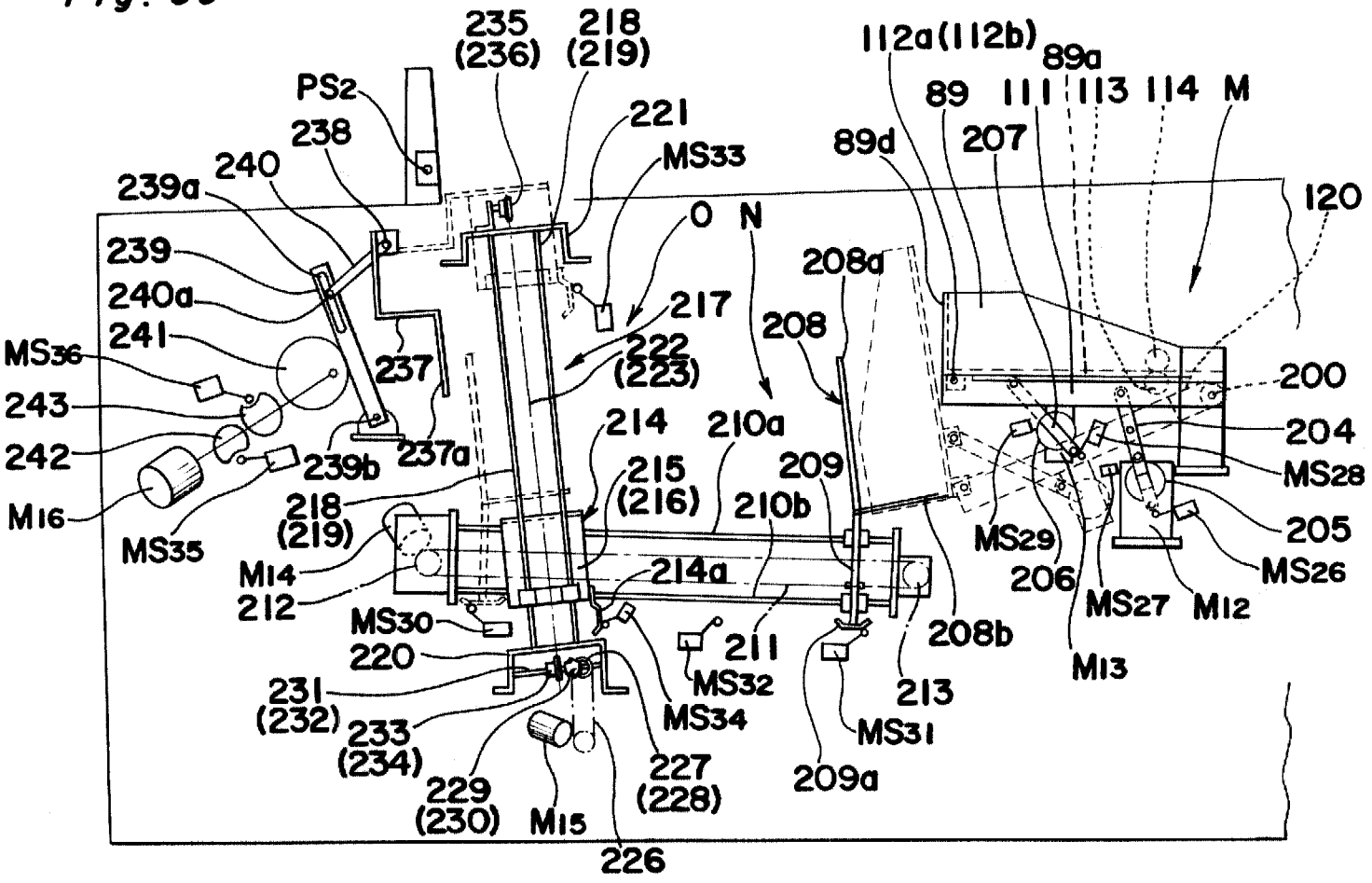
Figure 31:
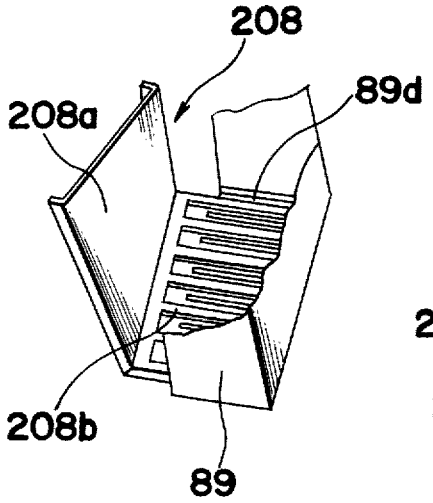
Figure 32:
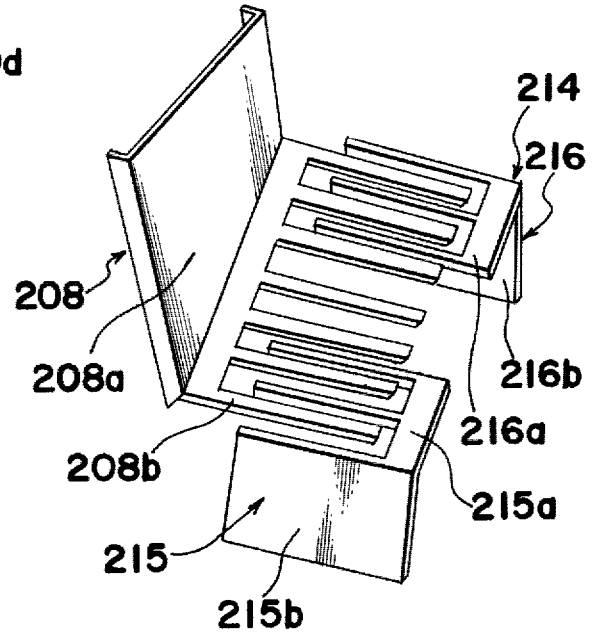
Figure 33:
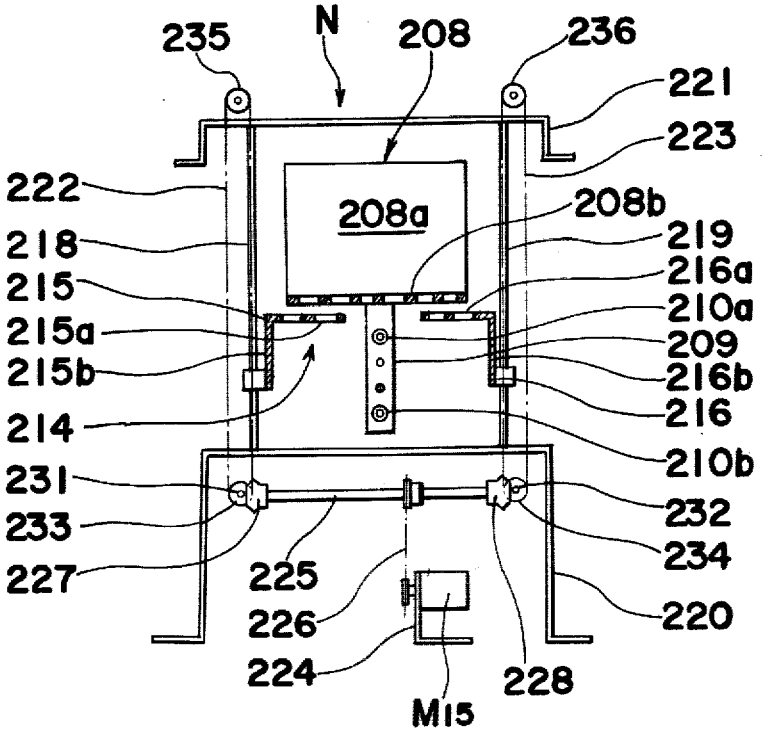
Figure 34:
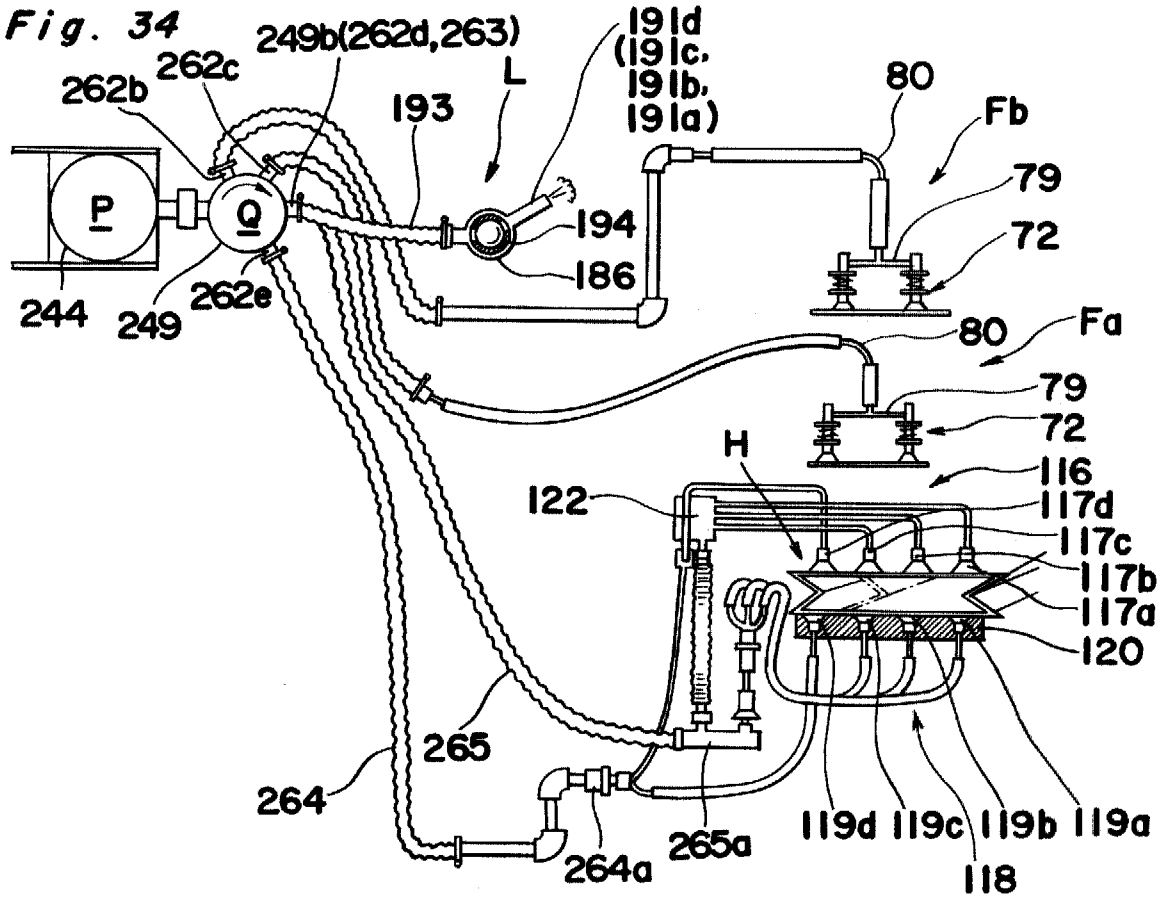
Figure 35:
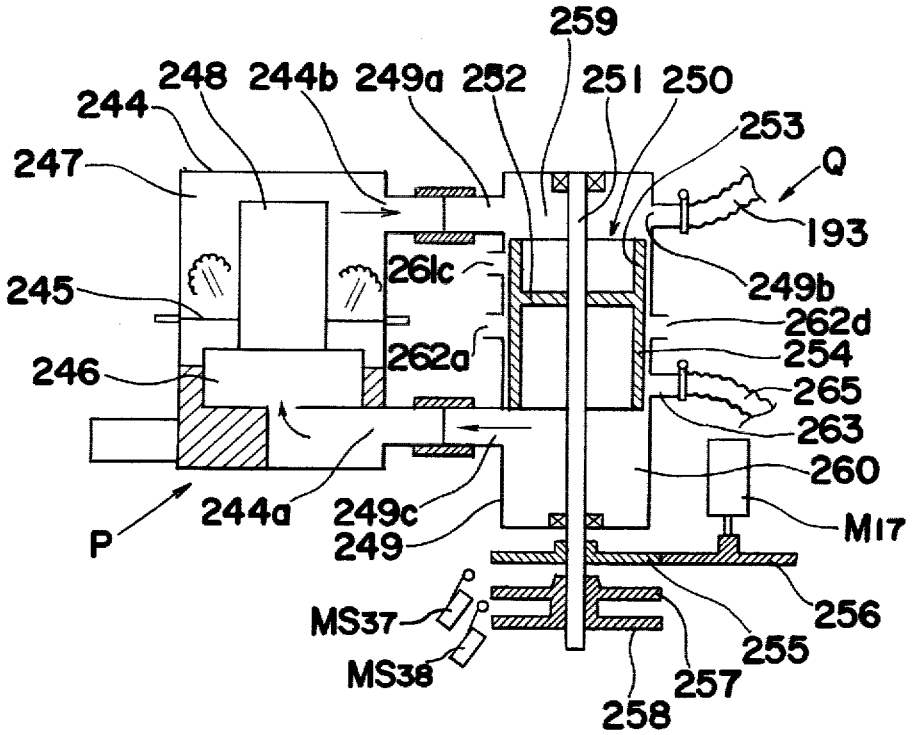
Figure 36:
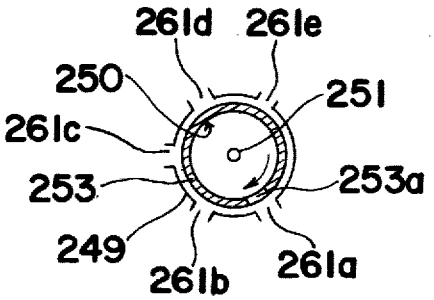
Figure 36:
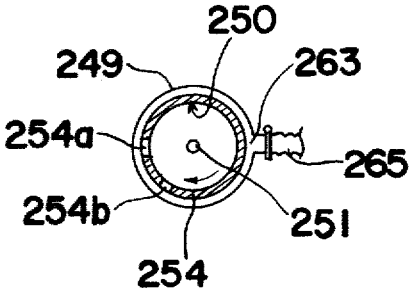
Figure 36:
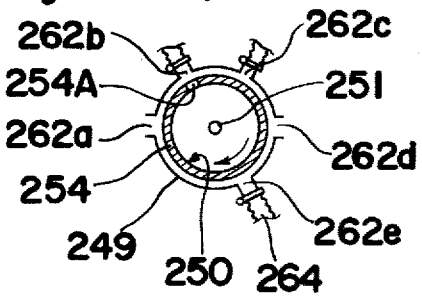
Figure 37:
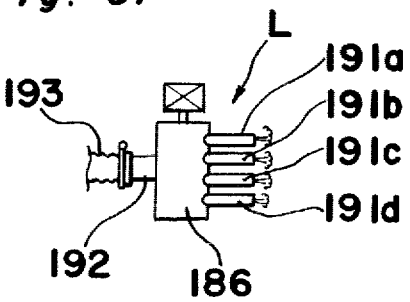
Figure 38:
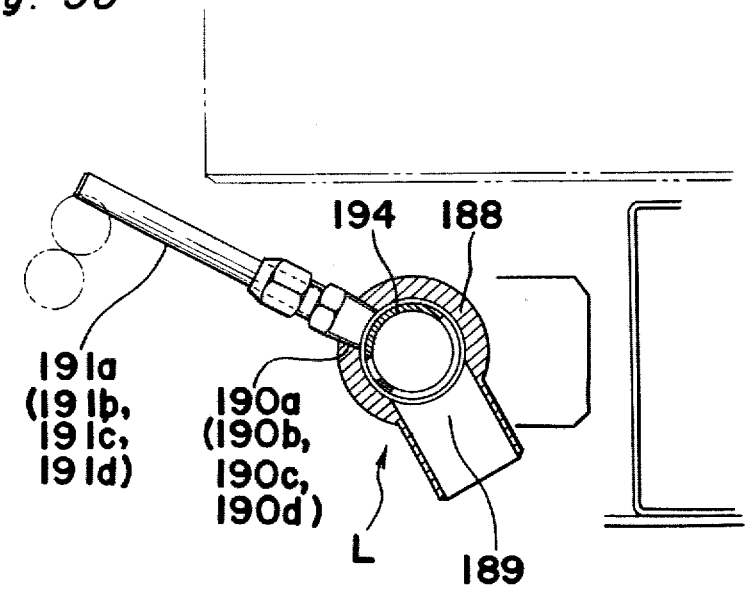
Figure 39:
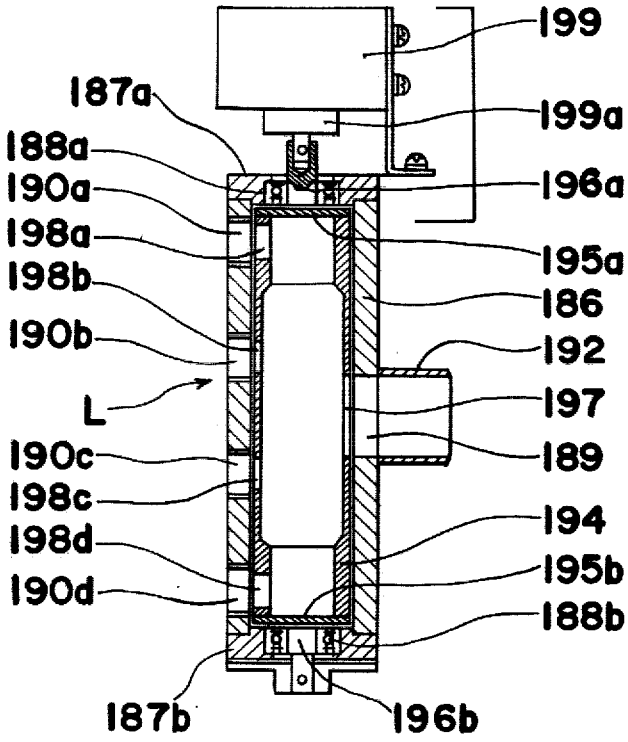
Figure 40:
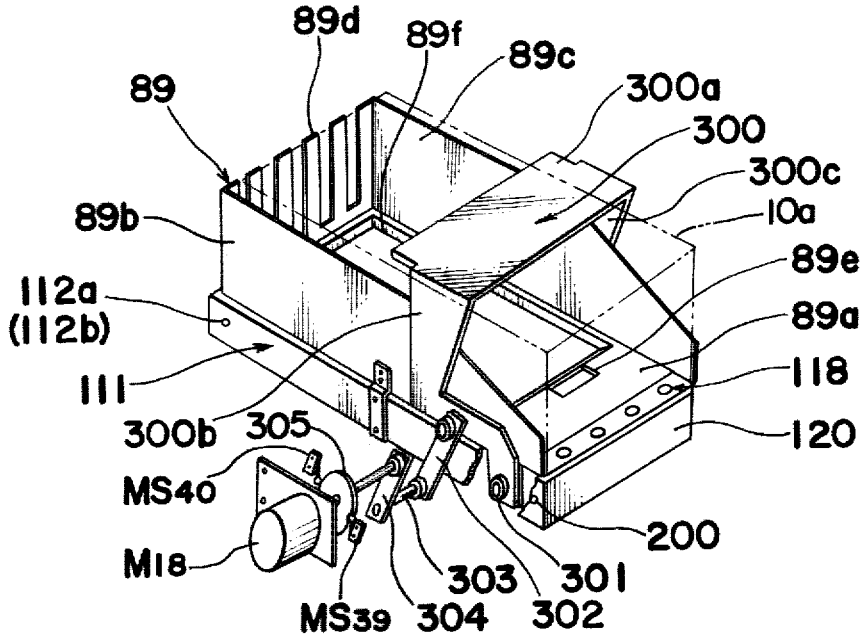

FIGS. 9 (*a*) to 9(*d*) are schematic diagrams showing the timed operation of the tray assembly and the loader assembly relative to a bag;

FIG. 10 is a side sectional view of a bag supply unit employed in the automatic bagging apparatus, said bag supply unit including a bag container, a bag pick-up mechanism and a bag feeding mechanism;

FIGS. 11(*a*) and 11(*b*) are schematic perspective views of a bag in different positions;

FIG. 12 is a schematic perspective view showing a plurality of bags in a stacked condition;

FIGS. 13 and 14 are bottom and side views, respectively, of one of suction head assemblies of the bag pick-up mechanism;

FIG. 15 is a side sectional view, on an enlarged scale, of one of suction heads of each of the suction head assemblies shown in FIGS. 13 and 14;

FIGS. 16 and 17 are side and perspective views of the bag pick-up mechanism;

FIG. 18(*a*) is a schematic side view of a path selector of the bag feeding mechanism;

FIG. 18(*b*) is a cross sectional view taken along the line XVIII—XVIII in FIG. 18(*a*);

FIG. 19 is a perspective view showing a bag receptacle and a suction opener and retainer;

FIGS. 20 to 22 are schematic side views of the suction opener and retainer in different operative positions, respectively;

FIG. 23 is a schematic side view of the bag receptacle shown relative to a bag mouth clamping mechanism;

FIGS. 24(*a*) to 24(*c*) are schematic front elevational views showing the sequence of steps in the bag mouth opening;

FIG. 25 is a perspective view showing the bag mouth clamping mechanism;

FIG. 26 is a longitudinal sectional view showing the details of a shaft structure employed in the bag mouth clamping mechanism;

FIGS. 27(*a*) and 27(*b*) are schematic side sectional views showing the small and large size bags relative to the bag mouth clamping mechanism;

FIG. 28 is a perspective view, with a portion broken away, showing a drive mechanism for a lower clamping device of the bag mouth clamping mechanism;

FIG. 29 is a front elevational view showing the position of the bag mouth clamping mechanism and that of an air injector;

FIG. 30 is a schematic side view showing the details of a delivery unit;

FIG. 31 is a schematic perspective view of a portion of the bag receptacle relative to a transporting carriage of the delivery unit;

FIG. 32 is a schematic perspective view of a portion of the transporting carriage relative to a lifting carriage employed in the delivery unit;

FIG. 33 is a front sectional view showing the relative position of the transporting carriage and the lifting carriage;

FIG. 34 is a schematic diagram showing a pneumatic circuit employed in the automatic bagging apparatus;

FIG. 35 is a schematic side sectional view of a blower assembly connected with a pneumatic distributor;

FIGS. 36(*a*) to 36(*c*) are cross sectional views of the pneumatic distributor showing the position of a rotary valving body relative to various ports;

FIG. 37 is a schematic top plan view of the air injector;

FIG. 38 is a cross sectional view, on an enlarged scale, of the air injector;

FIG. 39 is a longitudinal sectional view of the air injector shown in FIG. 38;

FIG. 40 is a perspective view of a modified form of the bag receptacle; and

Figure 41:
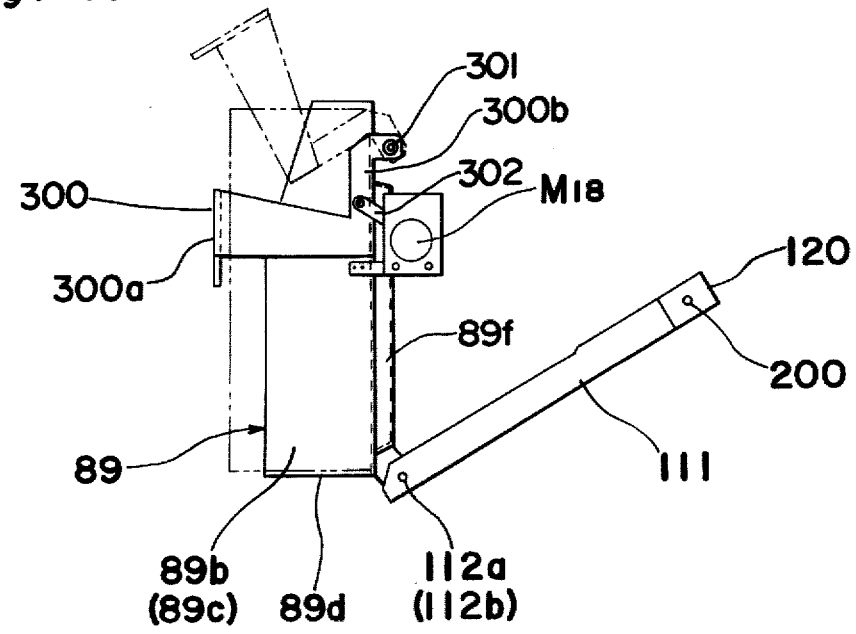

FIG. 41 is a side view of the modified bag receptacle shown in FIG. 40, said modified bag receptacle being shown in a transfer position.

Before the description of the present invention proceeds, it is to be noted that like parts are designated by like reference numerals throughout the accompanying drawings.

It is also to be noted that, although the automatic bagging apparatus embodying the present invention can be utilized in any field of industry, for example, for packing one or more goods for sale, the present invention will be described as utilized by and installed at a supermarket check-out station.

Before the description of the present invention proceeds, it is to be noted that like parts are designated by like reference numerals throughout the accompanying drawings.

An automatic bagging apparatus embodying the present invention comprises, in general:

(1) a merchandise receiving unit including,
  (1-a) a tray assembly,
  (1-b) a tray size adjusting mechanism,
  (1-c) a tray drive, and
  (1-d) a gating mechanism;
(2) a merchandise loading unit including;
  (2-a) a loader assembly, and
  (2-b) a loader drive;
(3) a bag supply unit including,
  (3-a) a bag container,
  (3-b) a bag pick-up mechanism, and
  (3-c) a bag feeding mechanism;
(4) a bag mouth opening unit including,
  (4-a) a suction opener and retainer,
  (4-b) a bag mouth clamping mechanism, and
  (4-c) an air injector;
(5) a delivery unit including,
  (5-a) a bag erecting mechanism,
  (5-b) a bag transporting mechanism, and
  (5-c) a bag lift;
(6) a pneumatic circuit operatively associated with the bag pick-up mechanism, the suction opener and retainer, and the blower assembly; and
(7) a control system for controlling a cycle of operation of the entire automatic bagging apparatus.

For facilitating a ready and better understanding of the present invention, the various components forming the automatic bagging apparatus will be described individually under the respective headings in the order listed above.

(1) Merchandise Receiving Unit

(1-a) Tray Assembly

The tray assembly, generally identified by A, is operable to transport and insert one or more articles or purchases to be packed or bagged into a bag 10 when and after the articles or purchases have been placed inside and on the bottom of the tray assembly A. The tray assembly A has a generally rectangular container-like configuration, the volume of which is adjustable in a manner as will be described later while the depth of the interior of the tray assembly A remains the same.

Referring now to FIGS. 1 to 7, the tray assembly A comprises a pair of elongated L-sectioned plate structures 11 and 13, each having an upright side plate 11*a* or 13*a* and a bottom plate 11*b* or 13*b*. The upright side plates 11*a* and 13*a* form the opposed side walls of the tray assembly A, respectively, while the bottom plates 11*b* and 13*b* form the bottom wall of the tray assembly A. The plate structures 11 and 13 are assembled for telescopical movement relative to each other in a direction widthwise of the tray assembly A and, for this purpose, the plate structures 11 and 13 are connected, in a manner with the free side edge portion of the bottom plate 11*b* overlapping and positioned above the free side edge portion of the bottom plate 13*b*, by means of a telescopical guide structure 12.

Figure 3:
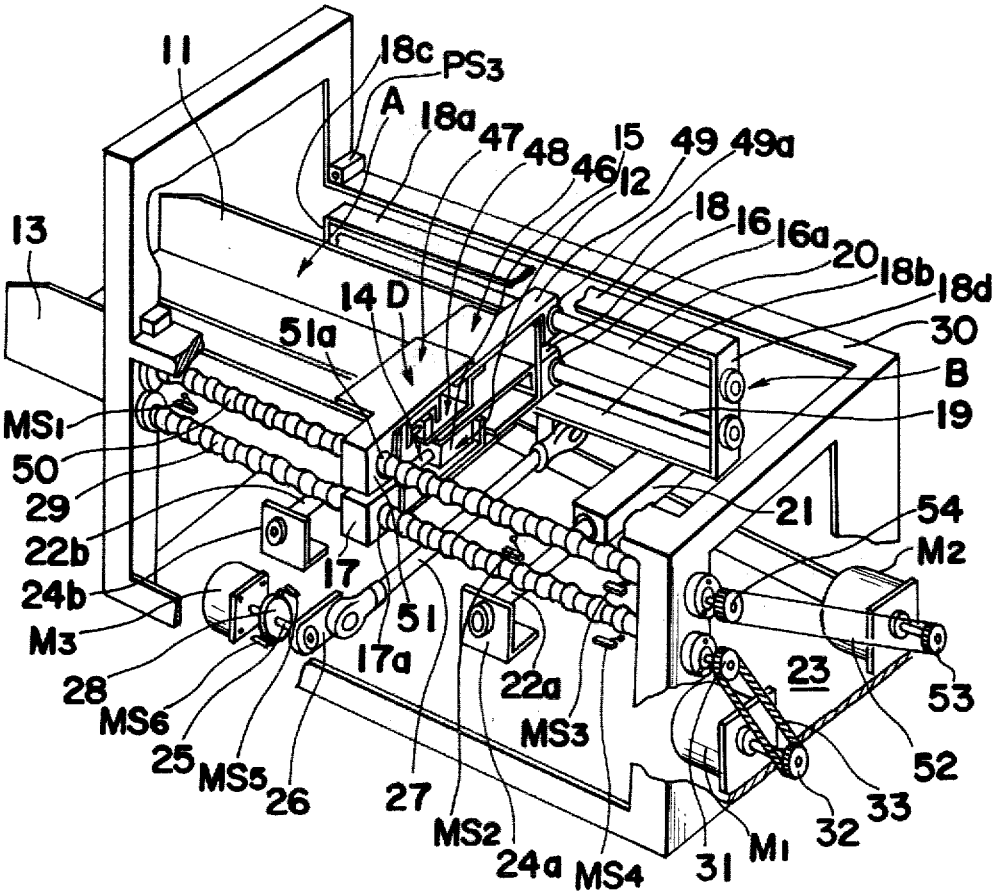
FIG. 3 is a perspective view of a merchandise receiving unit, including, the tray assembly and the loader assembly and their associated drive mechanisms, of the automatic bagging apparatus.

The telescopical guide structure 12, as best shown in FIG. 3, extends underneath the bottom of the tray assembly A in a direction widthwise thereof and comprises at least one guide rod 14 having one end rigidly connected to the plate structure 13 by means of a suitable bracket and the other end slidably extending through a bearing block 15, rigidly connected to and suspended from the plate structure 11, and terminating below the bottom plate 11*b* of the plate structure 11.

The tray assembly A has a pair of bearing wings 16 and 17 fast with the respective plate structures 11 and 13 and laterally outwardly protruding from the respective side plates 11*a* and 13*a*. Each of the bearing wings 16 and 17 has a bearing hole 16*a* or 17*a* defined therein. However, the bearing hole 17*a* in the bearing wing 17 is in the form of a threaded hole for a reason which will become clear from the subsequent description.

Figure 4:
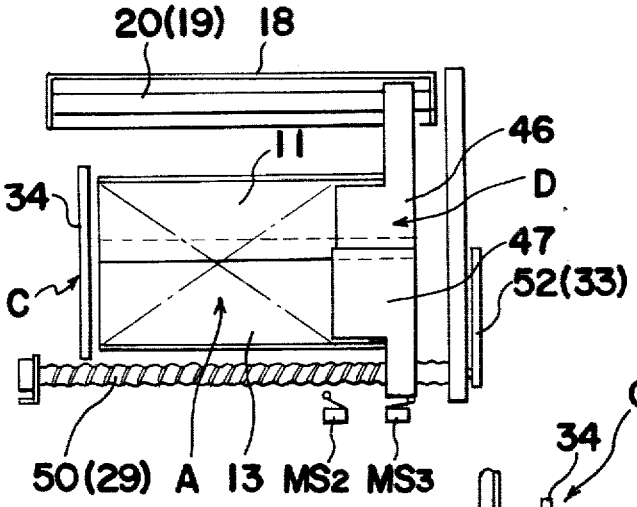
FIGS. 4 and 6 are schematic top plan views of the merchandise receiving unit, showing the tray assembly and the loader assembly in different operative positions.
Figure 6:
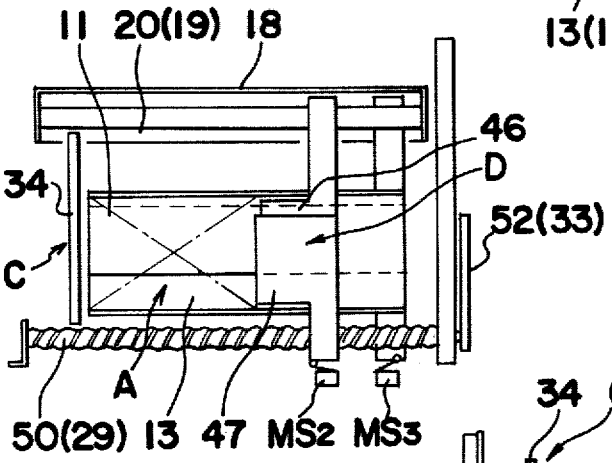

In the construction so far described, it will readily be seen that the width of the tray assembly A is adjustable between maximum and minimum widths as shown in FIGS. 4 and 6, respectively. However, for the purpose of description of the present invention, the plate structure 11 is assumed to be movable between a maximum width position, wherein the plate structure 11 is moved away from the plate structure 13 as shown in FIG. 4, and a minimum width position wherein the plate structure 11 is moved towards the plate structure 13 as shown in FIG. 6. The movement of the plate structure 11 relative to the plate structure 13 is effected in a manner as will be described in connection with the tray size adjusting mechanism.

(1-b) Tray Size Adjusting Mechanism

Referring particularly to FIG. 3, the tray size adjusting mechanism, generally identified by B, comprises a generally rectangular movable framework 18 having upper and lower frame members 18*a* and 18*b*, the length of each of said upper and lower frame members 18*a* and 18*b* corresponding to the distance through which the tray assembly A can move between inserted and retracted positions in a manner as will be described later, and a pair of opposed end frame members 18*c* and 18*d*. The rectangular movable framework 18 includes a pair of equally spaced guide rods 19 and 20 positioned one above the other and extending in parallel to each of the upper and lower frame members 18*a* and 18*b*, each of said guide rods 19 and 20 having its opposed ends rigidly secured to the opposed end frame members 18*c* and 18*d*, respectively.

The movable framework 18 of the construction described above is rigidly mounted on a pair of spaced bearing blocks, only one of which is shown at 21, said bearing blocks 21 being in turn movably mounted on respective guide rods 22*a* and 22*b* so that the movable framework 18 can move between expanded and contracted positions in a manner as will be described later. Each of the guide rods 22*a* and 22*b* has its opposite ends rigidly connected to a support deck 23 forming a part of an entire machine frame structure of the automatic bagging apparatus by means of respective L-shaped brackets, only one of which is shown by 24*a* or 24*b*, a substantially intermediate portion of the guide rods 22*a* or 22*b* extending through a bearing hole defined in the corresponding bearing blocks 21.

For moving the movable framework 18 between the expanded position, as shown in FIG. 4, and the contracted position as shown in FIG. 6, an electric reversible motor M3, for example, a DC motor, is utilized. This motor M3 has a drive shaft 25 having a crank arm 26 rigidly mounted on the free end of said drive shaft 25 for rotation together therewith, said crank arm 26 being in turn coupled to the movable framework 18 through a connecting rod 27 which has its opposite ends pivotally connected respectively to the movable framework 18 and the crank arm 26. In this manner, the motor M3 is so operatively coupled to the movable framework 18 through the crank arm 26 and then the connecting rod 27 that, when the motor M3 is rotated in a first direction, the movable framework 18 is moved from the contracted position towards the expanded position and, when the motor M3 is rotated in a second direction counter to the first direction, the movable framework 18 is moved from the expanded position towards the contracted position.

Since the movement of the movable framework 18 is transmitted to the plate structure 11 of the tray assembly A through the lower guide rod 19 slidably extending through the bearing wing 16 fast with the plate structure 11, the plate structure 11 can move in a direction towards and away from the plate structure 13. More specifically, when the movable framework 18 is moved from the expanded position towards the contracted position, the plate structure 11 can be moved from the maximum width position towards the minimum width position and, when the movable framework 18 is moved from the contracted position towards the expanded position, the plate structure 11 can be moved from the minimum width position towards the maximum width position.

Rigidly mounted on a substantially intermediate portion of the drive shaft 25 of the motor M3 is a cam member 28 operatively associated with a pair of microswitches MS5 and MS6 which are disposed in the vicinity of the perimeter of the cam member 28 in oppositely spaced relation to each other. The microswitches MS5 and MS6 serve as means for detecting the position of the movable framework 18 and, hence, the position of the plate structure 11 of the tray assembly A relative to the plate structure 13. More specifically, the cam member 28 is so shaped as to turn the microswitches MS5 and MS6 off and on, respectively, when the movable framework 18 arrives at the expanded position, and to turn the microswitches MS5 and MS6 on and off, respectively, when the movable framework 18 arrives at the contracted position.

(1-c) Tray Drive

The tray assembly A is movable between the inserted and retracted positions, as described hereinabove, in a direction lengthwise of the tray assembly A. For this purpose, as best shown in FIG. 3, a screw shaft 29 threadingly extends through the threaded bearing hole 17*a* in the bearing wing 17 fast with the plate structure 13 of the tray assembly A and has one end rotatably secured to one of pillars of a frame assembly 30. The other end of the screw shaft 29 extends rotatably through the pillar of the frame assembly 30, which is lengthwisely spaced from and opposed to said one of the pillars of the frame assembly 30, and carries a driven pulley 31 rigidly mounted thereon for rotation together with the screw shaft 29. The driven pulley 31 is operatively coupled to a drive pulley 32 fast with a drive shaft of an electric reversible motor M1, for example a DC motor, by means of an endless belt 33 such that rotation of the electric motor M1 can be transmitted to the screw shaft 29. Accordingly, during the rotation of the electric motor M1, the tray assembly A can be moved from either one of the retracted and inserted positions towards the other of the retracted and inserted positions depending upon the direction of rotation of the motor M1 and, hence, that of the screw shaft 29. This is possible because of the threaded engagement between the helical groove inside the bearing hole 17*a* in the wing 17 and the mating helical projection on the outer periphery of the screw shaft 29.

Positioned in the vicinity of the screw shaft 29 adjacent the driven pulley 31 is a microswitch MS4, the function of which will be described later.

It is to be noted that, to support the tray assembly A and also to facilitate a smooth movement of the tray assembly A between the retracted and inserted positions, any suitable guide means, such as one or more roller elements or a groove-and-rail arrangement, may be employed and interposed between the bottom of the tray assembly A and the support deck 23.

(1-d) Gating Mechanism

Figure 8:
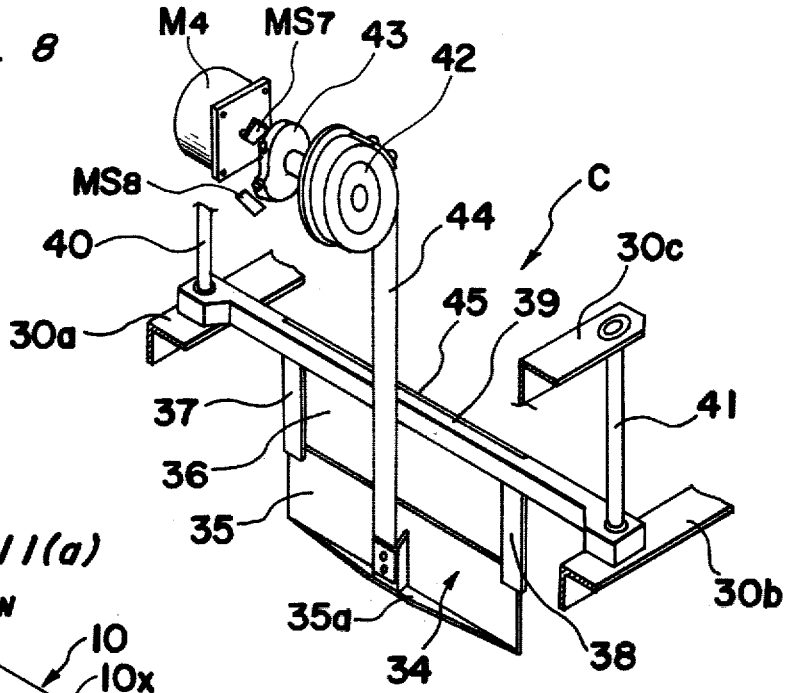
FIG. 8 is a schematic perspective view of a gating mechanism employed in the automatic bagging apparatus.

The gating mechanism, generally identified by C in FIG. 8, comprises a foldable gate assembly 34 constituted by a pair of rectangular shutter plates 35 and 36 each being of a width equal to or slightly larger than the maximum width of the tray assembly A which is attained when the plate structure 11 is held in the maximum width position relative to the plate structure 13. Each of the shutter plates 35 and 36 has its opposite side edges slidingly engaged in respective guide grooves defined in associated track members 37 and 38 which extend downwardly from an upwardly shiftable transverse beam member 39 extending in a direction parallel to the widthwise direction of the tray assembly A and supported in a manner as will subsequently be described with particular reference to FIG. 8.

The upwardly shiftable transverse beam member 39 has its opposite ends mounted on respective upright support columns 40 and 41 which are rigidly connected at one end to respective frame members 30*a* and 30*b* forming parts of the frame assembly 30 and at the other end to respective overhang frame members, only one of which is shown by 30*c*, both of said frame members 30*c* being rigidly supported by the frame assembly 30. The gating mechanism C is so positioned that the foldable gate assembly 34, the details of which will be described subsequently, can be positioned frontwardly of the tray assembly A in the retracted position in terms of the direction of movement of the same towards the inserted position, thereby substantially providing a front wall of the tray assembly A in such a manner as shown by the phantom line in FIG. 2.

The gate assembly 34 is movable between opened and closed positions in a direction perpendicular to the direction of movement of the tray assembly A. For moving the gate assembly 34 between the opened and closed positions, an electric reversible motor M4, for example, a DC motor, is employed.

The electric motor M4 has a drive shaft having a drum 42 and a cam member 43 both rigidly mounted thereon for rotation together therewith. The drum 42 is connected with the gate assembly 34 by means of a flexible winding band 44 preferably made of a thin strip of stainless steel and having one end rigidly secured to the drum 42 and the other end rigidly secured to the gate assembly 34. In this arrangement, by the rotation of the drum 42 in one of the opposite directions, the flexible winding band 44 can be wound up around the drum 42 pulling the gate assembly 34 upwardly from the closed position towards the opened position and, by the rotation of the drum 42 in the other of the opposite directions, the flexible winding band 44 can be unwound from the drum 42 allowing the gate assembly 34 to fall by gravity from the opened position towards the closed position as shown in FIG. 8.

The cam member 43 is operatively associated with a pair of microswitches MS7 and MS8 which are disposed in the vicinity of the perimeter of the cam member 43 and spaced a certain angular distance from each other. The microswitches MS7 and MS8 serve as means for detecting the position of the gate assembly 34 and control the operation of the electric motor M4. More specifically, the cam member 43 is so shaped as to turn the microswitches MS7 and MS8 on and off, respectively, when the gate assembly 34 arrives at the opened position, and as to turn the microswitches MS7 and MS8 off and on, respectively, when the gate assembly 34 returns to the closed position.

In practice, the gate assembly 34 is comprised of the lower and upper shutter plates 35 and 36 as hereinbefore described. These lower and upper shutter plates 35 and 36 are so designed as to undergo the following operation when the gate assembly 34 is moved from the closed position to the opened position.

(a) When the gate assembly 34 is in the closed position as shown in FIG. 8, the shutter plate 35 connected with the flexible winding band 44 is substantially positioned below the shutter plate 36 which is then held in a downwardly shifted position by one or two trap elements (not shown) with its opposite side edges engaged in the respective guide grooves in the track members 37 and 38 as shown.

(b) During a first stage of rotation of the drum 42 in said one of the opposite directions with the flexible winding band 44 being rolled up around the drum 42, the shutter plate 35 is first upwardly shifted and then carries the shutter plate 36 to move the latter upwardly together with said shutter plate 35. This is possible because the shutter plate 35 is provided at its lower edge with one or more engagements (not shown) engageable with the lower edge of the shutter plate 35 to transmit the upward movement of the shutter plate 35 to the shutter plate 36.

(c) As the drum 42 further rotates, the shutter plate 35 being still upwardly pulled by the flexible winding band 44 together with the shutter plate 36 along the guide grooves in the respective track members 37 and 38 passes upwardly through a slit 45 defined in the transverse beam member 39 and then carries the transverse beam member 39 to move the latter upwardly with the ends of said beam member 39 guided by the guide columns 40 and 41. This is possible because the shutter plate 35 is also provided at its lower edge with an engagement 35*a* protruding in a direction counter to the direction of protrusion of said one or more engagements engageable with the lower edge of the shutter plate 36, which engagement 35*a* is engageable with the transverse beam member 39 to transmit the continued upward movement of the shutter plate 35 to the transverse beam member 39.

From the foregoing, it will readily be seen that, at the completion of the movement of the gate assembly 34 from the closed position to the opened position, the lower and upper shutter plates 35 and 36 are positioned in face-to-face relation to each other and above the transverse beam member 39 while the respective lower edge portions of the lower and upper shutter plates 35 and 36 are still engaged in the slit 45 and, on the other hand, the transverse beam member 39 is upwardly shifted by the engagement between it and the engagement 35*a*. It will also be seen that the rotation of the drum 42 in said other of the opposite directions brings the gate assembly C to the closed position with the components 35, 36 and 39 being moved in respective manners in reversed relation to those described above.

With the gate assembly 34 so constructed as hereinbefore described, it is clear that the maximum height of the automatic bagging apparatus, particularly the height of the gate assembly C above the plane of the bottom of the tray assembly A, can advantageously be minimized. However, the gate assembly C may alternatively be constituted by a single shutter plate and/or the opposite ends of the transverse beam member 39 may be rigidly secured to the respective frame members 30*a* and 30*b*.

(2) Merchandise Loading Unit (2-a) Loader Assembly

Figure 2:
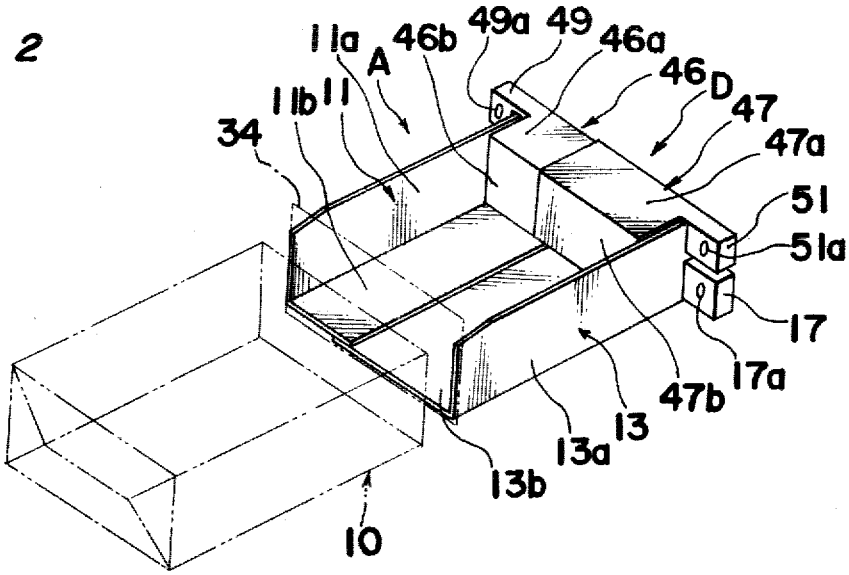
FIG. 2 is a perspective view of a tray assembly and a loader assembly both employed in the automatic bagging apparatus.

A loader assembly, generally identified by D, is operable to define a substantially rear wall of the tray assembly A as can readily be seen from FIG. 2 and also to push the goods into the bag 10. This loader assembly D is movable between a pushed position and any one of rear and front retracted positions independently of the movement of the tray assembly A between the inserted and retracted positions. However, for the purpose of the present invention, the loader assembly D can be moved from any one of retracted positions towards the pushed position simultaneously with the start of movement of the tray assembly A from the retracted position towards the inserted position, but the return movement of the loader assembly D back towards such any one of the rear and front retracted positions is effected independently of and subsequent to the start of the movement of the tray assembly A from the inserted position back towards the retracted position, as described later and as can be seen from FIGS. 9(*a*) to 9(*d*) which illustrate schematically the sequence of operation of the tray assembly A, the gate assembly 34 and the loader assembly D relative to the bag 10.

Referring now to FIGS. 2 to 7, the loader assembly D comprises a pair of generally L-sectioned plate structures 46 and 47 each having a top plate 46*a* or 47*a* and an upright plate 46*b* or 47*b*. The plate structures 46 and 47 are assembled for telescopical movement relative to each other in a direction widthwise of the tray assembly A within the space between the side plates 11*a* and 13*a* of the respective plate structures 11 and 13 forming the tray assembly A. For this purpose, the plate structures 46 and 47 are connected, in a manner with one of the opposed, L-shaped side edges of the plate structure 47 adjacent the side plate 13*a* overlapping and positioned above one of the opposed, L-shaped side edges of the plate structure 46 adjacent the side plate 11*a*, by means of a telescopic guide structure 48.

The telescopic guide structure 48 may be of a construction similar to the telescopic guide structure 12 employed in the tray assembly A and, therefore, the details of the guide structure 48 will not be described for the sake of brevity. However, it should be born in mind that the plate structure 46 is movable from an enlarged position, as shown in FIG. 4, towards a reduced position as shown in FIG. 6 and from the reduced position towards the enlarged position relative to the plate structure 47 in unison with the movement of the plate structure 11 from the expanded position towards the contracted position and from the contracted position towards the expanded position relative to the plate structure 13, respectively. For this purpose, the plate structure 46 is supported by the upper guide rod 20 (See, the description under "Tray Size Adjusting Mechanism".) through a bearing wing 49 having a bearing hole 49*a* through which the guide rod 20 axially slidably extends. On the other hand, the plate structure 47 is supported by a screw shaft 50 through a bearing wing 51 having a threaded bearing hole 51*a* through which said screw shaft 50 extends, the details of the screw shaft 50 being described later under the subsequent heading of the "Loader Drive".

These bearing wings 49 and 51 fast with the plate structures 46 and 47, respectively, protrude outwardly therefrom over the corresponding side plates 11 and 13 and are positioned laterally of the side plates 11 and 13 of the respective plate structures 11 and 13 forming the tray assembly A as best shown in FIG. 2.

From the foregoing, it will readily be seen that the plate structure 46 of the loader assembly D is moved between the enlarged and reduced positions relative to the plate structure 47 together with the plate structure 11 of the tray assembly A in response to the movement of the movable framework 18 between the expanded and contracted positions, respectively.

(2-b) Drive

As best shown in FIG. 3, the screw shaft 50 forming a part of the loader drive unit extends in parallel relation to and above the screw shaft 29, forming a part of the tray drive unit which has previously been described, and is supported by the frame assembly 30 in a manner similar to the screw shaft 29. This screw shaft 50 is driven by an electric reversible motor M2, for example, a DC motor, by means of an endless belt 52 suspended between a drive pulley 53 on a drive shaft of the motor M2 and a driven pulley 54 on one end of the screw shaft 50.

Positioned in the vicinity of the screw shaft 50 is first, second and third microswitches MS1, MS2 and MS3 which are aligned in position with the respective pushed, front retracted and rear retracted positions of the loader assembly D. The first microswitch MS1 is adapted to be turned on, when the loader assembly D being moved from one of the front and rear retracted positions towards the pushed position arrives at the pushed position, to interrupt the supply of electric power to the motor M2 and also to cause the motor M1 to rotate in such a direction as to cause the tray assembly A to move back towards the retracted position. The second microswitch MS2 is adapted to be turned on, when the loader assembly D being moved from the pushed position arrives at the front retracted position, to interrupt the supply of electric power to the motor M2. On the other hand, the third microswitch MS3 is adapted to be turned on when the loader assembly D being moved from the pushed position arrives at the rear retracted position, to interrupt the supply of electric power to the motor M2.

It is to be noted that the microswitch MS4 disposed in the vicinity of the screw shaft 29 as hereinbefore described is adapted to be turned on, when the tray assembly A is returned from the inserted position back to the retracted position, to interrupt the supply of electric power to the motor M1.

Figure 5:
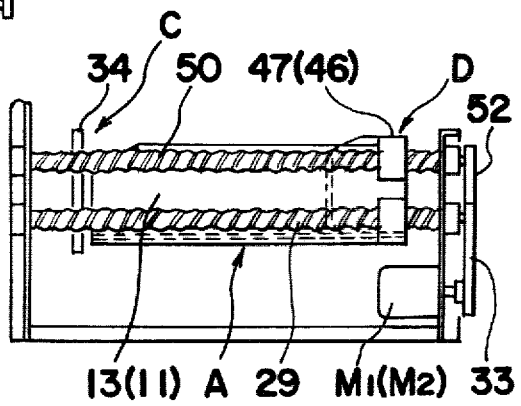
FIGS. 5 and 7 are side views of FIGS. 4 and 6, respectively.
Figure 7:
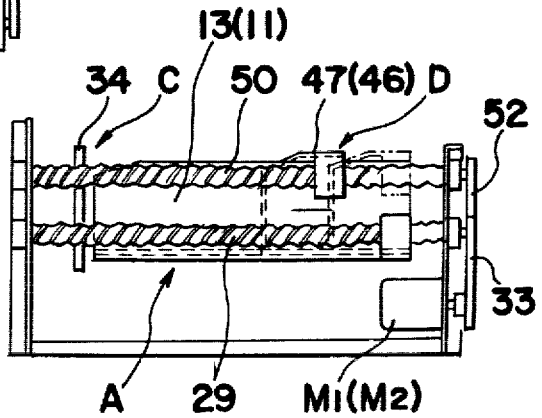

The adjustment of the loader assembly D from the rear retracted position as shown in FIGS. 4 and 5 to the front retracted position as shown in FIGS. 6 and 7 and from the front retracted position to the rear retracted position is carried out according to the size of the bag to be used and can be effected when a tray size selector switch associated with a small size bag and a tray size selector switch associated with a large size bag are manipulated, respectively, as will be described later.

Because the capability of adjustment of the length of the tray assembly A which is achieved by moving the loader assembly D between the front and rear retracted position, there is no possibility that an operator of the machine may place goods or purchases, the total volume of which corresponds to the volume of the large size bag, in the midst of busy work while the small size bag is then held in position to receive such goods or purchases in a manner as will be described later in connection with the operation of the automatic bagging apparatus embodying the present invention.

Before the description of the components of the bag supply unit proceeds, the operation of the automatic bagging apparatus of the construction so far described under the respective headings of "Merchandise Receiving Unit" and "Merchandise Loading Unit" will now be described with particular reference to FIGS. 9(*a*) to 9(*d*).

Figure 1:
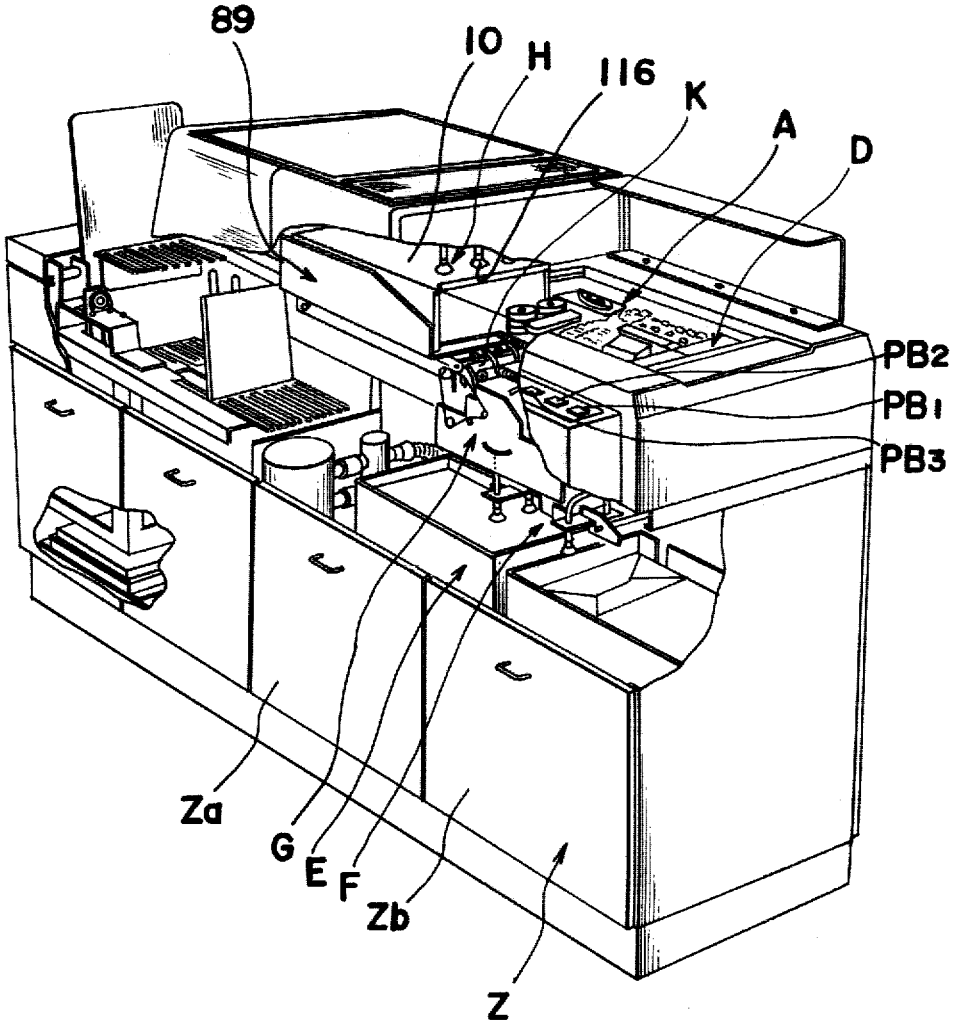
FIG. 1 is a perspective view, with a portion broken away, of an automatic bagging apparatus embodying the present invention.

Assuming that the plate structure 11 of the tray assembly A is in the maximum width position, the loader assembly D is in the rear retracted position and the large size bag 10*a* is fed in a manner as will be described later to a position ready to receive goods or purchases to be bagged as shown in FIG. 9(*a*), what the operator, for example, a supermarket cashier, is required to do is to place the goods or purchases on the tray assembly A and then to manipulate the start switch PB1. (In practice, as will be described later, manipulation of a selected one of tray size selector switches PB2 and PB3 as shown in FIG. 1 is required prior to the manipulation of the start switch PB1.).

Upon manipulation of the start switch PB1, the motor M4 starts its rotation to cause the drum 42 to wind up the winding band 44, thereby bringing the gate assembly 34 from the closed position towards the opened position. When the gate assembly 34 arrives at the opened position, the microswitch MS7 is turned on to interrupt the supply of the electric power to the motor M4 on one hand and to energize the motors M1 and M2 simultaneously to rotate the latter in respective first directions. When the motors M1 and M2 are so rotated in the respective first directions, the tray assembly A is moved from the retracted position towards the inserted position and the loader assembly D is moved from the rear retracted position towards the pushed position as shown in FIG. 9(*b*). Accordingly, the goods or purchases on the tray assembly A can be transported towards the large size bag 10*a* while pushed by the loader assembly D as shown in FIG. 9(*b*).

After the goods or purchases have been inserted into the bag 10*a* as shown in FIG. 9(*b*) and the microswitch MS1 is turned on in response to the arrival of the loader assembly D at the pushed position, the motor M1 is reversed to rotate in a second direction counter to the first direction on one hand and the motor M2 is deenergized on the other hand. This means that the tray assembly A starts its return movement from the inserted position back towards the retracted position while the loader assembly D remains in the pushed position to retain the goods or purchases within the bag 10*a*. Therefore, there is no possibility that some of the goods or purchases inserted into the bag 10*a*, particularly those positioned adjacent the open mouth of the bag 10*a*, may be drawn out of the bag 10*a* in contact with the bottom of the tray assembly A then being moved from the inserted position back towards the retracted position.

Subsequent to the completion of the return movement of the tray assembly A to the retracted position as shown in FIG. 9(*c*) at which time the microswitch MS4 is turned on in contact with the wing 17 of the tray assembly A, the motor M1 is deenergized on one hand and the motor M2 is reversed to rotate in a second direction counter to the first direction causing the loader assembly D to move from the pushed position back torwards the rear retracted position on the other hand.

At the time of completion of the return movement of the loader assembly D back to the rear retracted position as shown in FIG. 9(*d*), the microswitch MS4, which has been brought into the operative position as a result of the manipulation of the tray size selector switch PB2 associated with the selection of the large size bag 10*a* (The microswitch MS3 is therefore held in the inoperative position.), is turned on in contact with the wing 51 of the loader assembly D. The switching-on of the microswitch MS3 causes the motor M4 to rotate in such a direction as to unwind the winding band 44 from the drum 42, resulting in the movement of the gate assembly 34 from the opened position towards the closed position as shown in FIG. 9(*d*). The motor M4 is then deenergized when the microswitch MS8 is turned on to generate an electric signal indicative of the arrival of the gate assembly 34 at the closed position.

It is to be noted that the stroke of movement of the tray assembly A is so selected as to permit a portion of the tray assembly A between the loader assembly D and the gate assembly 34, when the tray assembly A is moved to the inserted position as shown in FIG. 9(*b*), to be completely inserted into the bag 10*a*. As will be discussed later, this is advantageous in that there is no possibility that one or some of the goods or purchases being inserted into the bag 10*a* may break the bag 10*a*.

(3) Bag Supply Unit (3-a) Bag Container

Before the description of the bag container proceeds, the type of bag 10, either large size or small size, which the automatic bagging apparatus embodying the present invention can handle will now be described with particular reference to FIGS. 2, 11 and 12.

Referring particularly to FIGS. 11(*a*) and 11(*b*), the type of bag 10 which can be utilized in the automatic bagging apparatus of the present invention is generally referred to as an automatic bottom bag and is made of any suitable sheet material such as paper or synthetic resin. This type of bag 10 is constituted by two pairs of opposed side walls, the opposed side walls 10*x* and 10*y* of one pair having a larger width than that of each of the opposed side walls 10*v* and 10*w* of the other pair, and a bottom wall 10*z* and has a generally rectilinear and rectangular cross section when completely opened or popped open in a manner as best shown in FIG. 11(*a*). However, this bag 10 is collapsible into a flat position as shown in FIG. 11(*b*) wherein the narrow side walls 10*v* and 10*w* are folded inwardly with respect to each other along respective fold lines L2 and L3, each extending intermediately of the width of the corresponding narrow side wall 10*v* or 10*w*, with the large side walls 10*x* and 10*y* held in partial contact with each other while the bottom 10*z* is folded along a fold line L1 to overlay the large side wall 10*y*. Thus, when the bag 10 is to be collapsed as shown in FIG. 11(*b*), the lower portion of the large side wall 10*y* which is on one side of the fold line L1 remote from the free end of such side wall 10*y* is folded about the fold line L1 and the bottom wall 10*z* hinges at its point of connection to the large side wall 10*x* so that the large side walls 10*x* and 10*y* move together with the narrow side walls 10*v* and 10*w* folded inwardly along the fold lines L2 and L3 and the bottom wall 10*z* partially overlies the side wall 10*y*. Generally, this type of bag is self-supporting when placed on a support surface with the bottom wall 10*z* held in contact with such supporting surface. However, in order to cause the bag 10 to exhibit its self-supporting feature in an upright position as shown in FIG. 11(*a*), it is required that the bag 10 be popped open or bulged open completely to such an extent as to establish a substantially rectangular cubic interior space inside the bag 10.

For the purpose of the description of the present invention, the bag which has been popped open or bulged open completely to such an extent as to establish a substantially rectangular cubic interior space inside the bag 10 is simply referred to as a "completely opened bag" in contrast to the 'mouth-opened bag' which is intended to means a bag wherein, while the bottom wall 10*z* is still or substantially folded about its point of connection to the large side wall 10*x*, overlaying the large side wall 10*y*, only the mouth of the bag 10 is opened. Naturally, when the mouth of the bag 10 is opened, the large side walls 10*x* and 10*y* extend relative to each other so as to converge towards the point of connection of the bottom wall 10*z* to the large side wall 10*x*.

Referring now to FIGS. 1 and 10, the bag container generally identified by E comprises, so far illustrated, a pair of similar boxes 55 and 56 housed inside the machine housing Z (FIG. 1) at a position substantially below the merchandise receiving and loading units and supported for movement between withdrawn and operative positions as will be described later. The box 55 is used to accommodate a stack of small size bags 10*b* therein while the box 56 is used to accommodate a stack of large size bags 10*a* therein. Therefore, the boxes 55 and 56 have, when viewed in FIG. 10, a different length and a different width, but have the same depth.

As best shown in FIG. 10, the box 55 comprises a pair of opposed side walls, only one of which is shown by 55*a* because of the longitudinal sectional representation in FIG. 10, a pair of opposed end walls 55*a* and 55*b* and a bottom wall 55*d*. The bottom wall 55*d* is rigidly mounted on a shaft member 57 having its opposite ends journalled in the respective side walls 55*a*, said bottom wall 55*d* being so supported as to be pivotable about the shaft member 57 between a lowered position, as shown by the solid line, and a raised position substantially as shown by the chain line. The bottom wall 55*d* in the lowered position is downwardly inclined towards the end wall 55*c* with one of the opposite ends of the bottom wall 55*d* remote from the shaft member 57 being engaged with a stop 58 fast with the end wall 55*c*. This bottom wall 55*d* is pivoted in response to a movement of a suction head assembly, the details of which will be described under the subsequent heading of "Bag Pick-up Mechanism", by means of a link mechanism comprised of an actuating lever 59, supported pivotally by the side wall 55*a* by means of a pivot pin 59*a*, and a transmitting lever 60 having one end rigidly connected to the shaft member 57 or the bottom wall 55*d* and the other end carrying an engagement pin 60*a* engageable with one end of the actuating lever 59.

Similarly, the box 56 comprises a pair of opposed side walls, only one of which is shown by 56*a*, a pair of end walls 56*b* and 56*c* and a bottom wall 56*d*. The bottom wall 56*d* is rigidly mounted on a shaft member 61 having its opposite ends journalled to the respective side walls 56*a*, said bottom wall 56*d* being so supported as to be pivotable about the shaft member 61 between a lowered position, as shown by the solid line, and a raised position substantially as shown by the chain line. The bottom wall 56*d* in the lowered position is downwardly inclined towards the end wall 56*c*, facing the end wall 55*c* of the box 55, with one of the opposite ends of the bottom wall 56*d* remote from the shaft member 61 being engaged with a stop 62 fast with the end wall 56*c*. This bottom wall 56*d* is also pivotable in response to a movement of a suction head assembly, the details of which will be described under the subsequent heading of "Bag Pick-up Mechanism", by means of a link mechanism comprised of an actuating lever 63, supported pivotally by the side wall 56*a* by means of a pivot pin 63*a*, and a transmitting lever 64 having one end rigidly connected to the shaft member 61 or the bottom wall 56*d* and the other end carrying an engagement pin 64*a* engageable with one end of the actuating lever 63.

Each of the bottom walls 55*d* and 56*d* of the respective boxes 55 and 56 is so designed that, even though the bags 10*b* or 10*a* in a stack within the corresponding box 55 or 56 are successively consumed one at a time in a manner as will be described later, the uppermost one of the stack of bags 10*b* or 10*a*, which has the shape as shown in FIG. 12, can be kept laying substantially horizontally. In other words, each of the bottom walls 55*d* and 56*d* of the respective boxes 55 and 56 is so designed as to compensate for reduction in angle of inclination of the uppermost bag to keep the latter at a substantially horizontal position.

These boxes 55 and 56 are positioned within the housing Z in end-to-end relation to each other with the end wall 55*c* of the box 55 facing the end wall 56*c* of the box 56. The box 55 has two rows of rollers 65*a* and 65*b* carried respectively by the end walls 55*b* and 55*c* and engaged in respective track members 66*a* and 66*b* so that the box 55 can move between withdrawn and operative positions in a direction substantially transversely of the lengthwise direction of the automatic bagging apparatus.

Similarly, the box 56 has two rows of rollers 67*a* and 67*b* carried respectively by the end walls 56*b* and 56*c* and engaged in respective track members 68*a* and 68*b* so that the box 56 can move between withdrawn and operative positions in a direction substantially transversely of the lengthwise direction of the automatic bagging apparatus.

It is to be noted that, while the track members 66*a* and 67*a* are supported by the base of the machine frame structure by means of respective support legs 69 and 70, the track members 66*b* and 67*b* are supported by the base of the machine frame structure by means of a common support leg 71.

From the foregoing, it will readily be seen that replenishment of a new stack of bags can readily be carried out by opening a corresponding one of hingedly supported doors Za and Zb (FIG. 1) and then drawing a corresponding box 55 or 56 from the operative position towards the withdrawn position.

(3-b) Bag Pick-up Mechanism

The bag pick-up mechanism, generally identified by F, is operable to pick up the bags one at a time from their container E and then to transfer the picked up bag to a bag feeding mechanism generally identified by G. The bag pickup mechanism F comprises bag pick-up devices Fa and Fb one for each bag box 55 or 56, said bag pick-up devices Fa and Fb being of the same construction and, therefore, only one of which, for example, the bag pick-up device Fb associated with the box 56, will now be described in detail with particular reference to FIGS. 10 and 13 to 17.

The bag pick-up device Fb comprises the suction head assembly 72 supported for movement between upwardly and downwardly shifted positions by means of a support rod 73 having one end rigidly connected to a lift block 74 and the other end rotatably connected to a cam plate 75, a substantially intermediate portion of said support rod 73 extending in a direction transversely of the widthwise direction of the box 56 and also that of the automatic bagging apparatus. As best shown in FIGS. 13, 14 and 17, the cam plate 75 carries a pair of suction heads 76 and 77 rigidly mounted in side-by-side relation to each other on a support plate 78 which lies at right angles to the cam plate 75 and extends in a direction parallel to the widthwise direction of the bag box 56.

The details of each of the suction heads 76 and 77 are best shown in FIG. 15. Each of the suction heads 76 and 77 is constituted by a support sleeve 76*a* or 77*a*, rigidly mounted on the support plate 78, a hollow cylindrical body 76*b* or 77*b*, having one end closed and also having a rubber suction cup member 76*c* or 77*c* mounted on the other end thereof, and a compression spring 76*d* or 77*d* interposed between the support plate 78 and a flange 76*e* or 77*e* radially outwardly protruding from the hollow cylindrical body 76*d* or 77*b*. The interior of the hollow cylindrical body 76*b* or 77*b* is communicated to a common pipe 79 having each end loosely extending through a corresponding guide slot 76*f* or 77*f* and rigidly connected to the correspondinng hollow cylindrical body 76*b* or 77*b* in communication with the interior thereof.

Each of the suction heads 76 and 77 of the construction described above is so designed that the hollow cylindrical body 76*b* or 77*b* can be axially displaceable against the compression spring 76*d* or 77*d* when an upwardly acting force acts thereon in a manner as will be described later.

As best shown in FIG. 17, the common pipe 79 is communicated at its substantially intermediate portion to a source of suction air, as will be described later, by means of a flexible tubing 80.

It is to be noted that the cam plate 75 is mounted on the support rod 73 for pivotal movement about said support rod 73 between an engaged position, as shown by the phantom line in FIG. 10, and a disengaged position as shown by the solid line in FIG. 10, it being to be understood that the cam plate 75 is normally biased to the engaged position by any suitable spring element such as a wire spring (not shown) operatively connected between the cam plate 75 and the support rod 73.

For moving the suction head assembly 72 between the upwardly and downwardly shifted position, the lift block 74 is movably guided by a pair of spaced columns 81*a* and 81*b* extending in parallel relation to each other between frame members 82*a* and 82*b*, which forms parts of the machine frame structure and are positioned on one side of the corresponding box 56. A drive chain 83 has its opposite ends rigidly secured to the lift block 74, a substantially intermediate portion thereof being turned around a drive gear 84, fast with a drive shaft of an electric reversible motor M6, for example, a DC motor, carried by the frame member 82*b*, and then around a driven gear 85 rotatably carried by the frame member 82*a*.

From the foregoing, it will readily be seen that, when the motor M6 is rotated in a first direction, the suction head assembly 72 can be moved from the downwardly shifted position towards the upwardly shifted position and, when the motor M6 is rotated in a second direction counter to the first direction, the suction head assembly 72 can be moved from the upwardly shifted position towards the downwardly shifted position.

The bag pick-up device Fa associted with the box 55 is of the same construction as the bag pick-up device Fb described above. However, referring particularly to FIG. 10, during the movement of the suction head assembly 72 of the bag pick-up device Fa between the upwardly and downwardly shifted positions, the support rod 73 in the suction head assembly Fa moves loosely in a vertical groove 86*a*, defined in one of the opposed side plates (only one of which is shown by 86 in FIG. 10), and a vertical groove 87*a* defined in the side wall 55*a* of the box 55 and aligned with said vertical groove 86*a* when the box 55 is in the operative position. On the other hand, during the movement of the suction head assembly 72 of the bag pick-up device Fb between the upwardly and downwardly shifted positions, the support rod 73 in the suction head assembly Fb moves loosely in a vertical groove 86*b*, defined in the side plate 86 and being parallel to the vertical groove 86*a*, and a vertical groove 87*b* defined in the side wall 56*a* of the box 56 and aligned with the vertical groove 86*b* when the box 56 is in the operative position.

Each of the bag pick-up devices Fa and Fb is so designed that, when the suction head assembly 72 is moved from the upwardly shifted position towards the downwardly shifted position during the rotation of the motor M6 in the second direction, a portion of the support rod 73 adjacent the lift block 74 engages the free end of the actuating lever 59 or 63 to pivot the latter clockwise or counterclockwise about the corresponding pivot pin 59*a* or 63*a* and, when the same suction head assembly 72 is moved from the downwardly shifted position towards the upwardly shifted position during the rotation of the motor M6 in the first direction, a cam edge defined at 75*a* in the cam plate 75 slidingly engages a roller element 87 or 88 to pivot said cam plate 75 about the support rod 73 from the engaged position towards the disengaged position.

From the foregoing, it is clear that, as the suction head assembly 72 approaches the downwardly shifted position with the cam plate 75 biased to the engaged position, the actuating lever 59 or 63 is pivoted clockwise or counterclockwise about the corresponding pivot pin 59*a* or 63*a*, thereby causing the bottom wall 55*d* or 56*d* of the corresponding box 55 or 56 to pivot about the shaft member 57 or 61 from the lowered position towards the raised position as shown by the phantom line in FIG. 10. In this arrangement, since that portion of the bottom wall 55*d* or 56*d* being pivoted from the lowered position towards the raised position about the corresponding shaft member 57 or 61 and the suction head assembly 72 approaching the downwardly shifted position substantially clamp the folded bottoms 10*z* of the stacked bags 10*a* or 10*b* therebetween, the bottom 10*z* of the uppermost one of the stacked bags can be sucked by the suction heads 76 and 77 with certainity when vacuum is developed inside the interiors of the respective hollow cylindrical bodies 76*b* and 77*b* in a manner as will be described later.

Disposed adjacent to one of the columns, for example, the column 81*b*, of each of the bag pick-up devices Fa and Fb and stationarily supported in position in any suitable manner is a microswitch MS11 adapted to be turned on in contact with the lift block 74 when the suction head assembly 72 of the corresponding bag pick-up device Fa or Fb arrives at the upwardly shifted position. When the microswitch MS11 is so switched on in response to the arrival of the suction head assembly 72 at the upwardly lifted position, the supply of electric power to the motor M6 which has been effected to rotate the latter in the first direction is interrupted until the corresponding tray size selector switch PB2 or PB3 is again manipulated for the next succeeding cycle of operation of the automatic bagging apparatus as will become clear from the subsequent description.

The rotation of the motor M6 in the second direction to bring the suction head assembly 72 from the downwardly shifted position towards the upwardly shifted position is initiated as soon as the suction cup members 76*c* and 77*c* of the corresponding suction head assembly 72 contact the bottom wall 10*z* of the uppermost one of the stacked bags 10*a* or 10*b* for the reason which will be described later.

It is also clear that, as the suction head assembly 72 approaches the upwardly shifted position, the cam plate 75 is pivoted about the support rod 73 from the engaged position towards the disengaged position with the roller element 87 or 88 contacting the cam edge 75*a* of the cam plate 75 and, simultaneously with or shortly before the arrival of the suction head assembly 72 at the upwardly shifted position as shown by the solid line in FIG. 10, the cam plate 75 is held in the disengaged position. When the suction head assembly is in the upwardly shifted position with the cam plate 75 held in the disengaged position as shown in FIG. 10, the bag 10*a* or 10*b* which has been picked up by the corresponding suction head assembly 72 is held in position ready to be fed towards the subsequent processing position by means of the bag feeding mechanism which will now be described with particular reference to FIGS. 10, 18, 19 and 23.

Rigidly mounted on the cam plates 75 of the respective suction head assemblies 72 of the back pick-up devices Fa and Fb are microswitches MS7 and MS8. Each of these microswitches MS7 and MS8 is adapted to be turned on when the suction heads 76 and 77 of the corresponding suction head assembly 72 contacts under pressure and sucks the associated uppermost one of the stacked bags 10*a* or 10*b*. When the microswitch MS9 or MS10 is so switched on in contact with the bag 10*a* or 10*b* with the corresponding head assembly 72 moved to the downwardly shifted position, the motor M6 is reversed to rotate in the first direction and, therefore, the corresponding suction head assembly 72 is moved from the downwardly shifted position towards the upwardly shifted position in the manner described above.

(3-c) Bag Feeding Mechanism

The bag feeding mechanism G best shown in FIG. 10 is operable to feed the bag 10*a* or 10*b*, which has been transferred from the bag pick-up device Fa or Fb towards a bag receptacle 89 which is, as best shown in FIG. 10, positioned frontwardly of and at the same level as the tray assembly A.

As best shown in FIG. 10, the bag feeding mechanism G has a first passage Ga, having one end positioned adjacent the bag pick-up device Fa, a second passage Gb, having one end positioned adjacent the bag pick-up device Fb and the other end joined together with the other end of the first passage Ga, and a third passage Gc having one end communicated to the joint between the first and second passages Ga and Gb and the other end positioned adjacent the bag receptacle 89. While the third passage Gc includes a pair of opposed guide wall members 90*a* and 90*b* and a plurality of, for example, two, sets 91 and 92 of feed rolls 91*a*, 91*b* and 92*a*, 92*b*, the first passage Ga includes a pair of opposed guide wall members 93*a* and 93*b* and a feed roll 94 and the second passage Gb includes a pair of opposed guide wall members 95*a* and 95*b* and a feed roll 96, the feed rolls 94 and 96 being positioned adjacent the bag pick-up device Fa and Fb, respectively. It is to be noted that the feed rolls 91*a*, 92*a*, 94 and 96 are rotatably supported at their opposite ends by the side plates 86, respectively, while the feed rolls 91*b* and 92*b* extending in parallel relation to the associated feed rolls 91*a* and 92*a* are rotatably supported at their opposite ends by respective pairs of pivotally supported brackets (only one of the pivotally supported brackets of each pair being shown by 97 and 98) and urged towards the associated feed rolls 91*a* and 92*a* by spring elements 97*a* and 98*a*. The feed rolls 91*a*, 92*a*, 94 and 96 are driven by an electric motor M5 in the same direction by means of an endless transmission system such as an endless belt or chain generally identified by 99.

It is to be noted that each of the feed rolls 94 and 96 is so positioned that, when the suction head assembly 72 of the corresponding bag pick-up device Fa or Fb arrives at the upwardly shifted position with the bag 10*a* or 10*b* sucked by the suction heads 76 and 77, a portion of the sucked bag 10*a* or 10*b* adjacent the mouth thereof and protruding outwards from the corresponding bag pick-up device can contact the feed roll 94 or 96 as best shown in FIG. 10.

The bag feeding mechanism G further comprises a path selector 100 including, as best shown in FIG. 18(*b*), a selector roll 101 having its opposite ends loosely extending through substantially arcuate slots 102 defined in the respective side plates 86. One of the opposite ends of the selector roll 101 protruding outwards from the adjacent side plate 86 is rotatably coupled to a bracket 103 which is in turn coupled to a pivotable lever 104 by means of an elastic support strip 105 which may be a leaf spring member. As best shown in FIG. 18(*b*), the pivotable lever 104 is pivotally supported in position by the side plate 86 through a pin member 104*a* and extends at a certain angle, for example, right angles, to the elastic support strip 105, the free end of said pivotable lever 104 having a roller element 106 rotatably mounted thereon. The elastic support strip 105 and, hence, the selector roll 101, is pivotable together with the pivotable lever 104 about the pivot pin 104*a*.

The path selector 100 further includes a generally heart-shaped cam 107 having a depression 107*a* and a pair of projecting portions 107*b* and 107*c* one on each side of the depression 107*a*, all being defined on the peripheral edge of said cam 107. This cam 107 is rigidly mounted on a drive shaft of an electric reversible motor M7, for example, a DC motor, supported by an auxiliary side plate 108 positioned on one side of the auxiliary side plate 108 remote from the cam 107, said auxiliary side plate 108 being rigidly secured to and fast with the side plate 86.

Mounted on the drive shaft of the electric motor M7 for rotation together therewith and in coaxial relation to the cam 107 is first, second and third switching cams 109*a*, 109*b* and 109*c*, as best shown in FIG. 18(*a*). Operatively associated with these switching cams 109*a*, 109*b* and 109*c* is microswitches MS12, MS13 and MS14 all being carried by the auxiliary side plate 108 in side-by-side relation to each other.

In the path selector 100 of the construction so far described, the heart-shaped cam 107 is so shaped that, when the motor M7 is rotated in a first direction and clockwise as viewed in FIG. 18(*b*), the roller element 106 rides over the projection 107*b*, causing the pivotable lever 104 to pivot counterclockwise, as viewed in FIG. 18(*b*), about the pivot pin 104*a* while, when the motor M7 is rotated in a second direction counter to the first direction and counterclockwise as viewed in FIG. 18(*b*), the roller element 106 rides over the projection 107*c*, causing the pivotable lever 104 to pivot clockwise, as viewed in FIG. 18(*b*), about the pivot pin 104*a*. Because of the particular shape of the heart-shaped cam 107, it will readily be seen that, when the pivotable lever 104 is pivoted counterclockwise about the pivot pin 104*a*, the selector roll 101 is moved to a first position wherein the selector roll 101 is cooperative with the feed roll 96 to feed the large size bag 10*a* into the second passage Gb and, when the pivotable lever 104 is pivoted clockwise about the pivot pin 104*a*, the selector roll 101 is cooperative with the feed roll 94 to feed the small size bag 10*b* into the first passage Ga. For the reason as will be described later, the selector roll 101 is normally held in a stand-by position located intermediate the first and second positions as shown in FIG. 18(*b*) and is adapted to be rotated in the first direction to move the selector roll 101 from the stand-by position towards the first position when the tray size selector switch PB2 is manipulated and the microswitch MS11 associated with the bag pick-up device Fb is subsequently opened, and in the second direction to move the selector roll 101 from the standby position towards the second position when the tray size selector switch PB3 is manipulated and the microswitch MS11 associated with the bag pick-up device Fa is subsequently opened. As hereinbefore described, the microswitch MS11 for each of the bag pick-up devices Fa and Fb, as shown in FIGS. 16 and 17, is opened in response to the arrival of the corresponding suction head assembly 72 at the upwardly shifted position.

The second and third switching cams 109*b* and 109*c* are so shaped as to switch the microswitches MS13 and MS14 off to deenergize the motor M7 when the selector roll 101 is moved to the first position with the motor M7 having been rotated in the first direction and when the selector roll 101 is moved to the second position with the motor M7 having been rotated in the second direction. When any one of these microswitches MS13 and MS14 is so turned off in the manner described above, the motor M5 is energized to drive the feed rolls 91*a*, 92*a*, 94 and 96, the rotation of the motor M5 being interrupted in a manner as will be described later.

Referring back to FIG. 10, in the construction of the selector 100, depending upon whether the tray size selector switch PB2 associated with the large size bags 10*b* is manipulated or whether the tray size selector switch PB3 associated with the small size bags 10*a* is manipulated, and when the microswitch MS11 is switched on in response to the arrival of the suction head assembly 72 of the corresponding bag pick-up device Fa or Fb at the upwardly shifted position, the motor M7 is rotated in one of the opposite first and second directions. Assuming that the tray size selector switch PB3 associated with the small size bags 10*a* has been manipulated and the microswitch MS11 associated with the bag pick-up device Fa is subsequently turned on at which time the uppermost one of the small size bags 10*a* in the box 55 has already been picked up by the suction head assembly 72 and transported upwardly towards the feed roll 94, the selector roll 101 is moved to the second position by the rotation of the motor M7 in the second direction on one hand and that portion of the sucked bag 10*a* protruding outwards from the gap between the rolls 94 and 101 is sandwiched between the feed roll 94 and the selector roll 101. At the same time, since the motor M5 has already been rotated by the opening of the microswitch MS14 which is effected in response to the arrival of the selector roll 101 at the second position as hereinbefore described, the bag 10*a* is positively fed into the passage Ga and then towards the bag receptacle 89 past the successive roll sets 91 and 92 along the passage Gc. Nevertheless, the bag feeding mechanism operates in a similar manner even when the tray size selector switch PB2 associated with the large size bags 10*b* is manipulated.

As best shown in FIG. 19, the bag receptacle 89 is pivotally supported on a platform 111 of a substantially U-shaped cross section having a pair of opposed side walls 111*a* and 111*b*, for pivotal movement between receiving and transfer positions about hinge pins 112*a*, and 112*b* and is constituted by a flat bottom surface 89*a*, a pair of opposed side walls 89*b* and 89*c* and a generally comb-shaped end wall 89*d* adjacent the hinge pins 112*a* and 112*b*. So far illustrated in FIGS. 19 and 23, the bag receptacle is held in the receiving position, the transfer position of said bag receptacle 89 being shown in FIG. 30, the details of the movement of the bag receptacle 89 and the required mechanism being described under the heading of "Delivery Unit".

The flat bottom surface 89*a* of the receptacle 89 has a substantially rectangular perforation 89*e* through which a feed roll 113 partially protrudes above the flat bottom surface 89*a*. This feed roll 113 is rotatably supported by the side walls 111*a* and 111*b* of the platform 111 and is adapted to be driven by the motor M5 (FIG. 10) in synchronism with the feed rolls 94 or 96, 91*a* and 92*a*. Cooperative with this feed roll 113 is a retainer roll 114 rotatably supported on a support rod 115, said support rod 115 being supported in a manner as will be described later for movement between an upwardly shifted position, wherein said retainer roll 114 is disengaged from the feed roll 113, and a downwardly shifted position wherein, as shown in FIG. 19, said retainer roll 114 is held in position to feed the bag, which has been delivered onto the receptacle 89 through the feed rolls 92*a* and 92*b* of the roll set 92, in cooperation with the feed roll 113 until the motor M5 is subsequently deenergized in a manner as will be described later.

Stationarily positioned adjacent one end edge of the flat bottom surface 89*a* of the receptacle 89 remote from the comb-shaped end wall 89*d* and rigidly carried in a manner as will be described later under the heading of "Bag Mouth Clamping Mechanism" is a photoelectric detector PS1 best shown in FIG. 23. This photoelectric detector PS1 is of a type having a light emitter and a light receiver arranged in side-by-side relation to each other, said light receiver being capable of generating a command signal when the trailing side of the bag with respect to the direction of travel of the bag towards the receptacle 89, that is, a portion of the bag adjacent its mouth, passes over the path of travel of light from the light emitter thereby allowing the light from the light emitter to travel without being reflected towards the light receiver. Accordingly, when the command signal is generated from the photoelectric detector PS1 in the manner described above, the motor M5 is instantaneously interrupted on one hand and the motor M7 is rotated to bring the selector roll 101 back to the stand-by position. It is to be noted that the first switching cam 109*a* is so shaped as to turn the microswitch MS12 off in response to the arrival of the selector roll 101 at the stand-by position to deenergize the motor M7.

When the bag, either the large size one or the small size one, is so delivered onto the receptacle 89 in the manner described above, the bag 10 is positioned on the flat bottom surface 89*a* of the receptacle 89 with its bottom wall 10*z* facing towards the comb-shaped end wall 89*a* and its mouth facing towards the tray assembly A. It is to be noted that the bottom surface 89*a* of the bag receptacle 89 is so leveled that, when the tray assembly A is moved towards the inserted position in the manner as hereinbefore described, the bottom of the tray assembly A can slide over the bottom surface 89*a* of the receptacle 89 without being trapped by that portion of the feed roll 113 protruding upwards through the rectangular perforation 89*c* in the bottom surface 89*a*.

(4) Bag Mouth Opening Unit (4-*a*) Suction Opener & Retainer

The suction opener and retainer, generally identified by H and simply referred to as a "Suction opener" hereinafter, is operable to open the mouth of the bag 10 on the receptacle 89 and to retain the mouth of the same bag 10 in an opened condition.

The suction opener H comprises, as best shown in FIGS. 19 to 22, a movable suction head assembly 116, including a plurality of, for example, four suction heads 117*a*, 117*b*, 117*c* and 117*d* positioned in a row across the widthwise direction of the bag receptacle 89, and a stationary suction head assembly 118 including a plurality of, for example, four, suction heads 119*a*, 119*b*, 119*c* and 119*d* arranged in a row in an elongated block 120 which extends across the widthwise direction of the bag receptacle 89. This suction opener H is positioned adjacent one end of the receptacle 89 remote from the comb-shaped end wall 89*d*. The movable suction head assembly 116 also includes rigid suction pipes 121*a*, 121*b*, 121*c* and 121*d* communicated at one end with the respective suction heads 119*a*, 119*b*, 119*c* and 119*d* and at the other end with a coupler 122 which is in turn communicated with a source of suction air. Although the number of the suction heads of the movable suction head assembly 116 may differ from that of the suction heads of the stationary suction head assembly 118, in the embodiment so far illustrated the both are the same and the suction heads 117*a* to 117*d* are so positioned as to align with the corresponding suction heads 119*a* to 119*d*.

These movable and stationary suction head assemblies 116 and 118 are so positioned relative to each other that, when the bag 10 is transferred onto the bag receptacle 89 in the manner described above, a portion of the bag 10 adjacent its mouth is positioned therebetween. This can readily be accomplished by selecting the position of the photoelectric detector PS1 which detects the passage of the trailing side of the bag with respect to the direction of travel of the bag towards the receptacle 89, that is, the mouth of the bag being delivered onto the receptacle, and generates the command signal necessary to deenergize the motor M5. Accordingly, it will readily be seen that, when the suction heads 117*a*, to 117*d* of the movable suction head assembly 116 suck a portion of the side wall 10*y* of the bag adjacent its mouth with the movable suction head assembly 116 held in the downwardly shifted position as shown in FIG. 21 while the suction heads 119*a* to 119*d* of the stationary suction head assembly 118 suck a portion of the side wall 10*x* of the same bag 10 adjacent its mouth, and when the movable suction head assembly 116 is subsequently moved towards the upwardly shifted position in a manner as will be described later, the mouth of the bag 10 on the bag receptacle 89 can be opened as shown in FIG. 22.

For moving the movable suction head assembly 116 between the upwardly and downwardly shifted positions, a bundle of the rigid suction pipes 121*a* to 121*d* is rigidly secured to a framed cage 124, comprised of upper and lower frame members 124*a* and 124*b* and a pair of opposed side frame members 124*c* and 124*d*, for movement together therewith. The framed cage 124 is movably guided by a pair of spaced columns 125*a* and 125*b* extending in parallel relation to each other between frame members 126*a* and 126*b*, which form parts of the machine frame structure and are positioned on one side of the bag receptacle 89. Movably supported by the columns 125*a* and 125*b* and positioned inside the framed cage 124 and between the upper and lower frame members 124*a* and 124*b* is a lift block 127 movable between lifted and lowered positions and carrying the support rod 115 having one end remote from the roll 114 rigidly secured thereto. A drive chain 128 has its opposite ends rigidly secured to the lift block 127, a substantially intermediate portion of said drive chain 128 extending loosely through the upper frame member 124*a* of the cage 124, then turned around a driven gear 129 mounted on the frame member 126*a*, and finally turned around a drive gear 130 fast with a drive shaft of an electric reversible motor M8, for example, a DC motor, after having loosely extended through the lower frame member 124*b*. The electric reversible motor M8 for driving the drive chain 128 is rigidly secured to the frame member 126*b* or any other suitable portion of the machine frame structure.

In the construction so far described, it is clear that, when the motor M8 is rotated in a first direction, the lift block 127 if held in a downwardly shifted position as shown in FIG. 20 is upwardly shifted along the columns 125*a* and 125*b* and, during this upward movement of the lift block 127, the lift block 127 abuts the upper frame member 124*a* to lift the cage 124 upwardly together with the lift block 127 as shown in FIG. 21. On the other hand, when the motor M8 is rotated in a second direction counter to the first direction, the lift block 127 which has been upwardly shifted as shown in FIG. 22 is downwardly shifted along the columns 125*a* and 125*b* while the cage 124 descends under the influence of gravitational force with the upper frame member 124*a* held in contact with the lift block 127 and, during the continued downward movement of the lift block 127, the latter disengages from the upper frame member 124*a*, leaving the cage 124 at the position where the movable suction head assembly 116 is held in the downwardly shifted position as shown in FIG. 21.

An upright support plate 131, forming a part of the machine frame structure and carrying the frame members 126*a* and 126*b* in spaced relation to each other as best shown in FIG. 19, has a lift lever 132 pivotally secured at a substantially intermediate portion thereof to the upright support plate 131 by means of a pivot pin 132*a* and also has its opposite ends located on the respective paths of travel of pins 133 and 134 which are rigidly secured to the respective side frame member 124*d* of the cage 124 and the lift block 127. As will be described later, the lift lever 132 is pivotable about the pivot pin 132*a* between a first operative position, wherein the movable suction head assembly 116 is held in the upwardly shifted position while the retainer roll 114 is held in position to retain the bag 10 in cooperation with the feed roll 113, and a second operative position wherein the movable suction head assembly 116 is held in the downwardly shifted position while the retainer roll 114 is held in a position disengaged and separated from the feed roll 113. The condition wherein the lift lever 132 is held in the first operative position is shown in FIG. 20 while the condition wherein the lift lever 132 is held in the second operative position is shown in FIG. 21.

The suction opener H of the construction as hereinbefore described is operable in the following manner. Assuming that the bag 10, either the large size one or the small size one, is being delivered onto the bag receptacle 89 with the motor M5 being driven, the lift block 127 is held in the lowered position as shown in FIG. 20 and the lift lever 132 is consequently held in the first operative position because the pin 134 carried by the lift block 127 causes the lift lever 127 to pivot counterclockwise about the pivot pin 132*a* with one of the opposite ends of the lift lever 132 remote from the lift block 127 lifting the cage 124 upwardly in contact with the pin 133 fast with said cage 124. In this condition, the movable suction head assembly 116 is separated a distance from the stationary suction head assembly 118 on one hand and the retainer roll 114 is held in contact with the feed roll 113.

When the motor M5 is deenergized by the command signal fed from the photoelectric detector PS1 at which time the bag 10 has already been delivered onto the bag receptacle 89, the motor M8 is energized to rotate in the first direction causing the lift block 127 to move towards the lifted position. As the lift block 127 elevates a certain distance from the lowered position towards the lifted position, not only is the retainer roll 114 shifted upwardly together with the lift block 127 thereby disengaging from the feed roll 113, but also the lift lever 132 is pivoted clockwise about the pivot pin 132*a* towards the second operative position by the effect of the weight of the cage 124 then descending under the influence of gravitational force, the weight of the cage 124 being transmitted to the lift lever 132 through the pin 133 fast with the cage 124. Therefore, the movable suction head assembly 116 is brought to the downwardly shifted position as shown in FIG. 21. Simultaneously with the generation of the command signal from the photoelectric detector PS1, suction is induced in the suction heads 117*a* to 117*c* or 117*a* to 117*d* (depending upon the size of bag being actually used as will be described later) of the movable suction head assembly 116 and also in the suction heads 119*a* to 119*c* or 119*a* to 119*d* of the stationary suction head assembly 118 to enable the opposed portions of the side walls 10*y* and 10*x* of the bag 10 adjacent the mouth to be retained respectively by the movable and stationary suction head assemblies 116 and 118.

As the lift block 127 further elevates towards the lifted position, the lift block 127 becomes engaged with the upper frame member 124*a* of the cage 124 then in the downwardly shifted position and subsequently lifts the cage 124 upwardly substantially as shown in FIG. 22. Simultaneously with the upward movement of the cage 124 caused by the upward movement of the lift block 127, the movable suction head assembly 116 is moved from the downwardly shifted position towards the upwardly shifted position, thereby lifting that portion of the side wall 10*y* of the bag 10, which is sucked by the movable suction head assembly 116, away from that portion of the side wall 10*x* of the same bag 10 which is sucked by the stationary suction head assembly 118. By so doing, the mouth of the bag 10 is opened as shown in FIG. 22. In this condition, the pins 133 and 134 respectively carried by the cage 124 and the lift block 127 are disengaged from the lift lever 132, allowing the latter to assume any position in readiness for the subsequent engagement therewith.

The manner in which the suction is induced in each of the movable and stationary suction head assemblies 116 and 118 will be described later under the heading of "Pneumatic Circuit".

As best shown in FIG. 19, the upright support plate 131 carries a plurality of, for example, four, microswitches MS15, MS16, MS17, and MS18. The microswitches MS15 and MS16 are adapted to be switched on to deenergize the motor M8 to hold the lift block 127 at the lifted position. These microswitches MS15 and MS16 are alternately brought into the operative position depending upon whether the tray size selector switch PB2 has been manipulated or whether the tray size selector switch PB3 has been manipulated. The microswitch MS17 is adapted to be turned on after the cage 124 has been moved the certain distance from the downwardly shifted position towards the upwardly shifted position with the movable suction assembly 116 spaced a certain distance from the stationary suction head assembly 118. This microswitch MS17 form a part of an electric circuit for the bag mouth clamping mechanism and, therefore, will be discussed in the subsequent description of the bag mouth clamping mechanism.

The microswitch MS18 is adapted to be turned on in response to the arrival of the lift block 127 at the lowered position as shown in FIG. 20 to deenergize the motor M8 which has been rotated in the second direction. The start of the motor M8 in the second direction after the lift block 127 has arrived at the lifted position is effected in a manner as will be discussed under the heading of "Pneumatic Circuit".

It is to be noted that, in order to avoid any possibility that the bag 10 emerging from the third passage Gc (FIG. 10) and being fed onto the receptacle 89 may jump over the retainer roll 114, the support rod 115 carries a pair of deflector bars 135*a* and 135*b* one on each side of the retainer roll 114, said deflector bars 135*a* and 135*b* so protruding from the support rod 115 in a direction towards the tray assembly A as to draw the bag 10, being ejected from the third passage Gc, towards the gap between the feed and retainer rolls 113 and 114. Each of these deflector bars 135*a* and 135*b* may be made of a metallic or synthetic material having an elasticity.

(4-b) Bag Mouth Clamping Mechanism

The bag mouth clamping mechanism includes upper, side and lower clamping devices, generally identified by I, J and K, the upper and side clamping devices being shown in FIG. 25 and the lower clamping device being shown in FIG. 27, all of said upper, side and lower clamping devices being cooperative with each other to retain the mouth of the bag in an opened condition in readiness for the subsequent insertion of the tray assembly A into the bag together with goods or purchases to be bagged.

Referring to FIG. 25, the side clamping device J will first be described. The side clamping device J comprises a pair of spaced, rectangular side flaps 136 and 137 of generally L-shaped cross section supported for synchronized pivotal movement between an inoperative position, in which the side flaps 136 and 137 are pivoted clockwise and counterclockwise, respectively, and protrude into the path of travel of the bag from the third passage Gc towards the bag receptacle 89, and an operative position in which, as shown, the side flaps 136 and 137 are pivoted counterclockwise and clockwise, respectively, and protrude in a direction generally parallel to the path of travel of the bag from the third passage Gc towards the bag receptacle 89. For this purpose, the side flap 136 has a spindle 138 extending in a direction parallel to the lengthwise direction of the side flap 136 and having one end rigidly connected thereto and the other end having a driven bevel gear 139 rigidly mounted thereon, a substantially intermediate portion of said spindle 138 rotatably and axially non-movably extending through a bearing plate 140. The bearing plate 140 is rigidly secured to the overhang frame member 30*c* of the frame assembly 30 with the driven bevel gear 139 positioned thereabove. On the other hand, the side flap 137 has a spindle 141 extending in a direction parallel to the lengthwise direction of the side flap 137 and having one end rigidly connected thereto and the other end having a driven bevel gear 142 rigidly mounted thereon, a substantially intermediate portion of said spindle 141 rotatably and axially non-movably extending through a bearing plate 143. The bearing plate 143 is rigidly secured to the movable framework 18 through a support wall 144 with the driven bevel gear 142 positioned thereabove, said support wall 144 being rigidly mounted on the upper frame member 18*a* of the movable framework 18.

These side flaps 136 and 137 are selectively pivoted between the inoperative and operative positions in unison with each other by an electric reversible motor M10, for example, a DC motor, by means of a drive transmission system including a shaft structure which will now be described with particular reference to FIG. 26.

The shaft structure generally identified by 145 comprises, as best shown in FIG. 26, a rigid shaft 146 and a hollow shaft 147 having one end closed and a rigid shaft section 147*a* extending outwardly from the closed end of the hollow shaft 147, said rigid shaft 146 having one end portion axially movably inserted into the hollow of the hollow shaft 147. Preferably, the inner diameter of the hollow shaft 147 is equal to or slightly larger than the diameter of the rigid shaft 146. For avoiding any possible separation of one of the shafts 146 and 147 from the other and for enabling the shafts 146 and 147 to be rotated together, the hollow shaft 147 has a slot 147*b* defined therein and extending in an axial direction thereof on one hand and, on the other hand, a pin 146*a* having one end rigidly secured to that end portion of the rigid shaft 146 extends from the rigid shaft 146 into the slot 147*b*. It is to be noted that, instead of the employment of the slot 147*b* and the pin 146*a*, any suitable spline arrangement known to those skilled in the art may be employed. For the reason which will become clear from the subsequent description, the length of the slot 147*b* in the hollow shaft 147 is so selected as to correspond to the distance of travel of the plate structure 11 of the tray assembly A between the maximum and minimum width positions.

The shaft structure 145 constructed as hereinabove described is rotatably supported by the support wall 144 on the movable framework 18 and a support wall 148 rigidly mounted on the frame assembly 30 in a manner as shown in FIG. 25. More specifically, the rigid shaft 146 has the other end axially non-rotatably extending through a bearing member 149 and terminating outside the support wall 148 on one side opposite to the hollow shaft 147, a substantially intermediate portion of said rigid shaft 146 rotatably extending through bearing members 150 and 151 spaced apart from each other. On the other hand, one of the opposite ends of the rigid shaft section 147*a* is axially non-movably supported by the support wall 144 by means of a bearing member 152 and the other of the opposite ends of the rigid shaft section 147*a* rotatably extends through a bearing member 153, supported by an auxiliary wall member 144*a* fast with the support wall 144, and terminating in an integral connection with the hollow shaft 147.

Rigidly mounted on the free end of the rigid shaft 146 remote from the hollow shaft 147 is a driven gear 154 constantly held in mesh with a drive gear 155 which is rigidly mounted on a drive shaft of the motor M10 as best shown in FIG. 25. Rotation of the shaft structure 145 which takes place when the motor M10 is energized in a manner as will be described later can be transmitted to the side flaps 136 and 137 by means of drive bevel gears 156 and 157 which are respectively constantly engaged with the driven gears 139 and 142, said drive bevel gear 146 being rigidly mounted on the rigid shaft 146 and said drive bevel gear 147 being rigidly mounted on the rigid shaft section 147*a* of the hollow shaft 147.

Rigidly mounted on the drive shaft of the motor M10 at a position between the motor M10 and the drive gear 155 is a switching cam 158 operatively associated with microswitches MS22 and MS23 supported in angularly spaced relation to each other and in position adjacent the perimeter of the switching cam 158, the function of each of said cam 158 and microswitches MS22 and MS23 being described later. However, it is to be noted that the side flaps 136 and 137 are pivoted from the inoperative position to the operative position to widen the opened mouth of the bag on the receptacle 89 and, at the same time, stretch the foldable narrow side walls 10*v* and 10*w*, respectively, as shown in FIG. 24(*c*) when the motor M10 is rotated in one of the opposite first and second directions, for example, the first direction.

Referring now to FIGS. 25 and 26, the upper clamping device 1 comprises an upper flap 159 of generally L-shaped cross section constituted by a pair of telescopically extendable rectangular plates 160 and 161, one side portion of the plate 160 being crimped to provide a guide groove 160*a* in which a corresponding side portion of the plate 161 is received for telescopical movement in a direction parallel to and relative to the plate 160. These plates 160 and 161 have respective lugs 160*b* and 161*a* protruding generally upwardly towards the shaft structure 145 and through which the respective plates 160 and 161 are supported by the shaft structure 145 in the manner which will now be described.

As best shown in FIG. 26, a boss member 162 having one end integrally formed with a driven gear 162*a* is rotatably and axially non-movably mounted on the rigid shaft 146 at a position between the bearing members 150 and 151 in any suitable manner known to those skilled in the art. The driven gear 162*a* on the boss member 162 is constantly held in engagement with a drive gear 163 rigidly mounted on a drive shaft of an electric reversible motor M9, for example, a DC motor, such that rotation of the motor M9 can be transmitted to the boss member 162. Mounted on the boss member 162 for rotation together therewith and also for movement in a direction axially of the boss member 162 is an annular carrier block 164 having an annular recess 164*a* defined therein and protruding inwardly thereof from one end face for providing a seat for a compression spring 165. This annular carrier block 164 has an inner peripheral surface formed with an axially extending guide groove 164*b* into which a pin 162*b* fast with the boss member 162 is so engaged that the annular carrier block 164 can rotate together with the boss member 162 and also move in an axial direction relative to the boss member 162. This annular carrier block 164 also has a radially outwardly extending flange 164*c* formed on one end thereof remote from the driven gear 162*a* on the boss member 162, the function of said flange 164*c* being described later.

The annular carrier block 164 is axially movable on and relative to the boss member 162 between biased and enlarged positions and is normally biased to the biased position by the action of the compression spring 165 having one end received in the recess 164*a* in the annular carrier block 164 and the other end engaged with a seat ring 166, said seat ring 166 being loosely mounted on the boss member 162 and held in position by a stop ring 167 which is rigidly mounted on the boss member 162 at one end thereof opposite to the driven gear 162*a*.

It is the annular carrier block 164 to which the lug 160*b* of the plate 160 of the upper flap 159 is rigidly secured as best shown in FIG. 25. Accordingly, not only can the plate 160 be pivoted angularly about the shaft structure 145 when the boss member 162 is rotated by the motor M9 in the manner described above, but also the same plate 160 can be moved in a direction parallel to the shaft structure 145 when the annular carrier block 164 is axially moved in a manner as will be described later. It is to be noted that the rotation of the shaft structure 145 which is effected when the motor M10 is rotated is in no way transmitted to the boss member 162.

Rotatably and axially movably mounted on the shaft structure 145 in spaced relation to the boss member 162 is a cylindrical boss member 168 to which the lug 161*a* of the plate 161 of the upper flap 159 is rigidly secured. This cylindrical boss member 168 has one end closed and the other end formed with a radially outwardly extending flange 168*a* and receiving therein a flanged end portion of the hollow shaft 147 opposite to the rigid shaft section 147*a*, a compression spring 169 being housed within the hollow of the cylindrical boss member 168 and interposed between the closed end of said boss member 168 and the flange 147*c* on that end portion of the hollow shaft 147. In order to avoid the separation of the cylindrical boss member 168 from the hollow shaft 147, an annular lid 170 having a central opening of a diameter substantially equal to or slightly larger than the outer diameter of the hollow shaft 147 is mounted on the hollow shaft 147 and rigidly secured to the flange 168*a* of the cylindrical boss member 168 with the flanged end portion of the hollow shaft 147 situated within the hollow of the boss member 168.

From the foregoing, it will readily be seen that, by the action of the compression spring 169, the hollow shaft 147 and the cylindrical boss member 168 are axially biased in a direction away from each other. Specifically, the cylindrical boss member 168 is biased to a biased position by the compression spring 169 in a direction away from the hollow shaft 147 with the flange 147*c* on the hollow shaft 147 abutting against the annular lid 170. This cylindrical boss member 168 is freely rotatable about the shaft structure 145 independently of the rotation of said shaft structure, but is axially moved along the shaft structure 145 in a direction towards the boss member 162 when the hollow shaft 147 is axially moved together with the movement of the hollow shaft 147 with the rigid shaft 146 telescopically received therein, the movement of the hollow shaft 147 being effected together with the movement of the movable framework 144 from the expanded position towards the contracted position. This is possible because the axial movement of the hollow shaft 147 in a direction towards and away from the boss member 162 can be transmitted to the boss member 168 through the compression spring 169. It is to be noted that, even though the boss member 168 moves axially together with the hollow shaft member 147 in the manner described above, the cylindrical boss member 168 remains held in the biased position unless the compression spring 169 is axially inwardly compressed in a manner as will be described later.

As best shown in FIG. 25, rigidly mounted on the drive shaft of the motor M9 for rotation together therewith is a switching cam 171 operatively associated with microswitches MS19, MS20 and MS21 supported in positions angularly spaced in relation to each other and adjacent the perimeter of the switching cam 171, the function of each of these microswitches MS19, MS20 and MS21 being described later. It is, however, to be noted that the rotation of the annular carrier block 164 which has been transmitted thereto from the drive gear 163 through the boss member 162 via the driven gear 162*a* can be transmitted to the cylindrical boss member 168 through the plate 160 of the upper flap 159 by way of the plate 161 of the same upper flap 159. Accordingly, the plates 160 and 161 are simultaneously pivotable incident to the rotation of the annular carrier block 164 and, accordingly, the upper flap 159 is pivotable about the shaft structure 145, say, between operative and inoperative positions as will be described subsequently.

In order that the plates 160 and 161 can be moved towards respective stretched positions in a direction away from each other against the compression springs 165 and 169 irrespective of whether the movable framework 18 is held in the expanded position and, hence, the hollow shaft 147 is telescopically moved away from the rigid shaft 146 or whether the movable framework 18 is held in the contracted position and, hence, the hollow shaft 147 is telescopically moved towards the rigid shaft 146, solenoid units 172 and 174 are employed for the plates 160 and 161, respectively. As shown in FIG. 25, the solenoid unit 172 has a plunger 172*a* and is supported by a portion of the support wall 148 on the frame assembly 30 while the solenoid unit 174 has a plunger 174*a* is supported by the support wall 144.

Each of the solenoid units 172 and 174 is of a type wherein the corresponding plunger 172*a* or 174*a* is normally urged to a projected position by the action of either a biasing element built in the solenoid unit 172 or 174 or the associated compression spring 165 or 169 for the reason which will become clear later, but is moved to a retracted position when the solenoid unit 172 or 174 is electrically energized in a manner as will be described later.

The plunger 172*a* of the solenoid unit 172 is operatively associated with the annular carrier block 164 by means of an actuating lever 173 having one end pivotally connected to the plunger 172*a* and the other end slidably engaged with the flange 164*c* on the annular carrier block 164 as shown. On the other hand, the plunger 174*a* of the solenoid unit 174 is operatively associated with the cylindrical boss member 168 through an actuating lever 175 having one end pivotally connected to the plunger 174*a* and the other end slidably engaged with the flange 168*a* on the cylindrical boss 168.

Accordingly, it is clear that, when the solenoid units 172 and 174 are simultaneously energized with the corresponding plungers 172*a* and 174*a* moved towards the projected positions, the annular carrier block 164 and the cylindrical boss membr 168 are axially moved along the shaft structure 145 in a direction away from each other against the associated compression springs 165 and 169, thereby causing the plates 160 and 161 of the upper flap 159 to be stretched outwardly with respect to each other to such an extent that the entire length of the upper flap 159 corresponds to the span between the narrow side walls 10*w* and 10*v* of the bag in the mouth-opened condition, which bag may be either the large size one or the small size one. More specifically, when the plates 160 and 161 are stretched outwardly in the manner described above when the movable framework 18 is held in the contracted position, the entire length of the upper flap 159 corresponds to the span between the narrow side walls 10*w* and 10*v* of the small size bag 10*b*, whereas when the plates 160 and 161 are stretched outwardly in the manner described above when the movable framework 18 is held in the expanded position, the entire length of the upper flap 159 corresponds to the span between the narrow side walls 10*w* and 10*v* of the large size bag 10*a*. The condition wherein the plates 160 and 161 are stretched outwards with the annular carrier block 164 and the cylindrical boss member 168 respectively held in the enlarged positions is illustrated in FIG. 24(*c*) whereas the condition wherein the plates 160 and 160 are moved in a direction towards each other with the annular carrier block 164 and the cylindrical boss member 168 respectively held in the biased positions as shown in FIG. 25 is illustrated in FIG. 24(*b*).

In the foregoing description of the upper clamping device I, the upper flap 159 has been described as pivotable between the operative and inoperative positions. In practice, however, the upper flap 159 is pivotable between the inoperative and operative positions past a substantially intermediate operative position which is spaced from the operative position a short angular distance corresponding to the difference in size between the opened mouth of the large size bag 10*a* and that of the small size bag 10*b*, that is, the difference between the height of the side wall 10*z* of the mouth-opened large size bag 10*a* above the flat bottom surface 89*a* of the receptacle 89 and that of the mouth-opened small size bag 10*b* above the flat bottom surface 89*a* of the receptacle 89, as can readily be seen from a comparison between FIGS. 27(*a*) and 27(*b*). In other words, when the small size bag 10*b* is desired to be used and is, therefore, fed onto the receptacle 89, and after the mouth of such small size bag 10*b* has been opened in the manner as hereinbefore described, the motor M9 is rotated to such an extent as to cause the upper flap 159 to assume the intermediate operative position as schematically shown in FIG. 27(*a*). On the other hand, when the large size bag 10*a* is desired to be used and is, therefore, fed onto the receptacle 89, and after the mouth of such large size bag 10*a* has been opened in the same manner, the motor M9 is rotated to such an extent as to cause the upper flap 159 to assume the operative position as shown in FIG. 27(*b*). The manner in which this can be achieved will be described in connection with the various microswitches employed in the bag mouth clamping mechanism.

Hereinafter, the construction of the lower clamping device K will be described with particular reference to FIGS. 23 and 28. Referring now to FIGS. 23 and 28, the lower clamping device K is positioned between the elongated support block 120 and the feed roll set 62 and generally below the upper clamping device I of the construction hereinbefore described. This lower clamping device K comprises, as best shown in FIG. 28, an elongated, substantially rectangular plate 176 pivotally supported by a pair of opposed auxiliary support plates (only one of which is shown by 86*a*), which are rigidly secured to the corresponding side plates 86 (FIG. 10), by means of a support shaft 177 pivotable together with said elongated plate 179. The elongated plate 176 has an elongated lower clamping flap 178 connected at one side edge integrally with the elongated plate 176 and protruding generally at right angles to the plate 176 in a direction towards the bag receptacle 89. The elongated lower clamping flap 178 is of a length smaller than that of the elongated plate 176 which must be larger than the width of the large size bag 10*a*, the length of said lower clamping flap 178 being slightly smaller than the width of the small size bag 10*b*.

The elongated plate 176 has an exit slot 176*a* defined therein and extending in a direction parallel to the lengthwise direction of the plate 176 and also has a pair of opposed guide plates 179*a* and 179*b* rigidly secured to the opposed side edges of the plate 176 which define the exit slot 176*a*. More specifically, the guide plates 179*a* and 179*b* are rigidly secured to the opposed side edges, respectively, of the plate 176 defining the exit slot 176*a* in such a manner that one of the opposite side portions of each of the guide plates 179*a* and 179*b* protrudes laterally of the elongated plate 176 in a direction generally parallel to the lower clamping flap 178 while the other of the opposite side portions of the corresponding guide plate protrudes laterally of the elongated plate 176 in a direction towards the feed roll set 92. These guide plates 179*a* and 179*b* cooperate with each other to guide the bag 10 being fed through the feed roll set 92 to pass through the exit slot 176*a* towards the bag receptacle 89. It is accordingly preferred that the adjacent side portions of the respective guide plates 179*a* and 179*b* situated on one side adjacent the feed roll set 92 are curved so as to diverge from each other as clearly shown in FIG. 28.

Positioned beneath the elongated plate 176 is an electrically operated drive motor M11 stationarily supported in any known manner on the machine frame structure and has a drive shaft having an actuating cam 180 and a pair of switching cams 181 and 182 all rigidly mounted thereon for rotation together therewith. While the switching cams 181 and 182 are operatively associated with respective microswitches MS24 and MS25 positioned adjacent the respective perimeters of the cams 181 and 182 and are operable in the manner which will be described later, the actuating cam 180 is operatively associated with the elongated plate 176 by means of a rocking arm 183 having one end rigidly connected to the support shaft 177 and the other end carrying a roller element 184.

The elongated plate 176 is normally biased counterclockwise about the support shaft 177 as viewed in FIG. 23 by the action of one or two spring elements, for example, tension springs 184*a* and 184*b*, the tension spring 184*a* being suspended between the side plate 86 and a connecting arm 185*a* rigidly mounted on one end of the support shaft 177 while the tension spring 184*b* is suspended between the side plate 86 and a connecting arm 185*b* rigidly mounted on the other end of the support shaft 177.

The actuating cam 180 is so shaped and so designed that one complete rotation of the motor M11 results in the reciprocal movement of the plate 176 about the support shaft 177 between feed and clamping positions. The elongated plate 176 when in the feed position as shown in FIG. 23 is held in position to allow the bag 10 being ejected from the feed roll set 92 to pass through the exit slot 176*a*, whereas the elongated plate 176 when in the clamping position is held in position to allow the lower clamping flap 178 to clamp and retain the portion of the side wall 10*x* of the bag between it and the elongated support block 120 substantially as shown in FIGS. 24(*b*) and 24(*c*).

While the bag mouth clamping mechanism is constructed as hereinbefore described, it operates in the following manner.

Assuming that the mouth of the bag 10 resting on the bag receptacle 89 is being opened with the cage 124 being upwardly shifted by the upward shift of the lift block 127 as hereinbefore described with reference to FIGS. 20 to 22, the cage 124 causes the microswitch MS17 (FIG. 19) to be turned on. At this time, the suction head assembly 116 movable together with the cage 124 has already been spaced a distance away from the stationary suction head assembly 118 and, therefore, the mouth of the bag 10 has already been opened substantially halfway or held substantially ajar in a manner as shown in FIG. 24(*a*).

On the other hand, when the microswitch MS17 is turned on in the manner described above, not only is the motor M11 rotated in one direction, but also the motor M9 is rotated in a first direction. Upon rotation of the motor M11 in said one direction, the elongated plate 176 of the lower clamping device K is pivoted about the support shaft 177 from the feed position towards the clamping position with the roller element 184 following the contour of the actuating cam 180. During this movement of the elongated plate 176 from the feed position towards the clamping position, the lower clamping flap 178 projects into the half-opened mouth of the bag 10 on the bag receptacle 89 and, simultaneously with the arrival of the plate 176 to the clamping position, the lower clamping flap 178 is held in position to clamp and retain the portion of the side wall 10*x* of the mouth-opened bag 10 between it and the elongated support block 120 as shown in FIG. 24(*b*). It is to be noted that the switching cam 182 associated with the microswitch MS25 is so shaped as to turn the microswitch MS25 off to deenergize the motor M11 when the plate 176 is pivoted to the clamping position at which time the motor M8 is also deenergized.

On the other hand, upon rotation of the motor M10 in said first direction, the upper flap 159 is pivoted about the shaft structure 145 from the inoperative position towards the operative position and, during this movement, the upper flap 159 projects into the half-opened mouth of the bag 10 on the receptacle 89, thereby clamping and retaining the portion of the side wall 10*y* of the mouth-opened bag in cooperation with the movable suction head assembly 116 in a manner as shown in FIG. 24(*b*). Thereafter, the upper flap 159 continues its pivotal movement towards the operative position while retaining that portion of the mouth-opened bag in cooperation with the movable suction head assembly 116 then being upwardly shifted. The pivotal movement of the upper flap 159 is interrupted when the cage 124 arrives at its upwardly shifted position as shown in FIG. 22 at which time the microswitch MS21 is turned on to deenergize the motor M9 then rotated in the first direction.

It is to be noted that, because of the particular shape of the switching cam 171 rotatable together with the motor M9, the microswitch MS20 is turned on shortly before or simultaneously with the completion of the rotation of the motor M9 in the first direction, said microswitch MS20 being so operatively associated with the solenoid unit 172 and 174 as to energize simultaneously the solenoid units 172 and 174 and also to energize the motor M10 to rotate the latter in a first direction, when the microswitch MS20 is so switched on in the manner described above.

When the solenoid units 172 and 174 are simultaneously energized, the annular carrier block 164 and the cylindrical boss member 168 are axially moved away from each other along the shaft structure 145 against the respective compression springs 165 and 169 and, therefore, the plates 160 and 161 of the lower clamping flap 159 are moved outwardly with respect to each other to stretch the side wall 10*y* of the bag widthwise as shown in FIG. 24(*c*).

On the other hand, when the motor M10 is rotated in the first direction causing the shaft structure 145 to rotate clockwise as shown by the arrow in FIG. 25, the side flaps 136 and 137 are pivoted from their inoperative positions towards the operative positions about the associated spindles 138 and 139. When the side flaps 136 and 137 are pivoted to the operative positions in the manner described above, the microswitch MS22 is turned on to deenergize the motor M10. This may take place simultaneously with or shortly after the arrival of the movable suction head assembly 116 at the upwardly shifted position. As hereinbefore described, when in the operative positions, the side flaps 136 and 137 serve to widen the mouth of the bag with its narrow side walls 10*w* and 10*v* unfolded as shown in FIG. 24(*c*).

In the manner described above, simultaneously with or shortly after the arrival of the movable suction head assembly 116 at the upwardly shifted position as shown in FIG. 22 and also FIG. 24(*c*), the opened mouth of the bag 10 is so shaped as to permit the subsequent insertion into the bag 10 of the tray assembly A having thereon the goods or purchases to be bagged, with no substantial possibility that the bag will be broken as its mouth when the tray assembly A with the goods or purchases thereon is subsequently inserted thereinto. Specifically, depending upon the type of the goods or purchases to be bagged, the upper clamping flap 159 serves not only to avoid the possible contact of some of the goods or purchases being bagged with the upper lip of the mouth of the bag if the height of the block of the goods or purchases on the tray assembly A above the bottom of said tray assembly A is slightly larger than the span between the upper and lower lips of the mouth of the bag, but also to compress them downwardly to permit them to pass under the upper clamping flap 159 into the bag 10. Should this downward compression of some of the goods or purchases on the tray assembly A being moved towards the inserted position be undesirable or be avoided, means may be provided, as will be described later, for detecting the height of the goods or purchases on the tray assembly A and for interrupting the continued movement of the tray assembly A towards the inserted position when the detected height is in excess of the predetermined value, that is, the span between the upper and lower lips of the mouth of the bag 10.

It is to be noted that the operation of the bag mouth clamping mechanism in the manner so far described takes place when either one of the tray size selector switches PB2 and PB3 has been manipulated. Accordingly, in order to enable the upper clamping flap 159, the lower clamping flap 178 and the side flaps 136 and 137 to return back to their respective original positions, the start switch PB1 (FIG. 1) must be manipulated. This will be described later in connection with the bag erecting mechanism.

(4-c) Air Injector

Referring now to FIGS. 29, 34 and 36 to 38, an air injector generally identified by L is operable to apply one or more, for example, two successive blasts of air into the mouth-opened bag 10 to bring the latter in the completely opened condition referred to and defined in the previous description concerning the bag container E. As hereinbefore defined, the completely opened bag is the one wherein the substantially rectangular cubic interior space is formed inside the bag subsequent to the opening of the mouth of the same bag. Speaking differently, assuming that the bag 10 is resting on the bag receptacle 89, when the mouth-opened bag 10 is brought to the completely opened condition, the bottom wall 10*z* assumes a parallel relationship to the comb-shaped end wall 89*d* on one hand and, on the other hand, the opposed side walls 10*x* and 10*y* assume a parallel relationship with each other while the side walls 10*v* and 10*w* assume a parallel relationship with each other. According to the present invention, insertion of the goods or purchases on the tray assembly A into the bag 10 takes place after the bag 10 on the receptacle 89 has been brought into the completely opened condition.

The air injector L comprises, as best shown in FIGS. 29, 38 and 39, a cylindrical hollow casing 186 having its opposite ends closed by respective annular end plates 187*a* and 187*b*, the annular end plates 187*a* and 187*b* having respective annular bearings 188*a* and 188*b* which are pressure-fitted into the associated openings in the end plates 187*a* and 187*b*. This cylindrical hollow casing 186 has defined therein an intake port 189, communicated with a source of compressed air as will be described later, and a plurality of, for example, four, outlet ports 190*a*, 190*b*, 190*c* and 190*d* arranged in a row in equally spaced relation to each other in a direction parallel to the longitudinal axis of the hollow casing 186, the position of the row of the outlet ports 190*a* to 190*b* being substantially opposite to the position of the intake port 189.

As best shown in FIGS. 29, 37 and 38, threadingly or rigidly connected to the outlet ports 190*a* and 190*d* in the cylindrical hollow casing 186 are nozzle members 191*a*, 191*b*, 191*c* and 191*d* equal in number to the number of the outlet ports 190*a* to 190*d*, through which nozzle members 191*a* to 191*d* compressed air is fed into the mouth-opened bag 10 on the receptacle 89 in a manner as will be described later. On the other hand, the intake port 189 in the cylindrical hollow casing 186 is communicated with the source of compression air through a coupling sleeve 192 by way of a flexible tubing 193 best shown in FIG. 34.

As best shown in FIGS. 38 and 39, the air injector L further comprises a cylindrical hollow rotor 194 having its opposite ends closed by respective lids 195*a* and 195*b*, each of said lids 195*a* and 195*b* having a bearing stud 196*a* or 196*b* which is integrally formed therewith and protrudes in a direction away from the rotor 194. The cylindrical hollow rotor 194 has an outer diameter substantially equal to or slightly smaller than the inner diameter of the cylindrical hollow casing 186 and is rotatably housed within the cylinder hollow casing 186 with the studs 196*a* and 196*b* protruding outwards through the respective annular bearings 188*a* and 188*b* as best shown in FIG. 39. The cylindrical hollow rotor 194 has defined therein an inlet 197 and outlet openings 198*a*, 198*b*, 198*c* and 198*d* equal in number to the number of the outlet ports 190*a* to 190*d* in the casing 186, said inlet 197 and outlet openings 198*a* to 198*d* being so positioned in the cylindrical hollow rotor 194 that, when said hollow rotor 194 is rotated through a predetermined angle, for example, not more than 90°, in one of the opposite directions about the longitudinal axis of any one of the studs 196*a* and 196*b*, the inlet 197 can be aligned and, therefore, communicated with the inlet port 189 and, at the same time, the outlet openings 198*a* to 198*d* can be aligned and, therefore, communicated with the outlet ports 190*a* to 190*d* as shown in FIG. 39. Alternatively, as can readily be understood from FIG. 38 and by those skilled in the art, it is possible to employ an inlet 197 of a size sufficient to render it to be communicated with the inlet port 189 at all times irrespective of whether the outlet openings 198*a* to 198*d* are communicated with the corresponding outlet ports 190*a* to 190*d* or whether the outlet openings 198*a* to 198*d* are brought out of alignment with the outlet ports 190*a* to 190*d*.

For selectively rotating the hollow rotor 194 in the opposite directions one at a time about the longitudinal axis of any one of the studs 196*a* and 196*b*, there is employed a rotary solenoid unit 199 of a type having an electromagnetically driven rotor 199*a* rotatable between closed and opened positions, but normally biased to the closed position by either a built-in biasing element or the effect of magnetic attraction, said rotary solenoid unit 199 being of any known construction. This rotary solenoid unit 199 is associated with the hollow rotor 194 with the rotor 199*a* coupled to the stud 196*a* such that, when the rotary solenoid unit 199 is electrically energized, the rotor 199*a* is rotated from the closed position towards the opened position to bring the inlet 197 and the outlet openings 198*a* to 198*d* into alignment with, that is, communication with, the inlet port 189 and the outlet ports 190*a* to 190*d*, but is rotated back to the closed position when the rotary solenoid unit 199 is deenergized.

The air injector L of the construction as hereinbefore described and, particularly the air injecting nozzle members 191*a* to 191*d*, is so positioned between the front of the tray assembly A and the bag receptacle 89 and below the plane in which the bottom of the tray assembly A lies that blasts of air emerging from the nozzle members 191*a* to 191*d* can be directed towards the mouth-opened bag 10 on the bag receptacle 89.

The operation of the air injector L and the time at which the blasts of air are supplied into the mouth-opened bag will be described later.

(5) Delivery Unit (5-a) Bag Erecting Mechanism

The bag erecting mechanism generally identified by M in FIG. 30 is operable, subsequent to the insertion of the goods or purchases into the bag 10 resting on the bag receptacle 89 and after the microswitch MS24 (FIG. 28) has been turned off by the switching cam 181, to erect into a substantiall upright position the bag 10 which has been loaded with the goods or purchases, but is still horizontally lying on the bag receptacle 89 with the opened mouth thereof facing towards the tray assembly A.

The bag receptacle 89 has been described as pivotally connected to the platform 111 by means of the hinge pins 112*a* and 112*b* with reference to FIG. 19. As shown in FIG. 19, the side walls 111*a* and 111*b* of the platform 111 are pivotally connected at one end to the opposite ends of the elongated support block 120 by means of hinge pins, only one of which is shown by 200. It is to be noted that such one of the hinge pins numbered 200 in FIG. 19 concurrently serves as a support rod for the support of relay gears 201 and 202 around which a part of the endless transmission system 99 (FIG. 10 ) and an endless chain 203 for transmitting the drive of the endless transmission system 99 to the feed roll 113 are respectively turned as shown.

From the foregoing, it will readily be seen that the platform 111 is tiltable together with the bag receptacle 89 between a horizontal position, as shown in FIG. 23 and as shown by the solid line in FIG. 30, and a tilted position as shown by the broken line in FIG. 30 about the longitudinal axis of any one of the hinge pins 200 positioned in opposed relation to the hinge pins 112*a* and 112*b*.

Referring now to FIG. 30, for effecting the pivotal movement of the platform 111 between the horizontal position and the tilted position in the manner described above, there is employed a crank arm 204 having one end pivotally connected to the platform 111 and the other end pivotally connected to a crank wheel 205, said crank wheel 205 being rigidly mounted on a drive shaft of an electrically operated motor M12 which is stationarily positioned on the machine frame structure. The drive mechanism including the motor M12, the crank arm 204 and the crank wheel 205 is preferably so designed that half the complete rotation of the motor M12 results in the pivotal movement of the platform 111 through 30° about the longitudinal axis of any one of the hinge pins 200 from the horizontal position to the tilted position, and vice versa. Therefore, it will readily be seen that one complete rotation of the motor M12 results in the reciprocal pivotal movement of the platform 111 from the horizontal position back to the horizontal position past the tilted position.

The bag receptacle 89 is held in the receiving position when the platform 111 is in the horizontal position, and remains the same though tilted together with the platform 111 when the latter is pivoted to the tilted position. However, this bag receptable 89 is brought to the transfer position, as shown by the broken line in FIG. 30, when and after the platform 111 has been pivoted to the tilted position. By so doing, the bag 10 loaded with the goods or purchases to be bagged, which has been held in a horizontal condition when the plaform 111 is in the horizontal position, can be brought into the substantially upright position with the mouth thereof facing upwards. For this purpose, another drive mechanism is employed and comprises an electrically operated motor M13 rigidly carried by and positioned underneath the platform 111, said motor M13 having the drive shaft on which a crank wheel 206 is rigidly mounted for rotation together with said drive shaft of the motor M13. The crank wheel 206 is operatively coupled to the bag receptacle 89 by means of a crank arm 207 having one end pivotally connected to the bag receptacle 89 and the other end pivotally connected to said crank wheel 206.

The drive mechanism including the motor M13, the crank wheel 206 and the crank arm 207 are preferably so designed that half the complete rotation of the motor M13 results in the pivotal movement of the bag receptable 89 through 60° about the longitudinal axis of any one of the hinge pins 112*a* and 112*b* from the receiving position to the transfer position, and vice versa. Accordingly, it will readily be seen that one complete rotation of the motor M13 results in the reciprocal pivotal movement of the platform 111 from the receiving position back to the receiving position past the transfer position.

It is to be noted that the first mentioned drive mechanism including the motor M12 may be positioned on either one or both sides of the platform 111. Where the first mentioned drive mechanism is employed on each side of the platform 111, the motor M12 may be of a type having a pair of opposed drive shafts extending in the opposite directions away from each other. It is also to be noted that the second mentioned drive mechanism including the motor M13 may be positioned substantially intermediately of the width of the platform 111 or the bag receptacle 89, or it may be constructed in a manner similar to the first mentioned drive mechanism.

Microswitches MS26 and MS27 are utilized to detect the position of the platform 111 and are adapted to be turned off when the platform 111 is in the tilted and horizontal positions, respectively. Microswitches MS28 and MS29 are utilized to detect the position of the bag receptacle 89 and are adapted to be turned off when the bag receptacle 89 is in the transfer and receiving positions, respectively.

The system wherein, in erecting the loaded bag 10, the platform 111 is tilted together with the bag receptacle 89 and then the bag receptacle 89 is pivoted to the transfer position, such as described above with reference to FIG. 30 and according to the present invention, is advantageous in that the height of the front portion of the automatic bagging apparatus in terms of the direction of movement of the customer past the cashier's station can be minimized to the level of the waist of the customer. In addition, there is another advantage that the top of that front portion of the automatic bagging apparatus on one side of the bag receptacle 89 remote from the tray assembly A can be utilized in any manner known to those skilled in the art, for example, as a temporary support table.

Furthermore, with the above described system, there is no substantial possibility that some of the goods or purchases loaded in the bag and positioned adjacent the mouth of the bag may roll over the mouth of the bag to the outside of such bag, which would be likely to occur under the influence of vibrations at the time of a sudden start of movement of the receptable 89 from the receiving position towards the transfer position if the platform 111 were fixed relative to the machine frame structure. As can readily be recognizeable by those skilled in the art, according to the present invention, since the bag receptable 89 is pivotable from the receiving position towards the transfer position only after the platform 111 has been pivoted to the tilted position together with such bag receptacle 89, some of the goods or purchases loaded in the bag and positioned adjacent the mouth thereof are forced to move towards the bottom of the bag by the effect of the gravitational force during the tilting of the platform 111 and, therefore, the above described possibility can advantageously be minimized.

(5-b) Bag Transporting Mechanism

Referring still to FIG. 30, the bag transporting mechanism N comprises a generally L-shaped carriage 208 constituted by a back plate 208*a* substantially comb-shaped seat plate 208*b* protruding from the back plate 208*a* at right angles thereto in a direction towards the bag receptacle 89 in the transfer position, as best shown in FIGS. 31 to 33. This carriage 208 is mounted on a traveller 209 for movement together therewith between a receiving position and a lifting position past a substantially intermediate stand-by position as will be described later, said traveller 209 being movably supported on a pair of equally spaced guide rods 210*a* and 210*b*, positioned one above the other, in a manner as best shown in FIG. 33. A drive chain, schematically shown by the chain line 211 in FIGS. 30 and 33, has its opposite ends connected rigidly to the traveller 209, a substantially intermediate portion of said drive chain 211 being turned around a drive sprocket wheel 212 and then around a driven sprocket wheel 213 after having loosely passed through the traveller 219 at a position spaced from where the opposite ends of the drive chain 211 are rigidly secured to the traveller 209. The drive sprocket wheel 212 is rigidly mounted on a drive shaft of an electric reversible motor M14 such that, when said motor M14 is rotated in a first direction, the carriage 208 is moved from the receiving position as shown by the solid line in FIG. 30 towards the lifting position as shown by the broken line in FIG. 30 while, when the motor M14 is rotated in a second direction counter to the first direction, the carriage 208 is moved from the lifting position towards the receiving position.

As best shown in FIG. 30, the carriage 208 is so inclined relative to the traveller 209 that the back plate 208*a* and the seat plate 208*b* can extend in parallel relation to the comb-shaped end plate 89*d* and the flat bottom surface 89*a* of the bag receptacle 89 when the latter is held in the transfer position with the platform 111 held in the tilted position as shown by the broken line. In particular, while the back plate 208*a* and the comb-shaped seat plate 208*b* are connected at right angles to each other, the carriage 208 is rigidly mounted on the traveller 209 in such a manner as to render the back plate 208*a* and the seat plate 208*b* to incline frontwardly with respect to the direction of movement of the carriage 208 towards the lifting position and upwardly of the guide rods 210*a* and 210*b*, respectively. By this arrangement, the loaded bag can steadily be supported by and on the carriage 208 during the movement of the carriage 208 from the receiving position towards the lifting position.

Referring particularly to FIG. 31, the manner in which the loaded bag can be transferred from the bag receptacle 89 onto the carriage 208 will now be described. The end plate 89*d* of the bag receptacle 89 and the seat plate 208*b* of the carriage 208 have been described as substantially comb-shaped. In other words, the end plate 89*d* and the seat plate 208*b* have their respective fingers so designed and so sized that, when the bag receptacle 89 is pivoted to the transfer position, the fingers of the comb-shaped end plate 89*d* can loosely be interleaved with the fingers of the comb-shaped seat plate 208*b*, one finger of the comb-shaped end plate 89*d* positioned in a space between every two adjacent members of the fingers of the comb-shaped seat plate 208*b*, as best shown in FIG. 31. In addition, the transfer position of the bag receptacle 89 is so selected relative to the receiving position of the carriage 209 that, when the bag receptacle 89 is pivoted to the transfer position after the platform 111 has been pivoted to the tilted position as shown by the broken line in FIG. 30, the comb-shaped end plate 89*d* of the bag receptable 89 is positioned a slight distance below the comb-shaped seat plate 208*b* of the carriage 208 with the fingers of the end plate 89*d* protruding downwardly through the corresponding spaces between the fingers of the seat plate 208*b*.

Accordingly, it is clear that, when the bag receptacle 89 is pivoted to the transfer position subsequent to the arrival of the platform 111 to the tilted position, the loaded bag on the bag receptacle 89 is seated on the comb-shaped seat plate 208*b* with the fingers of the end plate 89*d* of the bag receptacle 89 spaced a slight distance from the bottom of the loaded bag. Subsequent movement of the carriage 208 from the receiving position towards the lifting position effected in a manner as will be described later allows the loaded bag on the carriage 208 to leave from the bag receptacle 89 in the transfer position. By so doing, the loading bag which has been transferred onto the carriage 208 can be transported to the next succeeding processing station.

Positioned adjacent one of the guide rods, for example, the guide rod 210*b*, are microswitches MS31, MS32 and MS30 which are respectively aligned with the receiving, standby and lifting positions of the carriage 208. These microswitches MS30 to MS32 are adapted to be actuated by a feeler 209*a* rigidly carried by the traveller 209 in such a manner as will be described later in connection with the operation of the delivery unit.

(5-c) Bag Lift

The bag lift, generally identified by O, is positioned on one side of the bag transporting mechanism N remote from the bag erecting mechanism M and is operable to lift the loaded bag to a position accessible to the customer so that the customer can take it away.

Referring still to FIGS. 30, 32 and 33, the bag lift O comprises a lifting carriage 214, comprised of a pair of support plates 215 and 216 of substantially inverted L-shape, each of said support plates 215 and 216 being constituted by a generally comb-shaped plate 215*a* or 216*a* and a side plate 215*b* or 216*b*, and a guide structure 217 for guiding the lift carriage 214 between lowered and lifted positions in a direction generally perpendicular to the guide rods 210*a* and 210*b*. The guide structure 217 comprises two spaced pairs 218 and 219 of guide columns, one pair positioned on each side of the guide rods 210*a* and 210*b*, extending between lower and upper brackets 220 and 221 which are spaced from each other, but are fixed relative to the machine frame structure. The lifting carriage 214 is connected to the guide structure 217 in such a manner that the side plates 215*b* and 216*b* of the associated support plates 215 and 216 are movably mounted on the guide columns of the respective pairs 218 and 219 with the comb-shaped plates 215*a* and 216*b* held flush or level with each other as best shown in FIG. 33.

For driving the lift carriage 214 between the lowered and lifted positions and, more particularly, for driving the support plates 215 and 216 between the lowered and lifted positions in synchronism with each other, a single electric reversible motor M15, for example, a DC motor, and a pair of drive chains 222 and 223 are employed. As best shown in FIG. 33, the drive motor M15 is stationarily positioned on the machine frame structure through a bracket 224 and has its drive shaft operatively coupled to an intermediate drive shaft 225 by means of an endless transmission system 226 which may be constituted by either an endless belt or an endless chain. The intermediate drive shaft 225 is rotatably suspended from the bracket 220 and extends in a direction widthwise of the automatic bagging apparatus and across the guide rods 210*a* and 210*b*, the opposite ends of said shaft 225 having drive bevel gears 227 and 228 rigidly mounted thereon for rotation together therewith. The drive bevel gears 227 and 228 are constantly held in mesh with driven bevel gears 229 and 230, respectively. As best shown in FIG. 30, the driven bevel gears 229 and 230 are rigidly mounted on respective shaft members 231 and 232 which are rotatably suspended from the bracket 220 and extend in spaced relation to each other in a direction perpendicular to the intermediate drive shaft 225.

The shaft members 231 and 232 have drive sprocket wheels 233 and 234 rigidly mounted thereon for rotation together therewith. The drive chain 222 has its opposite ends rigidly secured to the support plate 215, a substantially intermediate portion thereof being turned around the drive sprocket wheel 233 and then around a driven sprocket wheel 235 which is rotatably supported on the upper bracket 221 as shown in FIG. 33. On the other hand, the drive chain 223 has its opposite ends rigidly secured to the support plate 216, a substantially intermediate portion thereof being turned around the drive sprocket wheel 234 and then around a driven sprocket wheel 236 which is rotatably supported on the upper bracket 221 as shown in FIG. 33.

Accordingly, it is clear that, when the motor M15 is rotated in one of the opposite directions, for example, a first direction, the lifting carriage 214 is moved from the lowered position, as shown by the solid line in FIG. 30, towards the lifted position as shown by the broken line in FIG. 30 and, when the same motor M15 is rotated in a second direction counter to the first direction, the lifting carriage 214 is moved from the lifted position towards the lowered position. in particular, during the movement of the lifting carriage 214, the support plates 215 and 216 move in synchronism with each other with the comb-shaped plates 215*a* and 216*a* constantly held level or flush with each other.

The lowered position of the lifting carriage 214 is so selected that the comb-shaped plates 215*a* and 216*a* of the respective support plates 215 and 216 are positioned below the comb-shaped seat plate 208*b* of the carriage 208 when the latter is held in the lifting position as shown by the broken line in FIG. 30, while the structural relationship between the comb-shaped plates 215*a* and 216*a* of the support plates 215 and 216 and the comb-shaped seat plate 208*b* of the carriage 208 is similar to that between the comb-shaped seat plate 208*b* and the comb-shaped end plate 89*d* of the bag receptacle 89. Therefore, it is clear that, during the movement of the carriage 214 from the lowered position towards the lifted position which takes place when the carriage 208 is held in the lifting position, the fingers of each of the comb-shaped plates 215*a* and 216*a* of the respective support plates 215 and 216 pass through the corresponding spaces between the fingers of the comb-shaped seat plate 208*b* of the carriage 208 as can readily be understood from FIG. 32.

For detecting the position of the lifting carriage 214, microswitches MS33 and MS34 each adapted to be actuated by a feeler 214*a* are positioned along and adjacent one pair of the guide columns, for example, one of the guide columns of the pair 218, in alignment with the lifted and lowered positions, respectively, the function of each of said microswitches MS33 and MS34 being described later.

Pivotally supported by the machine frame structure for movement between release and support positions at a position adjacent the top of the front portion of the automatic bagging apparatus is a temporary support structure 237 rigidly mounted on a support shaft 238 having its opposite ends journalled in the side walls of the machine frame structure. This temporary support structure 237 has a generally comb-shaped portion defined at 237*a*, said comb-shaped portion 237*a* having a shape so similar to the comb-shaped seat plate 208*b* of the carriage 208 that, even when the carriage 214 is in the lifted position as shown by the broken line in FIG. 30, the temporary support structure 237 can pivot from the release position, as shown by the solid line in FIG. 30, towards the support position as shown by the broken line in FIG. 30 with the fingers of the comb-shaped portion 237*a* passing upwardly through the corresponding spaces between the fingers of the comb-shaped plates 215*a* and 216*a* of the respective support plates 215 and 216. The temporary support structure 237 is so designed that, when it is held in the support position as shown by the broken line in FIG. 30, the comb-shaped portion 237*a* thereof can be positioned level with or slightly above the top of the front portion of the automatic bagging apparatus.

The support shaft 238 is operatively connected to a rocking lever 239, supported on the machine frame structure for pivotal movement between operative and inoperative positions about a hinge 239*b*, through a pivot arm 240 having one end rigidly connected to the support shaft 238 and the other end carrying a guide pin 240*a*. The guide pin 240*a* fast with the pivot arm 240 is so slidingly engaged in a guide slot 239*a* defined in the rocking lever 239 that the movement of the rocking lever 239 can be transmitted to the pivot arm 240 to move the temporary support structure 237 between the release and support positions. More specifically, when the rocking lever 239 is pivoted clockwise about the hinge 239*b* as viewed in FIG. 30 from the inoperative position towards the operative position, the temporary support structure 237 is pivoted from the release position towards the support position and, when the rocking lever 239 is pivoted counterclockwise about the hinge 239*b* from the operative position towards the inoperative position, the temporary support structure 237 is pivoted from the support position towards the release position. It is to be noted that, during the movement of the rocking lever 239 from either one of the operative and inoperative positions to the other of the operative and inoperative positions, the pin 240*a* reciprocately moves within the guide slot 239*a* in the rocking lever 239.

for moving the rocking lever 239 between the operative and inoperative positions, any suitable drive mechanism may be employed. For example, the hinge 239*b* may be constituted by a drive shaft of an electrically operated motor. Alternatively, the rocking lever 239 may be operatively connected to an electrically operated motor or a hydraulic cylinder through any suitable transmission system. However, so far illustrated, the drive mechanism comprises an electrically operated motor M16 having a crank wheel 241 eccentrically mounted on a drive shaft of the motor M16 for rotation together therewith, said crank wheel 241 being supported in position with its peripheral face slidingly contacting the rocking lever 240 as schematically shown in FIG. 30. The crank wheel 240 is so shaped that one complete rotation of said crank wheel 240 results in reciprocal movement of the rocking lever 239 between the inoperative and operative positions.

Rigidly mounted on the drive shaft of the motor M16 for rotation together therewith are switching cams 242 and 243 operatively associated with microswitches MS35 and MS36, respectively, said microswitches MS35 and MS36 being positioned adjacent the perimeters of the respective microswitches MS35 and MS36 for detecting the position of the drive shaft of the motor M16 and, therefore, the crank wheel 241 relative to the rocking lever 239.

The temporary support structure 237 is operable to support the loaded bag in position ready to be taken away by the customer. Where the automatic bagging apparatus according to the present invention is so designed that one complete cycle of operation thereof completes each time the customer takes the loaded bag away from the delivery zone, the temporary support structure 237 and its associated component parts may not be always necessary and, therefore, may be omitted. However, so far illustrated, the automatic bagging apparatus is so designed that, even if the customer has not yet taken the loaded bag away from the delivery zone and, therefore, the loaded bag remains in the delivery zone, the automatic bagging apparatus can start its next succeeding cycle of operation in a rapid sequence. In order to achieve this, it is necessary to return the lifting carriage 214, which has been moved to the lifted position, back towards the lowered position leaving the loaded bag at the delivery zone. In view of this, it is the temporary support structure 237 that supports the loaded bag while permitting the lifting carriage 214 to return back towards the lowered position leaving the loaded bag at the delivery zone.

For detecting whether or not the loaded bag in the delivery zone immediately above the opening at the top of the front portion of the apparatus through which the lifting carriage 214 is exposed has been taken away from such delivery zone, a photoelectric detector PS2 of the same construction as that of the photoelectric detector PS1 (FIGS. 23 and 28) is employed, the function of which will be described subsequently.

The operation of the delivery unit of the construction as hereinbefore described will now be described.

Assuming that either one of the microswitches MS2 and MS3 depending upon the type of the bag selected, for example, the microswitch MS3, has been turned on in response to the return of the loader assembly D back to the rear retracted position while the bag, that is, the large size bag in this example, on the bag receptacle 89 has already been loaded with the goods or purchases, the motor M11 (FIG. 28) is rotated to bring the elongated plate 176, which has been brought to the clamping position with the lower clamping flap 178 held in position to clamp the lower lip of the bag between it and the support block 120 in the manner as best shown in FIG. 24(*c*), back towards the feed position as shown in FIG. 23. Upon arrival of the plate 176 back at the feed position, the microswitch MS24 is turned off by the cam 181 to deenergize the motor M11 on one hand and to energize the motor M12 on the other hand.

Upon rotation of the motor M12 in the manner described above, the platform 111 is pivoted from the horizontal position towards the tilted position together with the bag receptacle 89 having the loaded bag thereon. At the time of arrival of the platform 111 at the tilted position, the microswitch MS26 is switched off in contact with one end of the crank arm 204 remote from the platform 111 to deenergize the motor M12 on one hand and to energize both of the motors M11 and M13 on the other hand.

By the rotation of the motor M11 subsequent to the switching-off of the microswitch MS25, the plate 176 which has once been pivoted back to the feed position is brought to the clamping position so that, when the microswitch MS 25 is subsequently switched off in response to the arrival of the plate 176 at the clamping position to deenergize the motor M11, the side flaps 136 and 137 (FIG. 25) which have been held in the operative positions can be pivoted back towards the inoperative positions in a manner as will subsequently be described. It is to be noted that, because the lower clamping flap 178 projects outwards from the plate 176, when the latter is held in the feed position, to such an extent as to provide an obstruction to the return movement of the side flaps 136 and 137 from the operative positions back towards the inoperative positions, it is required to operate the motor M11 again when the side flaps 136 and 137 are required to be returned to the inoperative positions.

On the other hand, by the rotation of the motor M13 so energized in the manner described above, the bag receptacle 89 is pivoted from the receiving position towards the transfer position as shown by the broken line in FIG. 30, thereby transferring the loaded bag onto the transporting carriage 208 then held in the receiving position as shown by the solid line. At the time of completion of the pivotal movement of the bag receptacle 89 to the transfer position, the microswitch MS28 is switched off in contact with one end of the crank arm 207 remote from the receptacle 89 to deenergize the motor M13 on one hand to energize the motor M14 to rotate in the first direction on the other hand.

When the microswitch MS28 is so switched off while the microswitch MS25 is switched off in the manner described above, the motor M10 (FIG. 25) is reversed to rotate in the second direction to bring the side flaps 136 and 137 back towards the inoperative positions. At the time of completion of rotation of the side flaps 136 and 137 back to the respective inoperative positions, the microswitch MS23 is turned on to deenergize the motor M10 on one hand and to energize the motor M11 to bring the plate 176 from the clamping position back towards the feed position. Deenergization of the motor M11 takes place when the microswitch MS24 is turned off in the manner described above. Simultaneously with the switching-on of the microswitch MS23, the motor M9 is also energized to rotate in the second direction and, therefore, the upper clamping flap 159 is brought from the operative position back towards the inoperative position. At the time of completion of the movement of the upper clamping flap 159 back to the inoperative position, the microswitch MS19 is turned on by the cam 171, thereby deenergizing the motor M9. It is to be noted that the plates 160 and 161 of the upper clamping flap 159, which have been moved in a direction away from each other to move outwards by the energization of the solenoid units 172 and 174 are moved in a direction towards each other when the microswitch MS1 is turned on in response to the arrival of the loader assembly D at the pushed position, the switching-on of the microswitch MS1 in the manner resulting in deenergization of the solenoid units 172 and 174. Therefore, at the time the upper clamping flap 159 is pivoted back towards the inoperative position, the plates 160 and 161 of the upper clamping flap 159 have already been moved in the direction towards each other.

When the motor M14 is rotated in the first direction in the manner described above, the transporting carraige 208 is moved from the receiving position towards the lifting position as shown by the broken line in FIG. 30 with the loaded bag mounted on such carriage 208. Upon arrival of the transporting carriage 208 at the lifting position, the microswitch MS30 is turned on to deenergize the motor M14 on one hand and to energize the motor M15 to rotate in the first direction on the other hand, the rotation of the motor M15 in said first direction resulting in the movement of the lifting carriage 214 from the lowered position towards the lifted position.

As the lifting carriage 214 starts its movement towards the lifted position as shown by the broken line in FIG. 30, the fingers of the comb-shaped plates **215*a* and 216*a* of the respective support plates 215 and 216 forming the lifting carriage 214 pass through the corresponding spaces between the fingers of the comb-shaped seat plate 218*b* of the transporting carriage 208, thereby lifting the loaded bag upwardly from the transporting carriage 208. In this way, the loaded bag having been transferred onto the lifting carriage 208 is upwardly lifted by the lifting carriage 208 then moving towards the lifted position. The motor M15 rotated in the first direction is deenergized when the lifting carriage 214 arrives at the lifted position at which time the microswitch MS33 is turned on in contact with the feeler 214*a* fast with the lifting carriage 214**.

It is to be noted that, during the movement of the transporting carriage 208 from the receiving position towards the lifting position, the microswitch MS32 is turned on in contact with the feeler **209*a* fast with the transporting carriage 208. Upon closure of this microswitch MS32, the return movement of the bag receptacle 89 from the transfer position back towards the receiving position and that of the platform 111 from the tilted position back towards the horizontal position take place successively. More specifically, upon closure of the microswitch MS32 in the manner described above, the motor M13 is further rotated to bring the bag receptacle 89 from the transfer position towards the receiving position wherein the bag receptacle 89 is held flat against the platform 111 then in the tilted position. At the time of completion of the return of the bag receptacle back to the receiving position, the microswitch MS29 is switched off in contact with that end of the crank arm 207 to deenergize the motor M13 on one hand and to energize the motor M12** on the other hand.

By the rotation of the motor M12 effected in this manner, the platform 111 is pivoted from the tilted position back towards the horizontal position as shown by the solid line in FIG. 30. The motor M12 so rotated as to bring the platform 111 back to the horizontal position together with the bag receptacle 89 is deenergized when the microswitch MS27 is turned off in contact with that end of the crank arm 204.

Simultaneously with the switching off of the microswitch MS29, the motor M8 (FIGS. 20 to 22) is reversed to rotate in the second direction to move the lifting block 127 from the lifted position towards the lowered position in readiness for the subsequent cycle of operation of the automatic bagging apparatus. The motor M8 so rotated in the second direction is deenergized when the lifting block 127 arrives at the lowered position at which time the microswitch MS18 (FIG. 19) is turned off.

When the lifting carriage 214 arrives at the lifted position, the microswitch MS33 is switched on in contact with the feeler **214*a* fast with the carriage 214 to deenergize the motor M15 on one hand and to energize the motor M14** to rotate in the second direction.

By the rotation of the motor M14 in the second direction, the transporting carriage 208 is returned from the lifting position back towards the receiving position. Upon arrival of the transporting carriage 208 back at the receiving position, the microswitch MS31 is turned on to deenergize the motor M14 then rotated in the second direction. However, during the movement of the transporting carriage 208 from the lifting position back towards the receiving position, the microswitch MS32 is turned on.

When the microswitch MS32 is turned on in the manner described above while the microswitch MS33 has been turned on in response to the arrival of the lifting carriage 124 at the lifted position, the motor M16 is rotated through approximately 180° to cause the temporary support structure 239 to move angularly from the release position towards the support position as shown by the broken line in FIG. 30. It is to be noted that, at the time of arrival of the lifting carriage 214 at the lifted position, the photoelectric detector PS2 is in position to detect the presence of the loaded bag on the lifting carriage 214 and, therefore, generates a command signal indicative of the presence of the loaded bag in the delivery zone. So long as the photoelectric detector PS2 generates the command signal indicative of the presence of the loaded bag in the delivery zone, and when the temporary support structure 237 is subsequently pivoted to the support position, the microswitch MS35 is switched off by the cam 242 to deenergize the motor M16 on one hand and to energize the motor M15 to rotate in the second direction on the other hand.

Although the rotation of the motor M15 in the second direction results in the lowering of the lifting carriage 214 back towards the lowered position, the loaded bag which has been lifted by the lifting carriage 214 is supported on the temporary support structure 237 then already held in the support position and, therefore, remains lifted. The motor M15 then rotated in the second direction is deenergized at the time of arrival of the lifting carriage 214 at the lowered position at which time the microswitch MS34 is turned on.

The return movement of the temporary support structure 237 from the support position back towards the release position takes place when the customer takes the loaded bag in the delivery zone away. More specifically, when the customer takes the loaded bag away from the delivery zone, the photoelectric detector PS2 no longer generates the command signal indicative of the presence of the loaded bag in the delivery zone and, therefore, the motor M16 is further rotated through 180° to bring the temporary support structure 237 back towards the release position as shown by the solid line in FIG. 30. The further rotation of the motor M16 is interrupted when the microswitch MS36 is switched off by the cam 243 at the time of arrival of the temporary support structure 237 at the release position.

It is to be noted that, when the temporary support structure 237 is held in the support position, the microswitch MS36 is switched on by the cam 243 while the microswitch MS35 is switched off as hereinbefore described. If the microswitch MS36 is held in the on-state while the loaded bag is present in the delivery zone and on the temporary support structure 237, the switching-on of the microswitch MS32 which is effected during the subsequent movement of the transporting carriage 208 from the receiving position towards the lifting position with the next succeeding loaded bag mounted thereon results in deenergization of the motor M14 and, accordingly, the transporting carriage 208 having the next loaded bag mounted thereon is stopped at the stand-by position. However, when the microswitch MS36 is turned off upon rotation of the motor M16 as a result of removal of the loaded bag from the delivery zone, the motor M14 once temporarily interrupted is re-started to move the transporting carriage 208 from the stand-by position towards the lifting position.

(6) Pneumatic Circuit

As hereinbefore described, the pneumatic circuit best shown in FIGS. 34, 35 and 36 is operatively associated with the bag pick-up mechanism F, the suction opener and retainer H, and the air injector L. The pneumatic circuit comprises a blower assembly P and a distributor Q, the combination of which provides the source of compressed air for the air injector L and also the sources of suction for the bag pick-up mechanism F and the suction opener and retainer H.

Referring first to FIG. 35, the blower assembly P comprises a cylindrical casing 244 having its opposed ends tightly closed and having an intermediate partition wall 245 dividing the interior of the cylindrical casing 244 into air intake and discharge chambers 246 and 247. Rigidly mounted on the intermediate partition wall 245 is a blower 248 of any known construction so positioned that, during the operation of the blower 248, a stream of air flows from the air intake chamber 246 to the air discharge chamber 247 by way of the blower 248. The cylindrical casing 244 has air intake and discharge ports 244*a* and 244*b* which are communicated with the air intake and discharge chambers 246 and 247, respectively.

On the other hand, the distributor Q comprises a cylindrical casing 249 having its opposite, upper and lower ends tightly closed, inlet and outlet ports 249*a* and 249*b* both defined therein adjacent the closed upper end of the casing 249, and a discharge port 249*c* defined therein adjacent the closed lower end of the casing 249. The distributor Q is coupled to the blower assembly P with the inlet port 249*a* and the discharge port 249*c* communicated respectively with the discharge port 244*b* and the intake port 244*a* in a manner as best shown in FIG. 35.

The distributor Q further comprises a valving rotor 250 having an outer diameter substantially equal to or slightly smaller than the inner diameter of the distributor casing 249 and a length so selected as to be equal to or smaller than the interval between the inlet and discharge ports 249*a* and 249*c* as measured in the axial direction of the distributor casing 249. The valving rotor 250 is rotatably housed within the distributor casing 249 and is of a construction comprised of a hollow cylindrical wall rigidly mounted on a shaft 251 by means of a flange 252 protruding radially inwardly from a substantially intermediate portion of the hollow cylindrical wall, said hollow cylindrical wall being constituted by upper and lower cylindrical wall sections 253 and 254 one on each side of the radially inwardly protruding flange 252. The shaft 251 has one end journalled on the closed upper end of the casing 249 and the other end rotatably extending through the closed lower end of the casing 249 and situated outside the casing 249, said other end of said shaft having rigidly mounted thereon a drive gear 255, constantly engaged with a drive gear 256 fast with a drive shaft of an electrically operated motor M17, and a pair of switching cams 257 and 258.

With the valving rotor 250 rotatably housed within the distributor casing 249, the interior of the casing 249 is divided by the radially inwardly protruding flange 252 into supply and suction chambers 259 and 260 which are positioned above and below the radially inwardly protruding flange 252, respectively. The supply chamber 259 is communicated with the discharge chamber 247 on one hand and with the blower assembly L through the outlet port 249*b* by way of the tubing 193 on the other hand, whereas the suction chamber 260 is communicated with the intake chamber 246.

For the reason which will become clear from the subsequent description, the valving rotor 250 has four apertures 253*a*, 254A, 254*a* and 254*b*. The aperture 253*a* is defined in the upper cylindrical wall section 253 as best shown in FIG. 36(*a*). The aperture 254A is defined in the lower cylindrical wall section 254 at a position adjacent the flange 252 whereas the apertures 254*a* and 254*b* are both defined in the lower cylindrical wall section 254 at a position remote from the flange 252, said apertures 254*a* and 254*b* being angularly spaced a predetermined angle, for example, 60°, from each other about the longitudinal axis of the shaft 251 as best shown in FIG. 36(*c*).

The aperture 253*a* in the upper cylindrical wall section 253 of the valving rotor 250 is selectively held in communication with any one of first, second, third, fourth and fifth exhaust ports 261*a*, 261*b*, 261*c*, 261*d* and 261*e*, all being defined in the distributor casing 249 at a position aligned with the path of travel of the aperture 253*a* in the upper cylindrical wall section 253 of the valving rotor 250 as best shown in FIG. 36(*a*). While the fifth exhaust port 261*e* is angularly spaced 120° from the first exhaust port 261*a* in a direction counter to the direction of rotation of the valving rotor 250 shown by the arrow in FIG. 36(*a*), every adjacent two of these exhaust ports 261*a* to 261*e* are angularly spaced 60° from each other about the longitudinal axis of the shaft 251. All of these exhaust ports 261*a* to 261*e* are communicated with the atmosphere in any suitable manner known to those skilled in the art.

The aperture 254A in the lower cylindrical wall section 254 of the valving rotor 250 is selectively held in communication with any one of first, second, third, fourth and fifth ports 262*a*, 262*b*, 262*c*, 262*d* and 262*e*, all being defined in the distributor casing 249 at a position aligned with the path of travel of the apertures 254A as best shown in FIG. 36(*b*). While the fifth exhaust port 262*e* is angularly spaced 120° from the first port 262*a* in a direction counter to the direction of rotation of the valving rotor 250 shown by the arrow in FIG. 36(*b*), every adjacent two of these ports 262*a* to 262*e* are angularly spaced 60° from each other about the longitudinal axis of the shaft 251. The first port 262*a* is communicated with the atmosphere, the second port 262*b* is communicated with the suction head assembly 72 of the bag pick-up device Fb through the flexible tubing 80, the third port 262*c* is communicated with the suction head assembly 72 of the bag pick-up device Fa through the flexible tubing 80, the fourth port 262*d* is communicated with the atmosphere, and the fifth port 262*e* is communicated with a flexible distributor pipe 264 which is in turn communicated with the movable and stationary suction head assemblies 116 and 118 as will be described later.

Any one of the apertures 254*a* and 254*b* in the lower cylindrical wall section 254 of the valving rotor 250, which is spaced from the aperture 254A, is selectively held in communication with a suction port 263 defined in the distributor casing 249 at a position aligned with the path of travel of any one of such apertures 254*a* and 254*b*, said port 263 being communicated with a flexible distributor pipe 265 which is in turn communicated with the movable and stationary suction head assemblies 116 and 118 as will be described later.

It is to be noted that, while the various ports are defined in the distributor casing 249 in association with the apertures in the valving rotor 250, in terms of the direction parallel to the longitudinal axis of the distributor casing 249, the ports 261*a* and 262*e* are aligned with each other, the ports 261*c* and 262*a* are aligned with each other, the ports 261*d* and 262*b* are aligned with each other, the ports 261*e* and 262*c* are aligned with each other, and the ports 262*d* and 263 are aligned with each other.

As best shown in FIG. 35, the switching cams 257 and 258 are operatively associated respectively with microswitches MS37 and MS38, the microswitch MS37 being utilized to provide an electric signal indicative of any one of a plurality of positions of the valving rotor 250 during each complete rotation of said valving rotor 250 about the shaft 251 whereas the microswitch MS38 is utilized to provide an electric signal indicative of the initial position of the valving rotor 250. For this purpose, the switching cam 257 is of a construction comprising a disc having its peripheral portion formed with equally spaced recesses into which the actuating arm of the microswitch MS37 is selectively engageable, the number of said recesses in the cam 257 being equal to the number of the axial rows of the ports defined in the distributor casing 249 except for the ports 249*a*, 249*b* and 249*c*. On the other hand, the switching cam 258 is of a construction comprising a disc having its peripheral portion formed with a recess into which the actuating arm of the microswitch MS38 is engageable each time the valving rotor 250 completes its 360° rotation.

The operation of the drive motor M17 is controlled by a programmable microcomputer (not shown) according to a predetermined program and in reference to the signals generated from the microswitches MS37 and MS38, in a manner as will subsequently be described.

Referring particularly to FIGS. 19 and 34, the flexible tubing 264 having one end communicated with the port 262*e* in the distributor Q has the other end coupled to a divider 264*a* which is in turn communicated with the suction pipe 121*d* leading to the suction head 117*d* of the movable suction head assembly 116 and also to the suction head 119*d* of the stationary suction head assembly 118. On the other hand, the flexible tubing 265 having one end communicated with the port 263 has the other end connected to a divider 265*a* which is in turn communicated with all of the suction heads 119*a*, 119*b* and 119*c* of the stationary suction head assembly 118 and also with the suction pipes 121*a*, 121*b* and 121*c* leading to the respective suction heads 117*a*, 117*b* and 117*c* of the movable suction head assembly 116 by way of the coupler 122. The suction opener and retainer H employed in the automatic bagging apparatus embodying the present invention is so designed that, when the large size bag 10*a* is actually utilized in accommodating the goods or purchases and is, therefore, fed onto the bag receptacle 89 in the manner described hereinbefore, all of the suction heads 117*a* to 117*d* of the movable suction head assembly 116 and all of the suction heads 119*a* to 119*d* of the stationary suction head assembly 118 are utilized in cooperative relation to each other in the manner described above, but when the small size bag 10*b* is actually utilized for the same purpose and is, therefore, fed onto the bag receptacle 89, only the suction heads 117*a* to 117*c* and the suction heads 119*a* to 119*c* are utilized in cooperative relation to each other as can readily be seen from the description concerning the operation of the pneumatic circuit.

The operation of the pneumatic circuit of the construction as hereinbefore described will now be described.

Assuming that the valving rotor 250 is held in the initial position wherein, as shown in FIGS. 36(*a*) to 36(*c*), the aperture 253*a* is aligned with the exhaust port 261*a*, the aperture 254A is aligned with the port 262*b* and the apertures 254*a* and 254*b* are out of alignment with the port 263 and are spaced 180° and 240°, respectively, from the port 263 in the direction counter to the direction of rotation of the valving rotor 250 as shown by the arrow, the manipulation of the tray size selector switch PB2 does not bring about any change in position of the valving rotor 250. Starting from this condition, simultaneously with the manipulation of the tray size selector switch PB2, the blower 248 is brought into operation. During the operation of the blower 248, a negative pressure is developed in both the suction chamber 260 inside the distributor casing 249 and the air intake chamber 246 inside the blower casing 244 on one hand and a positive pressure is developed in both the air discharge chamber 247 inside the blower casing 244 and the supply chamber 259 inside the distributor casing 249. At this time, the supply chamber 259 is communicated with the atmosphere through the aperture 253*a* in the valving rotor 250 then aligned with the exhaust port 261*a* and, therefore, the suction head assembly 72 of the bag pick-up device Fb associated with the large size bags 10*a* is operated to pick up the uppermost one of the stacked large size bags 10*a* within the bag box 56 in the manner described hereinbefore.

After the large size bag 10*a* so picked up by the suction head assembly 72 of the bag pick-up device Fb has been transported onto the bag receptacle 89 in the manner as hereinbefore described, and when the command signal from the photoelectric detector PB1 is generated, the motor M17 is rotated stepwisely through an angle of 180° to bring the apertures 253*a*, 254A and 254*a* into alignment with the ports 261*a*, 262*e* and 263, respectively. Shortly before the generation of the command signal from the photoelectric detector PB1, the microswitch MS14 (FIG. 18) has already been switched off in response to the arrival of the selector roll 101 at the second position and, therefore, the blower 248 is brought into inoperative position in response to the switching-off of the microswitch MS14. It is to be noted that, although the air inside the supply chamber 259 also flows into the flexible tubing 193 during the operation of the blower 248, the rotary solenoid unit 199 is still deenergized and the rotor 199*a* is, therefore, held in the closed position without applying any blast of air through the nozzle members 191*a* to 191*d*.

Shortly thereafter and in the manner which will be described later, the blower 248 is brought into operation again and, as a result thereof, air inside both of the flexible tubings 264 and 265 is sucked into the suction chamber 260 inside the distributor casing 249. Accordingly, all of the suction heads 117*a* to 117*d* and 119*a* to 119*d* of both of the movable and stationary suction head assemblies 116 and 118 are operated to open the mouth of the large size bag 10*a* on the bag receptacle 89 in the manner as shown in FIGS. 24(*a*) to 24(*c*). At the same time as the opening of the mouth of the large size bag 10*a* completes as shown in FIG. 24(*c*), and in response to the switching-on of the microswitch MS15 which takes place incident to the arrival of the lift block 127 at the lifted position, the motor M17 is further stepwisely rotated through an angle of 120° or 300° from the initial position as shown in FIG. 36 while the blower 248 continues its operation. When the motor M17 is further rotated through 120° in the manner described above, the aperture 253*a* is closed, the aperture 254A is aligned with the port 262*a* leading to the atmosphere and neither the aperture 254*a* nor the aperture 254*b* is communicated with the port 263.

At the same time, in accordance with the program set in the microcomputer and in response to the switching-on of the microswitch MS15, the rotary solenoid unit 199 is energized twice in rapid sequence so that two successive blasts of air can be applied into the bag 10*a* through the opened mouth of such bag 10*a* to bring the latter into the completely opened condition in the manner hereinbefore described under the heading of "Air Injector". The time required to apply the two successive blasts of air would be two seconds and, after this time has passed, the motor M17 is then rotated to bring the valving rotor 250 to the initial position thereby completing the 360° rotation.

The above described operation of the pneumatic circuit is particularly applicable where the tray size selector switch PB2 has been manipulated, that is, when the large size bag 10*a* is desired to be used in packing the goods or purchases therein. However, even when the small size bag 10*b* is desired to be utilized in packing the goods or purchases therein, the pneumatic circuit of the construction described above operates in a manner substantially similar to that described above. In particular, when the tray size selector switch PB3 is manipulated, the motor M17 is rotated to bring the apertures 253*a* and 254A into alignment with the ports 261*e* and 262*c* and the operation starts from this condition, the microswitch MS13, instead of the microswitch MS14, and the microswitch MS16 instead of the microswitch MS16 are utilized. Furthermore, during the operation of the movable and stationary suction head assemblies 116 and 118, the aperture 254*b*, instead of the aperture 254*a*, is brought into alignment with the port 263.

(7) Control System

The sequence of operation of the various machine units constituting the automatic bagging apparatus according to the present invention is in practice controlled by the programmable microcomputer which does not constitute the subject matter of the present invention and, therefore, is not disclosed herein. However, it should be noted that, in the foregoing description of the various machine units of the automatic bagging apparatus, the switching-on of one particular microswitch does not necessarily mean that an electric circuit connecting between an electric motor and a source of electric power is completed, but means the position of the associated movable part is provided as information to be inputted to the microcomputer. Thus, the microcomputer controls the sequence of operation of the various machine units of the automatic bagging apparatus according to the preset program and in consideration of various information fed from the various microswitches and photoelectric detectors.

Bearing the above in mind, the operation of the entire automatic bagging apparatus will now be described.

In the first place, an operator of the automatic bagging apparatus embodying the present invention has to manipulate either one of the tray size selector switches PB2 and PB3, after having estimated the amount of the goods or purchases to be bagged. In the case where the tray size selector switch PB2 has been manipulated, the programmable microcomputer built in the apparatus controls the apparatus according to the program so formulated as to operate the various electric and/or electro-mechanical components of the apparatus in a predetermined sequence using the large size bag, whereas in the case where the tray size selector switch PB3 has been manipulated, the programmable microcomputer controls the electric and/or electro-mechanical components of the apparatus in a predetermined sequence using the small size bag. More specifically, when the tray size selector switch PB2 is manipulated, the microswitches MS2, MS5, MS9, MS11 (that included in the bag pick-up device Fb), MS13 and MS16 are brought into the inoperative position and are not, therefore, used in controlling the sequence of operation of the apparatus. On the other hand, when the tray size selector switch PB3 is manipulated, the microswitches MS3, MS6, MS10, MS11 (that included in the bag pick-up device Fa), MS14 and MS15 are brought into the inoperative position and are not, therefore, used in controlling the sequence of operation of the apparatus. In addition thereto, the manipulation of the tray size selector switch results in change in initial position of the valving rotor 250 of the distributor Q in such a manner that, when the tray size selector switch PB2 is manipulated, the initial position of the valving rotor 250 is such that the aperture 254A is communicated with the port 262*b* as shown in FIG. 36(*b*) and, when the tray size selector switch PB3 is manipulated, the initial position of the valving rotor 250 is such that the aperture 254A is communicated with the port 262*c*.

For the purpose of ready and better understanding of the operation of the automatic bagging apparatus of the present invention, it is assumed that the operator intends to cause the apparatus to pack the goods or purchases into a small size bag 10*b*. In this case, the first procedure to be taken is to manipulate the tray size selector switch PB3 to cause the microcomputer to operate according to the program associated with the utilization of the small size bag. If the movable framework 18 and the loader assembly D are respectively held in the expanded and rear retracted positions at the time of manipulation of the tray size selector switch PB3, they are moved to the contracted and front retracted positions, respectively. On the other hand, if the movable framework 18 and the loader assembly D are respectively held in the contracted and front retracted positions at the time of manipulation of the tray size selector switch PB3, they remain the same position because of the nature of the program set in the microcomputer.

In addition thereto, if the valving rotor 250 is in the position wherein the aperture 254A is communicated with the port 262*b* at the time of manipulation of the switch PB3, the motor M17 is energized to rotate the valving rotor 250 to the position wherein the aperture 254A is communicated with the port 262*c*. On the other hand, if the valving rotor 250 is in the position wherein the aperture 254A is communicated with the port 262*b* at the time of manipulation of the switch PB3, the motor M17 remains deenergized by the same token.

Subsequent to the manipulation of the tray size selector switch PB3, the operator can load the goods or purchases onto the tray assembly A. During the loading of the goods or purchases onto the tray assembly A, the motor M6 of the bag pick-up device Fa (FIGS. 10 and 13 to 17) is rotated in the first direction to bring the suction head assembly 72 from the upwardly shifted position towards the downwardly shifted position. Since the blower 248 of the blower assembly P (FIG. 35) has been operated while the aperture 254A in the valving rotor 250 is communicated with the port 262*c* as hereinbefore described, the suction force is developed in each of the suction heads 76 and 77 of the suction head assembly 72 of the bag pick-up device Fa and, therefore, the uppermost one of the small size bags 10*b* stacked in the box 55 is sucked thereby no sooner than the suction head assembly 72 arrives at the downwardly shifted position. When the suction head assembly 72 of the bag pickup device Fa arrives at the downwardly shifted position at which time the microswitch MS9 is turned on and the motor M6 is reversed to rotate in the second direction in response to the switching-on of the microswitch MS9. Upon rotation of the motor M6 in the second direction, the suction head assembly 72 is moved from the downwardly shifted position towards the upwardly shifted position with the small size bag 10*b* carried by the associated suction heads 76 and 77 and the upward movement of the suction head assembly 72 is interrupted when the microswitch MS11 in the bag pick-up device Fa is switched on in contact with the lift block 74.

In response to the arrival of the suction head assembly 72 of the bag pick-up device Fa at the upwardly shifted position, that is, the switching-on of the microswitch MS11, the motor M7 (FIG. 18) of the path selector 100 is rotated in the second direction, that is, counterclockwise as viewed in FIG. 18(*b*), to cause the selector roll 101 to assume the second position wherein said selector roll 101 is cooperative with the feed roll 94 to feed the small size bag 10*b* into the first passage Ga in the manner described hereinbefore. Prior to the small size bag 10*b* being fed into the first passage Ga completely, the microswitch MS14 is switched off by the cam 109*c*, fast with the drive shaft of the motor M7, in response to the arrival of the selector roll 101 at the second position and, consequently, the motor M7 and the motor M5 are deenergized and energized, respectively, on one hand and the blower 248, which has been operated to develop the suction force in the suction head assembly 72, is brought into the inoperative position.

By the rotation of the motor M5 (FIG. 10), the small size bag 10*b* which has partly been sandwiched between the feed roll 94 and the selector roll 101 in the second position is drawn into the first passage Ga and then fed towards the bag receptacle 89 in the manner as hereinbefore described.

When the trailing side of the small size bag 10*b* with respect to the direction of travel of the bag towards the bag receptacle 89 passes over and leaves the photoelectric detector PS1, the latter generates the first command signal and, in response to the generation of this first command signal, not only is the motor M7 rotated in the first direction until the selector roll 101 is brought to the stand-by position at which time the microswitch MS12 is turned off to deenergize the motor M7, but also the motor M17 (FIG. 35) is rotated through 180° to bring the aperture 254*b* in the valving rotor 250 into alignment with the port 263 in the distributor casing 249.

By an electric signal generated from the microswitch MS37 which is indicative of the fact that the aperture 254*b* has been brought into alignment with the port 263, the motor M8 is energized to rotate in the first direction on one hand and the blower 248 is brought into operation on the other hand. When the motor M8 is so rotated in the first direction, the lift block 127 in the downwardly shifted position as shown in FIG. 20 is upwardly shifted while the lift lever 132 is pivoted clockwise, as viewed in FIGS. 20 to 21, towards the second operative position by the effect of the weight of the cage 124 then descending under the influence of the gravitational force. Therefore, the movable suction head assembly 116 is brought to the downwardly shifted position as shown in FIG. 21. Since the blower 248 has already been brought into operation at this time and, therefore, a suction force has already been developed in the flexible tubing 265 and, hence, the suction heads 117*a* to 117*c* and 119*a* to 119*c* of the respective movable and stationary suction head assemblies 116 and 118, the upper and lower lips of the mouth of the bag 10*b* lying on the bag receptacle 89 are respectively sucked by the movable and stationary suction head assemblies 116 and 118 in the manner as hereinbefore described.

As the lift block 127 further elevates towards the lifted position, the lift block 127 becomes engaged with the upper frame member 124*a* of the cage 124 then in the downwardly shifted position and subsequently lifts the cage 124 upwardly substantially as shown in FIG. 22. Simultaneously with the upward movement of the cage 124 caused by the upward movement of the lift block 127, the movable suction head assembly 116 is moved from the downwardly shifted position towards the upwardly shifted position, thereby lifting the upper lip of the mouth of the bag 10*b* in a direction away from the lower lip of the mouth of the bag 10*b* which is sucked by and retained in position by the stationary suction head assembly 118.

The rotation of the motor M8 in the first direction is interrupted when the microswitch MS16 is turned on in contact with the lift block 127, whereupon the lift block 127 is held in the lifted position.

However, during the upward shift of the lift block 127 towards the lifted position, the microswitch MS17 is turned on in contact with the lift block 127 and, therefore, the upper clamping flap 159 is brought to the operative position on one hand and the elongated plate 176 is brought to the clamping position on the other hand in the manner as hereinbefore described in connection with the operation of the bag mouth opening unit. In addition, in response to the switching-on of the microswitch MS20 which is effected by the switching cam 171 fast with the drive shaft of the motor M9 during the pivotal movement of the upper clamping flap 159 from the inoperative position towards the operative position, not only are the solenoid units 172 and 174 energized to move the plates 160 and 161 in a direction away from each other to stretch the upper clamping flap 159, but also the side flaps 136 and 137 are brought to the operative positions as hereinbefore described. By so doing, the mouth of the small size bag lying on the bag receptacle 89 is completely opened and retained in the opened position.

The pivotal movement of the upper clamping flap 159 from the inoperative position to the operative position and that of the elongated plate 176 from the feed position to the clamping position are completed simultaneously with or shortly before the arrival of the lift block 127 at the lifted position. When the microswitch MS16 is switched on incident to the arrival of the lift block 127 at the lifted position, the motor M17 is further stepwisely rotated through 60° while the blower 248 continues its operation. The further 60° rotation of the motor M17 results in that the suction chamber 260 is communicated with the atmosphere through the aperture 254A then aligned with the port 262*a*. At the same time, in response to an electric signal generated by the microswitch MS37 which is indicative of the fact that the aperture 254A is aligned with the port 262*a*, the rotary solenoid unit 199 is energized twice in rapid sequence in accordance with the program set in the microcomputer and, accordingly, two successive blasts of air fed through the flexible tubing 193 are applied into the mouth-opened bag 10*b* on the bag receptacle 89 by means of the air injector L.

By the application of the two successive blasts of air into the mouth-opened bag 10*b* on the bag receptacle 89, the small size bag 10*b* is brought into the completely opened condition. Thereafter, the motor M17 is rotated to the initial position while the blower 248 is brought into the inoperative position, completing one cycle of operation of the pneumatic circuit.

Thus, the small size bag 10*b* on the bag receptacle 89 is held in position ready to receive the goods or purchases therein. By this time or shortly thereafter, the operator of the automatic bagging apparatus may complete the loading of the goods or purchases onto the tray assembly A. The subsequent procedure to be taken after the goods or purchases to be bagged have been placed or loaded on the tray assembly A is to manipulate the start switch PB1.

Upon manipulation of the start switch PB1, the gate assembly 34 is brought to the opened position in the manner hereinbefore described and, in response to the switching-on of the microswitch MS7 (FIG. 8), the tray assembly A and the loader assembly D are simultaneously moved from the retracted position and the front retracted position towards the inserted position and the pushed position, respectively, in the manner as hereinbefore described. By so doing, the goods or purchases on the tray assembly A are, while pushed by the loaded assembly D, inserted into the completely opened small size bag 10*b* on the bag receptacle 89.

The tray assembly A so moved to the inserted position is immediately returned back towards the retracted position when the microswitch MS1 is switched on in response to the arrival of the loader assembly D at the pushed position. At the same time, the solenoid units 172 and 174 are deenergized to move the plates 160 and 161 of the upper clamping flap 159 in a direction towards each other in response to the switching-on of the microswitch MS1. When the tray assembly A arrives at the retracted position at which time the microswitch MS4 is turned on, the loader assembly D starts its return movement back towards the front retracted position.

Upon completion of the return movement of the loader assembly D back to the front retracted position at which time the microswitch MS2 is turned on, the elongated plate 176 of the lower clamping device I is temporarily pivoted from the clamping position towards the feed position. The rotation of the motor M11 to bring the elongated plate 176 towards the feed position is interrupted when the microswitch MS24 is turned off by the switching cam 181 fast with the drive shaft of the motor M11.

In response to the switching-off of the microswitch MS24, the motor M12 (FIG. 30) is rotated and the platform 111 is consequently pivoted from the horizontal position towards the tilted position together with the bag receptacle 89 having the loaded bag 10*b* thereon. Thereafter, the bag erecting mechanism M, the bag transporting mechanism N and the bag lift O are sequentially operated in the manner as hereinbefore fully described in connection with the operation of the delivery unit under the heading of "Delivery Unit". Nevertheless, during the operation of the delivery unit, the elongated plate 176 temporarily pivoted to the feed position is again pivoted to the clamping position to allow the side flaps 136 and 137 to be returned back to the inoperative positions and, thereafter, the elongated plate 176 is returned back to the feed position on one hand and the upper clamping flap 159 is returned back to the inoperative position on the other hand as hereinbefore described in connection with the operation of the delivery unit. In addition, the lift block 127 is moved to the initial, lowered position in response to the arrival of the bag receptacle 89 at the transfer position, which has already been described in connection with the operation of the delivery unit.

In this manner, the automatic bagging apparatus embodying the present invention completes one cycle of operation thereof with the various movable component parts being returned their respective original positions in readiness for the subsequent cycle of operation. However, it is to be noted that, even if the photoelectric detector PS2 (FIG. 30) is in position to detect the presence of the loaded bag on the temporary support structure 237 then held in the support position as shown by the bottom line in FIG. 30, that is, even when the loaded bag is left unremoved from the temporary support structure 237 in the support position and, therefore, the photoelectric detector PS2 does not generate the second command signal, the automatic bagging apparatus can undergo the subsequent cycle of operation. In this case, so long as the previously loaded bag remains unremoved from the temporary support structure 237, the transporting carriage 208 carrying the bag, either the large size one or the small size one, which is loaded with goods or purchases during the next succeeding cycle of operation of the automatic bagging apparatus, is held at the stand-by position which is substantially intermediate between the receiving position and the lifting position and where the microswitch MS32 is installed.

Although the present invention has fully been described in connection with the preferred embodiments thereof with reference to the accompanying drawings, it is to be noted that various changes and modifications will readily be conceived by those skilled in the art. By way of example, as best shown in FIGS. 40 and 41, in order to avoid the possibility that the loaded bag being erected with the bag receptacle 89 pivoting from the receiving position towards the transfer position while the platform 111 is held in the tilted position may undesirably tilt towards the transporting carriage 208 before the arrival of the bag receptacle 89 at the transfer position due to the displacement of the center of gravity of the loaded bag and/or the abrupt movement of some of the goods or purchases inside the bag towards the bottom of such bag (which possibility often occurs particularly where relatively heavy goods or purchases are packed in the bag at a region adjacent the mouth thereof rather than adjacent the bottom thereof), the bag receptacle 89 may have a rigid guard band 300 of substantially U-shaped configuration. So far illustrated, the rigid guard band 300 has an elongated guard portion 300*a* having its opposite ends from which respective arms 300*b* and 300*c* protrude outwardly, the respective free ends of said arms 300*b* and 300*c* being so pivotally connected to the bag receptacle 89 by means of associated hinge pins (only one of which is shown by 301) that, when the guard band 300 is in an operative position as shown by the solid line in FIGS. 40 and 41, the guard portion 300*a* encircles the loaded bag in cooperation with the bottom surface 89*a* and side walls 89*b* and 89*c* of the bag receptacle 89 at a position adjacent the mouth of the loaded bag, and when the guard band 300 is in a release position as shown by the broken line in FIG. 41, the loaded bag is free to separate away from the bag receptacle 89. For pivotally moving the guard band 300 in the manner as hereinbefore described, an electric motor M18 connected to the bag receptacle 89 in spaced relation thereto and any suitable transmission system are utilized. So far illustrated in FIG. 40, the transmission system for transmitting a drive of the motor M18 to the guard band 300 comprises a crank arm 302 having one end pivotally connected to the arm 300*b* and the other end pivotally connected to a connecting rod 303 which is in turn rigidly connected to the drive shaft of the motor M18 through a connecting arm 304 having its opposite ends rigidly connected respectively to the connecting rod 303 and the drive shaft of the motor M18. This transmission system so far illustrated in FIG. 40 is so designed that, starting from the condition as shown by the solid line, that is, wherein the guard band 300 is held at the operative position, 180° rotation of the motor M18 results in the pivot of the guard band 300 to the release position as shown by the broken line in FIG. 41.

Where the arrangement shown in FIGS. 40 and 41 is employed, the motor M18 is preferably rotated in response to the switching-off of the microswitch MS28 (FIG. 30) to bring the guard band 300 from the operative position towards the release position and further rotated, or reversed if the motor M18 is an electric reversible motor, in response to the switching-off of the microswitch MS29 (FIG. 30) to bring the guard band from the release position towards the operative position. In practice, microswitches MS39 and MS40 operatively associated with a switching cam 305 rigidly mounted on the drive shaft of the motor M18 are utilized for interruption of the rotation of the motor M18 to hold the guard band 300 respectively at the release position and the operative position.

In addition, the automatic bagging apparatus has been described as having the tray size adjusting mechanism. However, the tray size adjusting mechanism B may not be always necessary and may, therefore, be omitted if desired. If the tray size adjusting mechanism B is omitted, not only can the path selector 100 (FIGS. 10 and 18) be omitted, but also either one of the bag boxes 55 and 56 and its associated suction head assembly 72 may be omitted. In particular, where the tray size adjusting mechanism B is omitted and, therefore, the automatic bagging apparatus is made to utilize bags of one size, the bottom surface 89*a* of the bag receptacle 89 is preferably formed, at a position relatively adjacent the comb-shaped end wall 89*d*, with a recess 89*f* of a width slightly smaller than the width of the bags utilizeable. The employment of the recess 89*f* in the bottom surface 89*a* of the bag receptacle 89 is advantageous in that, when the bag receptacle 89 is being pivoted from the receiving position towards the transfer position while the platform 111 is held in the tilted position, one side end of the loaded bag adjacent its bottom which faces the bottom surface 89*a* can freely pivot without being collapsed in contact with the bottom surface of the bag receptacle 89 when the loaded bag in the bag receptacle tends to tilt.

Furthermore, in view of the fact that, when the bag on the bag receptacle 89 is merely mouth-opened at the time of the loading of the goods or purchases into such bag, the bag tends to be torn off when contacted with some of the goods or purchases being loaded, the employment of a photoelectric detector for detecting whether or not the bag on the bag receptacle has completely been opened by the application of the successive blasts of compressed air is preferred. Where the photoelectric detector is employed. It may be of a type comprising a light emitter and a light receiver, and it may be mounted on the bag receptacle 89 in such a manner as shown by PS4 in FIGS. 22 and 23. By the utilization of the photoelectric detector PS4, it is possible to suspend the insertion of the goods or purchases into the bag when the bag on the bag receptacle 89 has not yet been opened completely. So fas as the small size bags are involved, they can be brought to the completely opened condition more readily than the large size bags and, therefore, no photoelectric detector for this purpose may be necessary. However, the use of two photoelectric detectors, one being associated with the large size bags such as shown by PS4 and the other being associated with the small size bags, may be employed.

The photoelectric detector PS4 may also be used as a control for controlling the operation of the rotary solenoid 199 (FIG. 39). More specifically, should the bag on the bag receptacle 89 fail to be completely opened when the only blast of compressed air is applied thereto through the air injector L, the photoelectric detector PS4 generates an electric signal indicative of the incomplete opening of the bag, with which the rotary solenoid 199 is again energized to apply the next suceeding blast of compressed air. By applying the blasts of compressed air in this manner, the bag can assuredly be opened completely.

Yet, in order to avoid the passage of the goods or purchases excessively placed on the tray assembly A into the bag past the gate assembly 34 (FIG. 8) which would be likely to break the upper lip of the completely opened bag, another photoelectric detector of a type comprising a light emitter and a light receiver may also be employed such as shown by PS3 in FIG. 3. The light emitter and receiver of the photoelectric detector PS3 are so positioned that a beam of light emitted from the light emitter travels towards the light receiver at the level parallel to or slightly below the upper lip of the completely opened bag on the bag receptacle 89. By the utilization of the photoelectric detector PS3, it is possible to suspend the movement of the tray assembly from the retracted position towards the inserted position when the goods or purchases are excessively loaded onto the tray assembly A.

Furthermore, each of the bottom walls 55*d* and 56*d* of the respective boxes 55 and 56 may have a counter weight rigidly or adjustably secured thereto at a position remote from the corresponding stop 58 or 62 so that, as the bags in the corresponding box 55 or 56 are consumed, the bottom wall 55*d* or 56*d* can be upwardly pivoted to compensate for reduction in weight of the bags acting thereon.

Yet, although in the foregoing description it has been described that the boxes 55 and 56 accommodate the respective stacks of small and large size bags, they may contain the respective stacks of bags of equal size. In this case, the bags in one of the boxes 55 and 56 can be used when and after the bags in the other of the boxes 55 and 56 have been consumed, thereby enabling the apparatus to accommodate a relatively large number of bags of equal size.

Accordingly, these and other changes and modifications which are regarded as routine expedients obvious to those skilled in the art without departing from the true scope of the present invention are to be construed as included within such true scope of the present invention.

What is claimed is:

1. An automatic bagging apparatus for automatically packing articles to be bagged into a bag, which comprises, in combination:

a movable tray assembly for the support of the articles to be bagged, said tray assembly being supported for movement between retracted and inserted positions and having a generally U-shaped cross section as viewed in the direction of movement thereof;

a bag receiving means positioned adjacent the inserted position of the tray assembly and remote from the retracted position thereof for the support of a bag in a manner with its mouth facing towards the tray assembly;

a bag container for the storage of at least one stack of bags to equal size in collapsed condition;

means for successively feeding the bags from the bag container towards the bag receiving means one at a time;

a loader assembly supported for movement between forward and withdrawn positions in a direction parallel to the direction of movement of the tray assembly, said loader assembly substantially forming the rear wall of the tray assembly with respect to the direction of movement of the tray assembly towards the inserted position and being operable to engage and push the to-be-bagged articles towards the bag lying on the bag receiving means during the movement of the tray assembly, said tray assembly when moved to the inserted position having its front portion inserted into the bag on the bag receiving means;

a first drive means operable in first and second modes one at a time, said first drive means when in the first mode moving the tray assembly from the retracted position towards the inserted position and, when in the second mode, moving the tray assembly from the inserted position back towards the retracted position;

a second drive means operable in first and second modes one at a time, said second drive means being adapted to be operated in the first mode, when the first drive means is operated in the first mode, to move the loader assembly from the withdrawn position towards the forward position simultaneously with the movement of the tray assembly from the retracted position towards the inserted position and also to be operated in the second mode in response to the arrival of the tray assembly at the retracted position to move said loader assembly back towards the withdrawn position independently of the tray assembly, said first drive means being operated in the second mode in response to the arrival of the loader assembly at the forward position;

means operable subsequent to the arrival of the bag at the bag receiving means for opening the mouth of the bag on the bag receiving means to bring said bag into a mouth-opened condition;

means operable subsequent to the opening of the mouth of the bag on the bag receiving means for retaining the mouth of the bag on the bag receiving means in the open condition until the loader assembly which has been moved to the forward position is returned towards the withdrawn position subsequent to the return of the tray assembly to the retracted position leaving the to-be-bagged articles inside the completely opened bag;

a source compressed air;

means operable subsequent to the opening of the mouth of the bag on the bag receiving means for applying compressed air into the mouth-opened bag to bring the latter into a completely opened condition, said first and second drive means being adapted to be operated in the respective first modes after the mouth-opened bag has completely been opened by the application of the compressed air thereinto, said compressed air applying means including a nozzle assembly positioned facing the mouth of the bag on the bag receiving means and means interposed between said nozzle assembly and said source of compressed air for alternately placing the passage between the nozzle assembly and the source of compressed air in communication with and cutting it off from the source of compressed air in rapid succession for a predetermined number of cycles;

a photoelectric detector for detecting whether or not the bag on the bag receiving means has been completely opened by the application of the successive blasts of compressed air supplied by said compressed air applying means, and when said detector detects that the opening of the bag is complete, for allowing operation of both said drive means to be normally operated in predetermined succession while, and said detector detects that the opening of the bag is not complete, blocking operation of both of said drive means instantly until the unopened bag is replaced by a new one.

2. An apparatus as claimed in claim 1, further comprising a gating assembly supported for movement between closed and opened positions in a direction perpendicular to the direction of movement of the tray assembly, said gating assembly when in the closed position substantially forming the front wall of the tray assembly in a position opposed to the loader assembly, said gating assembly when in the opened position permitting the passage of the tray assembly and the loader assembly past said gating assembly; and a third drive means operable in first and second modes one at a time, said third drive means being operated in the first mode, when the tray assembly is to be moved towards the inserted position with the to-be-bagged articles carried thereby and pushed by the loader assembly, to move the gating assembly from the closed position towards the opened position and in the second mode to move the gating assembly from the closed position back towards the opened position in response to and subsequent to the return of the loader assembly to the withdrawn position.

3. An apparatus as claimed in claim 1, further comprising means positioned on one side of the bag receiving means remote from the tray assembly for erecting the bag which has been loaded with the articles to a position with its mouth facing upwards.

4. An apparatus as claimed in claim 3, further comprising means for receiving the loaded bag from the erecting means and transporting said loaded bag towards a delivery zone spaced a distance from the article receiving zone.

5. An apparatus as claimed in claim 1, wherein said bag receiving means comprises a bag receptacle constituted by a generally rectangular bottom wall, a pair of opposed side walls and one end wall positioned frontwardly with respect to the direction of movement of the tray assembly from the retracted position towards the inserted position.

6. An apparatus as claimed in claim 1, wherein each of said first and second drive means comprises an electric reversible motor having a drive shaft, an elongated threaded shaft having one end operatively coupled to the drive shaft of the electric reversible motor, and a bearing member having a threaded hole defined therein and mounted axially movably on the threaded shaft while said threaded shaft threadingly extends through the threaded hole in the bearing member, said threaded shaft being rotated in one direction of two opposite directions about its own longitudinal axis when one of the first and second drive means is operated in the first mode and in the other of the opposite directions when one of the first and second drive means is operated in the second mode, said tray assembly and said loader assembly being rigidly mounted on the respective bearing members of the first and second drive means.

7. An apparatus as claimed in claim 1, further comprising means for detecting whether or not an excessive number of articles to be bagged are deposited on the tray assembly and blocking the movement of the tray assembly from the retracted position towards the inserted position only when an excessive number of articles to be bagged are deposited on the tray assembly.

8. An apparatus as claimed in claim 1, wherein said bag mouth opening means comprises a movable suction head assembly including a plurality of suction heads adapted to engage the upper lip of the mouth of the bag fed onto the bag receiving means, a stationary suction head assembly including a plurality of suction heads adapted to engage the lower lip of the mouth of the bag on the bag receiving means, a source of vacuum communicated to the suction heads of each of the movable and stationary suction head assemblies, said movable suction head assembly being supported for movement in a direction away from the stationary suction head assembly, the mouth of the bag on the bag receiving means being opened as the movable suction head assembly is moved in a direction away from the stationary suction head assembly while the suction heads of the movable suction head assembly and the suction heads of the stationary suction head assembly suck the upper and lower lips of the mouth of the bag on the bag receiving means, respectively, and a fourth drive means for moving the movable suction head assembly in the direction away from and towards the stationary suction head assembly.

9. An apparatus as claimed in claims 1, 2, 3, 4, 5, 6 or 8, wherein said bag feeding means comprises a suction head assembly communicated to a source of vacuum, said suction head assembly being supported for movement between a lowered position, wherein said suction head assembly is positioned inside the bag container, and an elevated position wherein said suction head assembly is positioned upwardly of and outside the bag container, and a fifth drive means for moving the suction head assembly between the lowered and elevated positions, said suction head assembly being adapted to be communicated with the source of vacuum during the movement thereof from the lowered position to the elevated position sucking the bag inside the container, said bag so sucked being picked off of the remaining bags in the container and upwardly transported by said suction head assembly by the suction force as said suction head assembly is moved towards the elevated position, and a passage means extending from the elevated position towards the bag receiving means and including a plurality of pairs of feed rolls through which the bag is transported towards the bag receiving means.

10. An apparatus as claimed in claim 9, wherein said source of compressed air, said source of vacuum for the movable and stationary suction head assemblies of the bag mouth opening means and said source of vacuum for the suction head assembly of the bag feeding means are constituted by a blower assembly having suction and discharge chambers and an air current producing means for developing positive and negative pressures respectively in said discharge and suction chambers during the operation of said air current producing means, and a distributor having a rotary valving body rotatably housed therein and dividing the interior of said distributor into suction and discharge compartments respectively communicated to the suction and discharge chambers, said distributor further having at least first, second and third ports defined therein, said first port being communicated to the discharge compartment and forming the source of compressed air, the second port being communicable to the suction compartment and forming the source of vacuum for the movable and stationary suction head assemblies, and said third port being communicable to the suction compartment and forming the source of vacuum for the suction head assembly of the bag feeding means, said second and third ports being communicated to the suction compartment through the rotary valving body at different times according to the position of the rotary valving body, and a sixth drive means for intermittently rotating said rotary valving body.

11. An apparatus as claimed in claim 1, wherein said bag mouth retaining means comprises an elongated upper flap supported for pivotal movement between operative and inoperative positions and engageable with the upper lip of the mouth of the bag on the bag receiving means from below, an elongated lower flap supported for pivotal movement between operative and inoperative positions and engageable with the lower lip of the mouth of the same bag from above, a pair of opposed, elongated side flaps each being supported for movement between operative and inoperative positions and engageable with a corresponding side wall of the bag connecting between the upper and lower lips thereof, a seventh drive means for moving the upper flap between the operative and inoperative positions, an eighth drive means for moving the lower flap between the operative and inoperative positions and a ninth drive means for moving the side flaps simultaneously between the operative and inoperative positions, said upper and lower flaps when pivoted to their respective operative positions clamping the upper and lower lips of the mouth-opened bag on the bag receiving means in cooperation with the movable and stationary suction head assemblies, respectively, and said side flaps when pivoted to their respective operative positions contacting the opposed side walls of the mouth-opened bag connecting between the upper and lower lips thereof to widen the opened mouth of the bag.

12. An apparatus as claimed in claim 9, wherein said upper flap comprises a pair of elongated plate members connected together for telescopic movement in a direction away from and towards each other, and further comprising means for biasing said elongated plate members in a direction towards each other and means operable in response to the arrival of the upper flap at the operative position for moving the elongated plate members in a direction away from each other to substantially stretch the opened mouth of the bag widthwise.

13. An apparatus as claimed in claim 1, wherein said tray assembly is constituted by a pair of opposed first and second plate structures of substantially L-shaped cross section as viewed in the direction of movement of the tray assembly, said first plate structure being rigidly mounted on the bearing member of the first drive means, and a guiding frame structure supported for movement between at least maximum and minimum width positions in a direction perpendicular to the direction of movement of the tray assembly and having first and second guide rods extending in parallel relation to each other and also to the direction of movement of the tray assembly, said second plate structure of the tray assembly being axially movably mounted on the first guide rod, wherein said loader assembly is constituted by a pair of opposed first and second loader members connected together for telescopical movement relative to each other in correspondence with a change in width of the tray assembly as measured in a direction perpendicular to the direction of movement of the tray assembly, the first loader member being rigidly mounted on the bearing member of the second drive means and said second loader member of the loader assembly being axially movably mounted on the second guide rod, and further comprising a tenth drive means operatively coupled to the guiding frame structure for selectively bringing said guiding frame structure to the maximum and minimum width positions, the width of the tray assembly being adjusted to a smaller value when the guiding frame structure is in the minimum width position than when said guiding frame structure is in the maximum width position.

14. An apparatus as claimed in claim 13, wherein said bag container comprises at least first and second boxes disposed in end-to-end relation to each other with respect to the direction of movement of the tray assembly, said first box being adapted to accommodate another stack of smaller bags than those of said at least one stack of bags which are accommodated in said second box, and wherein said bag feeding means comprises a pair of suction head assemblies of the same construction operatively associated respectively with the first and second boxes and communicated to a source of vacuum, each of said suction head assemblies being supported for movement between a lowered position, wherein said respective suction head assembly is positioned inside the corresponding box, and an elevated position wherein said respective suction head assembly is positioned upwardly of and outside the corresponding box, and an eleventh drive means for moving the respective suction head assembly between the lowered and elevated positions, said suction assembly being adapted to be communicated with the source of vacuum during the movement thereof from the lowered position to the elevated position, said suction head assembly when in the lowered position sucking the bag inside the container, said bag so sucked being picked off of the remaining bags in the corresponding box and upwardly transported by said suction head assembly by and the suction force as said respective suction head assembly is moved towards the elevated position, and a passage means having first, second and third passage sections all connected together at one end, said first passage section leading towards the bag receiving means, said second passage section leading towards the first box and said third passage section leading towards the second box, and including a plurality of pairs of feed rolls through which the bag is transported towards the bag receiving means, and a path selector means for connecting a selected one of the second and third passage sections to the first passage section.

15. An apparatus as claimed in claim 14, wherein said upper flap comprises a pair of elongated plate members connected together for telescopic movement in a direction away from and towards each other, and further comprising means for biasing said elongated plate members in a direction towards each other and means operable in response to the arrival of the upper flap at the operative position for moving the elongated plate members in a direction away from each other to substantially stretch the opened mouth of the bag widthwise.

16. An apparatus as claimed in claim 8 wherein the generally rectangular wall of the bag receptacle is outwardly indented to provide a substantially rectangular recess for accommodating a loose pivotal movement of the loaded bag during the pivotal movement of the bag receptacle from the receiving positionn towards the erected position.

17. An automatic bagging apparatus for automatically packing articles to be bagged in a bag, which comprises, in combination:

a movable tray assembly for the support of the articles to be bagged, said tray assembly being supported for movement between retracted and inserted positions and having a generally U-shaped cross section as viewed in the direction of movement thereof;

a bag receiving means positioned adjacent the inserted position of the tray assembly and remote from the retracted position thereof for the support of a bag in a position with its mouth facing towards the tray assembly;

a bag container for the storage of at least one stack of bags of equal size in collapsed condition;

means for successively feeding the bags from the bag container towards the bag receiving means one at a time;

a loader assembly supported for movement between forward and withdrawn positions in a direction parallel to the direction of movement of the tray assembly, said loader assembly substantially forming the rear wall of the tray assembly with respect to the direction of movement of the tray assembly towards the inserted position and being operable to withhold and push the to-be-bagged articles towards the bag lying on the bag receiving means during the movement of the tray assembly, said tray assembly when moved to the inserted position having its front portion inserted into the bag on the bag receiving means;

a first drive means operable in first and second modes one at a time, said first drive means when in the first mode moving the tray assembly from the retracted position towards the inserted position and, when in the second mode, moving the tray assembly from the inserted position back towards the retracted position;

a second drive means operable in first and second modes one at a time, said second drive means being adapted to be operated in the first mode, when the first drive means is operated in the first mode, to move the loader assembly from the withdrawn position towards the forward position simultaneously with the movement of the tray assembly from the retracted position towards the inserted position and also to be operated in the second mode in response to the arrival of the tray assembly back at the retracted position to move said loader assembly back towards the withdrawn position independently of the tray assembly, said first drive means being operated in the second mode in response to the arrival of the loader assembly at the pushed position;

a means operable subsequent to the arrival of the bag at the bag receiving means for opening the mouth of the bag receiving means to bring said bag to an open-mouthed condition;

a means operable subsequent to the opening of the mouth of the bag on the bag receiving means for retaining the mouth of the bag on the bag receiving means in the open-mouthed condition until the loader assembly which has been moved to the forward position is returned towards the withdrawn position subsequent to the return of the tray assembly to the retracted position leaving the to-be-bagged articles inside the completely opened bag;

a source of compressed air;

a means operable subsequent to the retaining of the mouth of the bag in the open-mouthed condition on the bag retaining means for supplying compressed air into the open-mouthed bag to bring the latter to a completely opened condition, said first and second drive means being adapted to be operated in the respective first modes after the open-mouthed bag has been completely opened by the application of the compressed air thereinto, said compressed air applying means including a nozzle assembly positioned facing the mouth of the bag on the bag receiving means and means interposed between said nozzle assembly and said source of compressed air for alternately placing the passage between the nozzle assembly and the source of compressed air in communication with and out of communication with said source of compressed air in rapid succession for a predetermined number of cycles;

a means positioned on one side of the bag receiving means remote from the tray assembly for erecting the bag which has been loaded with the articles with its mouth facing upwards, and comprising a generally elongated pivotable platform, said bag receptacle being pivotally connected at one end of the bottom wall adjacent said one end wall thereof to said pivotable platform for pivotal movement between receiving and erected positions, said pivotable platform being supported for pivotal movement between horizontal and tilted positions about the point of pivot which is located at a position remote from the point of pivotal connection of the bag receptacle to the pivotable platform;

a third drive means for moving the platform from the horizontal position towards the tilted position with the bag receptacle being correspondingly tilted together with said pivotable platform; and a fourth drive means operable in response to the arrival of the pivotable platform at the tilted position for moving the bag receptacle from the receiving position towards the erected position, the sum of the angle through which the pivotable platform is moved between the horizontal and tilted positions and the angle through which the bag receptacle is moved between the receiving and erected positions being approximately 90°.

18. An apparatus as claimed in claim 17, further comprising means installed on the bag receptacle for avoiding any possible separation of the loaded bag away from the bag receptacle during the pivotal movement of the bag receptacle from the receiving position towards the erected position.

19. An apparatus as claimed in claim 18, wherein said avoiding means comprises a substantially U-shaped guard band having its opposite ends pivotally connected to the respective side walls of the bag receptacle at a position remote from the end wall of said bag receptacle, and a drive means for moving the guard band between an operative position, in which a substantially intermediate portion of said guard band extends substantially in parallel and spaced relation to the bottom wall of the bag receptacle to hold the loaded bag between it and the bottom wall of the bag receptacle, and a release position in which said substantially intermediate portion thereof is held in position clear of the loaded bag, said drive means being operated to move the guard band from the operative position towards the release position in response to the arrival of the bag receptacle at the erected position.

* * * * *